US006523941B2

(12) United States Patent
Asakawa et al.

(10) Patent No.: US 6,523,941 B2
(45) **Date of Patent: *Feb. 25, 2003**

(54) LIQUID DISCHARGING METHOD AND LIQUID DISCHARGING HEAD

(75) Inventors: Yoshie Asakawa, Hotaka-machi (JP); Hiroyuki Ishinaga, Tokyo (JP); Toshio Kashino, Chigasaki (JP); Aya Yoshihira, Yokohama (JP); Kiyomitsu Kudo, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/890,645

(22) Filed: Jul. 9, 1997

(65) Prior Publication Data

US 2002/0186282 A1 Dec. 12, 2002

(30) Foreign Application Priority Data

Jul. 9, 1996 (JP) ..... 8-179686
Jul. 4, 1997 (JP) ..... 9-179995

(51) Int. Cl.[7] ..... B41J 2/05
(52) U.S. Cl. ..... 347/65
(58) Field of Search ..... 347/65, 63, 20

(56) References Cited

U.S. PATENT DOCUMENTS

| | | | | |
|---|---|---|---|---|
| 4,480,259 A | | 10/1984 | Kruger et al. | 347/63 |
| 4,587,534 A | | 5/1986 | Saito et al. | |
| 4,723,129 A | | 2/1988 | Endo et al. | 347/56 |
| 5,182,577 A | | 1/1993 | Ishinaga et al. | |
| 5,278,585 A | | 1/1994 | Karz et al. | 347/65 |
| 5,485,186 A | * | 1/1996 | Ishinaga | 347/65 |
| 5,821,962 A | * | 10/1998 | Kudo | 347/65 |

FOREIGN PATENT DOCUMENTS

| | | | |
|---|---|---|---|
| EP | 0373894 A2 | 6/1990 | |
| EP | 0593051 A1 | 4/1994 | |
| EP | 0721842 A2 | 7/1996 | B41J/2/05 |
| EP | 0813967 A2 | 12/1997 | B41J/2/14 |
| JP | 55081172 | 6/1980 | |
| JP | 61069467 | 4/1986 | |
| JP | 63199972 | 8/1988 | |

* cited by examiner

*Primary Examiner*—Benjamin R. Fuller
*Assistant Examiner*—C. Dickens
(74) *Attorney, Agent, or Firm*—Fitzpatrick, Cella, Harper & Scinto

(57) ABSTRACT

A liquid discharging method which employs a liquid discharging head consisting of a liquid discharging port, a bubble generating region where the bubble generates in the liquid and a movable member that can move between a first position and a second position which is located at a point farther from the bubble generating region compared with the first position, wherein the movable member moves from the first position to the second position by the pressure of the bubble generated by the bubble generating energy in the bubble generating region, and at the same time the bubble expands farther toward the downstream direction compared with the upstream direction by the displacement of the movable member in order to discharge the liquid out of the liquid discharging port by the liquid discharging energy applied to such liquid. The movable member has its free end in the downstream side with respect to its fulcrum and the liquid is discharged by applying the discharging energy corresponding to a saturation domain where the amount of the liquid to be discharged out of the liquid discharging port is substantially saturated in accordance with the increase of the discharging energy.

48 Claims, 26 Drawing Sheets

LIQUID DISCHARGING METHOD AND LIQUID DISCHARGING HEAD

BACKGROUND OF THE INVENTION

1. Field of the Invention

The present invention relates to a liquid discharging method to discharge the required amount of a liquid by the bubble generated by applying the thermal energy to the liquid as well as a liquid discharging head, a head cartridge and a liquid discharging device.

2. Related Background Art

A conventional ink jet recording method, so-called a bubble jet recording method is well known which causes the status change of ink with sudden volume change (bubble generation) by applying such pulse energy as heat pulse etc., to ink according to a signal to be recorded to discharge ink from an ink discharging port by a pressure caused by such status change in order to apply ink onto a record medium. As disclosed in U.S. Pat. No. 4,723,129, a recording device using the above-mentioned bubble jet recording method generally comprises an ink discharging port, an ink flow path connected with such ink discharging port, an electro-thermal converting element as a means for generating energy to discharge ink provided in the ink flow path.

It is possible to record an image of high quality at a high speed with low noise by this recording method. At the same time, the ink discharging ports can be arranged in high density on a recording head for such recording method. Therefore, the bubble jet recording method has many advantages. For example, an image of high resolution and even a color image can be recorded by means of a compact equipment. For this reason, the bubble jet recording method has been recently applied not only to various kinds of office apparatus such as a printer, a copying machine, and a facsimile, but also to industrial systems such as a textile printing machine.

With the diffusion of bubble jet technology into various fields as described above, in recent years, the following developments have been made:

For example, a heat generating element has been optimized by adjusting the thickness of a protective film to improve energy efficiency. This improvement is effective to enhance the heat transfer efficiency to a liquid such as ink. On the other hand, a driving condition for discharging a liquid such as ink properly at a high speed with stable bubble generation to obtain a high quality image has been proposed. An improved flow path shape has also been proposed to obtain a liquid discharging head with high refilling speed to fill a liquid flow path with a liquid after a liquid discharging process in order to achieve high speed recording.

Various flow path shapes have been proposed, as described above. Japanese Patent Application Laid-Open No. 63-199972 discloses a flow path construction shown in FIGS. 36A and 36B. The invention disclosed in the patent is the flow path construction and head manufacturing process based on back wave due to bubble generation (a pressure in a direction opposite to a liquid discharging port, that is, a pressure toward a liquid chamber 12). The back wave is known as an opposite energy because it is not the energy in the liquid discharging direction.

In the case of the flow path construction shown in FIGS. 36A and 36B, a valve 10 is installed at a location on a side opposite to the liquid discharging port 11 with respect to the heat generating element 2, apart from the bubble generating region of the heat generating element. The valve 10 is manufactured from a plate, etc. As shown in FIG. 36B, it has an initial position on the ceiling of the flow path 3. When the bubble generates, it droops into the flow path 3. In the case of the invention shown FIGS. 36A and 36B, the valve 10 controls part of the back wave to check the movement of the back wave toward an upstream side. As a result, an energy loss is controlled. However, the careful examination of the bubble generating process reveals that the control of part of the back wave by the valve 10 installed in the flow path 3 containing a liquid to be discharged is not preferable for the liquid discharging process. That is, originally, the back wave itself does not have a direct influence on the liquid discharging process as described above. When the back wave generates in the flow path 3, as shown in FIG. 36A, a pressure having a direct influence on the liquid discharging process can discharge a liquid from the flow path 3. Therefore, the control of the back wave, especially the control of part of the back wave does not have a great influence on the liquid discharging process.

On the other hand, in the case of the bubble jet recording method, due to the repetition of the heating process under the condition that the heat generating element is in contact with ink, burned ink may accumulate on the surface of the heat generating element. Some kind of ink leaves much burned ink and results in unstable bubble generation. As a result, smooth ink discharge is not guaranteed. Therefore, the development of a process to discharge a liquid smoothly without denaturing it has been eagerly waited, even through a liquid to be discharged is apt to deteriorate and even though such liquid does not generate sufficient bubble.

Japanese Patent Application Laid-Open Nos. 61-69467, 55-81172 and U.S. Pat. No. 4,480,259, etc., disclose a process in which two kinds of liquid, namely, a bubble-generating liquid and a liquid to be discharged (a discharging liquid) are employed separately to discharge the latter by giving the bubble pressure to the latter. In the case of these inventions, ink, the liquid to be discharged is completely separated from the bubbling liquid by means of a flexible membrane made of silicone rubber, etc. so that the former does not come into contact with the latter, and at the same time the pressure due to bubble generation is transmitted to the liquid to be discharged by the displacement of the flexible membrane. By such configuration, the accumulation of burned liquid on the surface of the heat generating element can be prevented and the liquid to be discharged can be more freely selected.

However, in the case of the above-mentioned head configuration in which the liquid to be discharged is completely separated from the bubbling liquid, the pressure due to bubble generation is transmitted to the liquid to be discharged by the expansion/contraction and the displacement of the flexible membrane, so the considerable portion of such pressure is absorbed by such membrane. In addition, the flexible membrane does not displace much, so an advantage due to the separation of the liquid to be discharged from the bubbling liquid can be obtained, but the energy efficiency and the liquid discharging pressure may lower.

Some inventors of the present invention made the following analyses to provide a novel liquid discharging method using the bubble as well as a head, etc. for such method based on the principle of a liquid droplet discharging process: the first technical analysis to analyze the principle of the mechanism of a movable member in a flow path based on its behavior; the second analysis to analyze the principle of the droplet discharge by the bubble pressure; the third analysis to analyze the bubble generating region of a heat generating element. As a result, it becomes possible to improve the basic discharging properties of the liquid discharging method by the bubble (the bubble due to film boiling) generated in the flow path to such high level not expected from the conventional viewpoint.

The present applicant has established an entirely novel method for controlling the bubble actively by arranging the fulcrum of the movable member on the upstream side and its free end on the discharging port side, namely, on the downstream side, and at the same time by arranging the movable member itself in the heat generating element area or the bubble generating area based on the results of the above-mentioned analyses. The present applicant has applied such method to be patented. More particularly, it was found out that the bubble discharging properties could be greatly improved by the growing portion of the bubble generated in the downstream side, taking the energy of the bubble itself for the liquid discharging amount into consideration. It was also found out that the above-mentioned bubble has the greatest influences on the liquid discharging properties. In other words, the liquid discharging efficiency and the liquid discharging speed can be improved by efficiently directing such growing bubble portion toward the liquid discharging direction. The method in accordance with the present invention achieves very high technical level compared with the conventional liquid discharging method by positively moving the growing portion of the bubble in the downstream side to the free end of the movable member. In the case of the present invention, it is preferable to investigate the structural factors of the movable member, the flow path, etc., relating to the bubble generation on the downstream side from a center line of the heat generating region, for example, an area in the flowing direction of the liquid passing through a electrothermal converting element or on the downstream side from a center line of the bubble generating surface area. On the other hand, a liquid refilling speed can be greatly improved by modifying the arrangement of the movable member and the structure of a liquid supply path.

U.S. Pat. No. 5,821,962 to Kudo et al. shows a liquid ejecting head for ejecting liquid by generation of a bubble. The head includes an ejection outlet through which the liquid is ejected, a liquid flow path in fluid communication with the ejection outlet, a bubble generation region for generating the bubble in the liquid and a moveable member disposed opposite to the bubble generation region. The head is provided with a base portion wherein the moveable member is displaced by pressure produced upon bubble generation to eject the liquid through the ejection outlet. Kudo et al. however, do not disclose any particular relationship between the applied discharge energy and the discharge volume; and Kudo et al. do not disclose how to use such relationship to stabilize the amount of liquid ejected.

As described above, the present invention is directed to the liquid discharging method and the liquid discharging head in which the bubble generating direction is concentrated on the downstream side by arranging the movable member in a direction opposite to the bubble generating region in the liquid path. The present invention aims at the improvement of liquid discharging efficiency and stability by improved liquid discharging principle to use the bubble energy more effectively by modifying the structure of the movable member and the flow path. The present invention also aims at the achievement of surprisingly stable liquid discharging performance by discovering a novel liquid discharging amount control means. The principal objects of the present invention are as follows:

SUMMARY OF THE INVENTION

It is the first object of the present invention to provide a liquid discharging method and a liquid discharging head in which the volume in a space from a liquid discharging port to the free end of a movable member is controlled as the liquid amount to be discharged.

It is the second object of the present invention to provide a liquid discharging method and a liquid discharging head in which discharging performance is more stable by applying the liquid discharging energy higher than that required for discharging the liquid amount to be discharged from the liquid discharging port to the free end of the movable member.

It is the third object of the present invention to provide a liquid discharging method and a liquid discharging head in which meniscus refilling speed after a liquid droplet discharging process is enhanced.

It is the fourth object of the present invention to provide a novel liquid discharging principle by controlling the generated bubble drastically.

It is the fifth object of the present invention to provide a liquid discharging method and a liquid discharging head, etc., in which the liquid can be discharged smoothly by enhancing the liquid discharging efficiency and the liquid discharging pressure and by reducing the heat accumulated in the liquid on the heat generating element and at the same time by decreasing remaining bubble on the heat generating element.

It is the sixth object of the present invention to provide a liquid discharging head, etc., in which liquid refilling frequency is increased and the printing speed, etc., is improved by decreasing the inertia in a direction opposite to the liquid supply direction due to the back wave and at the same time by reducing meniscus backward motion by means of the valve function of the movable member.

It is the seventh object of the present invention to provide a liquid discharging method and a liquid discharging head, etc., with sufficiently high liquid discharging efficiency and liquid discharging pressure in which the accumulation of burned liquid on the heat generating element can be reduced and by which the applications of the liquid to be discharged can he extended.

It is the eighth object of the present invention to provide a liquid discharging method and a liquid discharging head, etc., in which the kind of the liquid to be discharged can be more freely selected.

It is the ninth object of the present invention to provide a liquid discharging head and device which can be easily manufactured at low cost by constructing a liquid introduction path for supplying a plurality of liquids with less parts and to provide a compact liquid discharging head, device, etc.

In the case of the above-mentioned liquid discharging head equipped with a movable member in a flow path in accordance with the present invention which discharges the liquid droplets out of the liquid discharging port by displacing such movable member by the bubble generated in the bubble generating region, more stable liquid discharging amount and more high speed liquid refilling properties can be achieved by limiting the liquid discharging amount to a certain level when the energy applied for discharging the liquid reaches a certain value and by discharging the liquid in such limited domain. The typical requirements to achieve the above-mentioned purposes are as follows:

The liquid discharging method in accordance with the present invention employs the liquid discharging head consisting of the liquid discharging port; the bubble generating region where the bubble generates in the liquid; and the movable member which can move between a first position and a second position which is located at a point farther from the bubble generating region compared with the first position. In this liquid discharging head, the movable member moves from the first position to the second position by the pressure of the bubble generated by the bubble generating energy in the bubble generating region. At the same time, the bubble expands farther toward the downstream direction compared with the upstream direction by the displacement of the movable member. Under this condition, the liquid is discharged out of the liquid discharging port by the liquid discharging energy applied to such liquid. In this case, the movable member has its free end in the downstream side with respect to its fulcrum, and the amount of the liquid to be discharged out of the liquid discharging port is controlled by the liquid discharging energy contained in the saturation domain to be saturated in accordance with the increase of such energy.

Alternately, the liquid discharging method in accordance with the present invention employs the liquid discharging head consisting of the liquid discharging port; a first liquid flow path connected with the liquid discharging port; a second liquid flow path including the bubble generating region; and the movable member equipped with its free end in the side of the liquid discharging port and located between the first liquid flow path and the bubble generating region. In this liquid discharging head, the free end of the movable member moves toward the first liquid flow path by the pressure of the bubble generated by the bubble generating energy in the bubble generating region. Under this condition, the liquid is discharged out of the liquid discharging port by the liquid discharging energy applied to such liquid by introducing the pressure due to the displacement of the movable member. The amount of the liquid to be discharged out of the liquid discharging port is controlled by the liquid discharging head according to the energy contained in the saturation domain to be saturated in accordance with the increase of such energy.

Alternately, the liquid discharging method in accordance with the present invention supplies the liquid from the upstream side of the heat generating element along such element located in the liquid flow path; generates the bubble by heating the liquid with the heat generated by the heat generating element activated by the bubble generating energy; displaces the free end of the movable member which is equipped with such free end on the liquid discharging port side and faces the heat generating element by the pressure of the bubble generated; and discharges the liquid out of the liquid discharging port by applying the liquid discharging energy to the liquid by introducing the pressure due to the displacement of the movable member into the liquid discharging port side. Under this condition, the liquid is discharged in a domain where the amount of the liquid to be discharged out of the liquid discharging port is substantially saturated with the increase of the liquid discharging energy.

Alternately, the liquid discharging method in accordance with the present invention employs the movable member equipped with its displaceable free end on the liquid discharging port side; displaces the movable member by the bubble including at least a pressure component directly acting on the liquid droplet discharging operation, after causing film boiling by applying the bubble generating energy to the liquid; and discharges the liquid out of the liquid discharging port by applying the liquid discharging energy to the liquid by introducing the bubble including the pressure component into the liquid discharging port side. Under this condition, the liquid is discharged by applying the liquid discharging energy corresponding to the domain where the amount of the liquid to be discharged out of the liquid discharging port is substantially saturated with the increase of the liquid discharging energy.

Alternately, the liquid discharging method in accordance with the present invention in which the liquid droplets are discharged out of the liquid discharging port situated on the downstream side of the bubble generating side with respect to the liquid droplet discharging direction in a direction not opposite to the bubble generating region by the bubble generated by the bubble generating energy in the bubble generating region. The above-mentioned liquid discharging method employs the movable member equipped with the free end which seals the liquid discharging port side domain of the bubble generating region from the liquid discharging port, and equipped with a surface ranging from the fulcrum situated on the side opposite to the liquid discharging port with respect to the free end. The above-mentioned liquid discharging method discharges the liquid by opening the bubble generating region to the liquid discharging port by moving the substantially sealed free end, and by applying the liquid droplet discharging pressure to the liquid. Under this condition, the liquid is discharged by applying the liquid discharging energy corresponding to the domain where the amount of the liquid to be discharged out of the liquid discharging port is substantially saturated with the increase of the liquid discharging energy.

Alternately, the liquid discharging head consists of the liquid discharging port; the bubble generating region where the bubble generates in the liquid; and the movable member which is arranged in the bubble generating region and can move between a first position and a second position which is located at a point farther from the bubble generating region compared with the first position. In this liquid discharging head, the movable member moves from the first position to the second position by the pressure of the bubble generated by the bubble generating pulse energy in the bubble generating region. At the same time, the bubble expands further toward the downstream direction compared with the upstream direction by the displacement of the movable member. In this case, the liquid is discharged out of the liquid discharging port by the liquid discharging energy applied to such liquid. Under this condition, the liquid is discharged by applying the liquid discharging energy corresponding to the domain where the amount of the liquid to be discharged out of the liquid discharging port is substantially saturated with the increase of the liquid discharging energy.

Alternately, the liquid discharging head consists of a first liquid flow path connected with the liquid discharging port; a second liquid flow path including the bubble generating region where the bubble generate in the liquid with the heat applied to the liquid by the bubble generating energy; and the movable member equipped with its free end on the side of the liquid discharging port and located between the first liquid flow path and the bubble generating region. In this liquid discharging head, the liquid is discharged by moving the free end of the movable member toward the first liquid flow path by the pressure of the bubble generated in the bubble generating region, and by applying the bubble generating energy to the liquid by introducing the pressure to the liquid discharging port side of the first liquid flow path. Under this condition, the amount of the liquid to be discharged out of the liquid discharging port is substantially saturated with the increase of the liquid discharging energy.

Alternately, the liquid discharging head in accordance with the present invention consists of the liquid discharging port; the liquid flow path including the heat generating element for generating the bubble in the liquid by heating the liquid and a liquid supply path for supplying the heat generating element with the liquid from the upstream side of the heat generating element along such element; the movable member having its free end on the liquid discharging port side and facing the heat generating element and introducing the pressure into the liquid discharging port by displacing the free end by the pressure of the bubble generated. When the liquid is discharged out of the liquid discharging port by the liquid discharging energy from the heat generating element, the amount of the liquid to be discharged out of the orifice is substantially saturated with the increase of the liquid discharging energy.

Alternately, the liquid discharging head in accordance with the present invention consists of the liquid discharging port; the heat generating element for generating the bubble in the liquid by heating the liquid; the movable member having its free end on the liquid discharging port side and facing the heat generating element and introducing the pressure into the liquid discharging port side by displacing the free end by the pressure of the bubble generated; and the liquid supply path for supplying the heat generating element with the liquid from the upstream side along the surface near to the heat generating element. When the liquid is discharged out of the liquid discharging port by the liquid discharging energy from the heat generating element, the amount of the liquid to be discharged out of the liquid discharging port is substantially saturated with the increase of the liquid discharging energy.

Alternately, the liquid discharging head in accordance with the present invention consists of a plurality of the liquid discharging ports; plurality of grooves for forming a plurality of first liquid flow paths connects directly with each corresponding liquid discharging port; grooved member including concave portion forming first common liquid chamber for supplying a plurality of the first liquid flow paths above-mentioned with the liquid; an element substrate including a plurality of heat generating elements for generating the bubble in the liquid by heating it; a separation wall which is situated between the grooved element and the element substrate, constitutes a part of the wall of second liquid flow path corresponding to the heat generating elements and includes the movable member situated at a position facing the heat generating elements and displaceable toward the first liquid flow path by the bubble pressure. When the liquid is discharged out of the liquid discharging port by the liquid discharging energy from the heat generating element, the amount of the liquid to be discharged out of the liquid discharging port is substantially saturated with the increase of the liquid discharging energy.

Alternately, the liquid discharging head cartridge in accordance with the present invention consists of the liquid discharging head and a liquid container for containing the liquid to be supplied to the liquid discharging head.

Alternately, the liquid discharging device in accordance with the present invention consists of the liquid discharging head and a driving signal supply means for supplying a driving signal to discharge the liquid out of the liquid discharging head.

Alternately, the liquid discharging device in accordance with the present invention consists of the liquid discharging head and a recording medium transport means for transporting such recording medium to receive the liquid discharged out of the liquid discharging head.

According to the liquid discharging method, liquid discharging head, etc., of the present invention, the liquid discharging efficiency is improved by the synergetic effects of the bubble generated and the movable member displaceable by such bubble. At the same time, both very stable liquid discharging amount and more speedy liquid refilling properties can be obtained by discharging the liquid in a domain where the amount of the liquid to be discharged out of the liquid discharging port is saturated with the increase of the liquid discharging energy. As a result, stable bubble generation and stable liquid droplet formation can be achieved, and at the same time a high quality image can be recorded at a high speed by discharging the liquid at a rapid speed. The resulting image has very high quality with very slight variation and unevenness in its density because the variation of the liquid discharging amount due to the environmental changes and the uneven properties inherent for the head is very slight.

The other advantages of the present invention will be understood more clearly with reference to the following description of the preferred embodiments of the present invention.

The terms "upstream" and "downstream" in the present patent specification are used with respect to direction in which the liquid flows from the liquid supply source to the liquid discharging port through the bubble generating region (or the movable member) and the direction opposite to such direction respectively.

The "downstream side" with respect to the bubble itself chiefly means the bubble discharging port side directly relating to the liquid droplet discharging process. More particularly, such term means the downstream side of the central portion of the bubble in the liquid flow direction and in the configuration arrangement and a domain on the downstream side of the centerline of the heat generating element.

The term "substantial sealing" means the condition that the bubble cannot pass through a slit around the movable member before the displacement of the movable member during a bubble growing process.

The term "separation wall" means in a broad sense a wall (which may include the movable member) for separating the bubble generating region and an area directly communicating with the liquid discharging port, and in a narrow sense a wall which separates the liquid flow path containing the bubble generating region from the liquid flow path directly communicating with the liquid discharging port to prevent mixing of the liquids in the liquid flow paths.

The term "displacement trace of the free end of the movable member" means an arc-like face drawn by the displacement of the movable member around its fulcrum. If such arc is small, it can be regarded as a flat surface.

The term "substantially saturated saturation domain" of the liquid discharging amount means an area including a perfect saturation area in which the liquid discharging area $S_o$ ($\mu m^2$) of the liquid discharging face multiplied by a distance OE ($\mu$m) from the liquid discharging face to the displacement trace, or track surface drawn by the free end of the movable member, as well as an area from a inflection point at which the curve leaves a domain where the liquid discharging amount is proportional to effective bubble generating area to such perfect saturation area. The above-mentioned inflection point changes slightly according to the liquid conditions, head discharging port shape or the area changes near to the liquid discharging port. However, it can be represented by $0.9S_o \cdot OE$ in a range less than 150 $\mu$m for the liquid discharging head. This inflection point is the physical pulling-back component to pull back the liquid which is being drawn back during the liquid discharging process. It corresponds to the pulling-back force around the liquid discharging port. It can be regarded as ($2\pi R \times 1\ \mu m$) at the maximum. Therefore, the substantial saturation area containing the inflection point is expressed as $(S_o - 2\pi R) \times OE$.

The term "recording" means a process for forming a meaningful image such as a character, and figure on a recording means and a process for forming a meaningless image such as a pattern.

DETAILED DESCRIPTION OF THE PREFERRED EMBODIMENTS

Figure 1A:
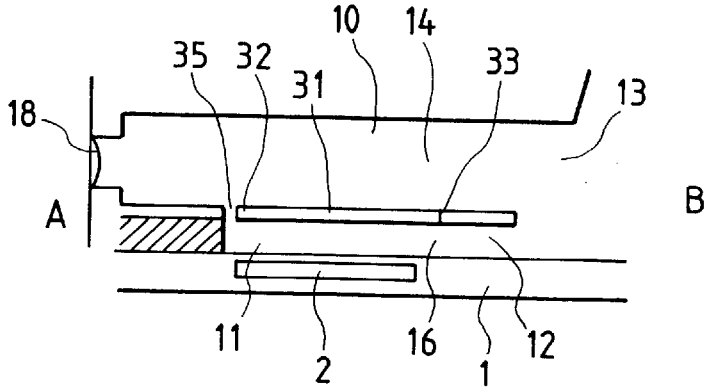
FIGS. 1A, 1B, 1C and 1D show schematic sectional views of the liquid discharging process of the liquid discharging principle of the present invention.

The present invention will be described below with reference to the appended drawings. Prior to the description of the preferred embodiments, the principle of the liquid discharging operation on which the present invention operates will be described. According to the principle of the liquid discharging operation of the present invention, the liquid discharging force and the liquid discharging efficiency are improved by controlling the bubble pressure transmission direction and the bubble growing direction for discharging the liquid by means of the movable member installed in the liquid flow path.

FIGS. 1A to 1D show the sectional views of the liquid discharging head in accordance with the present invention cut along the liquid flow path direction. These figures show the liquid droplet discharging process based on the above-mentioned liquid discharging principle sequentially. FIG. 2 shows a partial sectional perspective view of such liquid discharging head. FIG. 2 also shows the configuration of the liquid discharging head of a first embodiment of the present invention described later.

In the case of such liquid discharging head, a heat generating element 2 (in the present embodiment, the heat generating element is 40 $\mu$m×105 $\mu$m in size) for applying the thermal energy to the liquid as a liquid discharging energy generating element is installed in an element substrate 1. On such element substrate 1, a liquid flow path 10 is arranged along the heat generating element 2. The liquid flow path 10 communicates with a liquid discharging port 18 and at the same time with a common liquid chamber 13 for supplying a plurality of the liquid flow paths 10 with the liquid. The liquid flow path 10 receives the liquid in the amount equal to the liquid to be discharged out of the liquid discharging port from such common liquid chamber 13.

A plate-shaped movable member 31 is made of elastic material such as metals and equipped with a flat portion. It is mounted on the element substrate 1 for the liquid flow path 10, facing the heat generating element 2. One end of the movable member is fixed on a base (a support) 34 formed by patterning photosensitive resin, etc., on the wall of the liquid flow path wall 10 and the element substrate in the form of a cantilever. The base 34 supports the movable member 31 and at the same time serves as its fulcrum (its support section) 33.

The movable member 31 has a fulcrum (a support section, namely, a fixing point) 33 on the upstream side of a large liquid flow due to the liquid discharging operation from the common liquid chamber 13 to the liquid discharging port 18 through the movable member 31. It is installed at a position about 15 $\mu$m apart from the heat generating element 2 facing such element 2 so that it covers such 2 and its free end (its free end portion) 32 is situated on the downstream side of the fulcrum 33. The bubble generating region exists between the heat generating element 2 and the movable member 31. The kind, shape and layout of the heat generating element 2 and the movable member 31 are not limited to the above-mentioned ones. If the movable member can control the bubble formation and the pressure transmission described below, any kind, shape and layout will do. For the clearer description of the liquid flow described later, the above-mentioned liquid flow path 10 is divided into two domains by the movable member 31, namely, a first liquid flow path 14 directly communicating with the liquid discharging port 18 and a second liquid flow path 16 having the bubble generating region 11 and the liquid supply path 12.

When the energy is supplied to the heat generating element 2, the liquid in the bubble generating region 11 between the movable member 31 and the heat generating element 2 is heated. As a result, the bubble is generated in the liquid due to film boiling described in U.S. Pat. No. 4,723,129. The pressure and the bubble due to the bubble generating process act on the movable member 31 preferentially. As shown in FIGS. 1B, 1C and FIG. 2, the movable member 31 moves around the fulcrum so that it opens widely toward the liquid discharging port side. The bubble pressure and the growing bubble itself are directed toward the liquid discharging port 18 according to the displacement degree of the movable member 31.

One of the liquid discharging principles of the present invention will be described below. One of the most important principles of the present invention is that the movable member 31 facing the bubble moves from the first position, namely, the stationary position to the second position, namely, the displaced position by the bubble pressure or the bubble itself, and the bubble pressure or the bubble itself are pushed toward the downstream side where the liquid discharging port is installed by means of the movable member 31.

The above-mentioned principle will be described in more detail by comparing the schematic diagram of a conventional liquid flow path not using the movable member in FIG. 3 with the present invention in FIG. 4. In these figures, VA shows the pressure transmission direction toward the liquid discharging port and VB shows that toward the upstream side.

Figure 3:
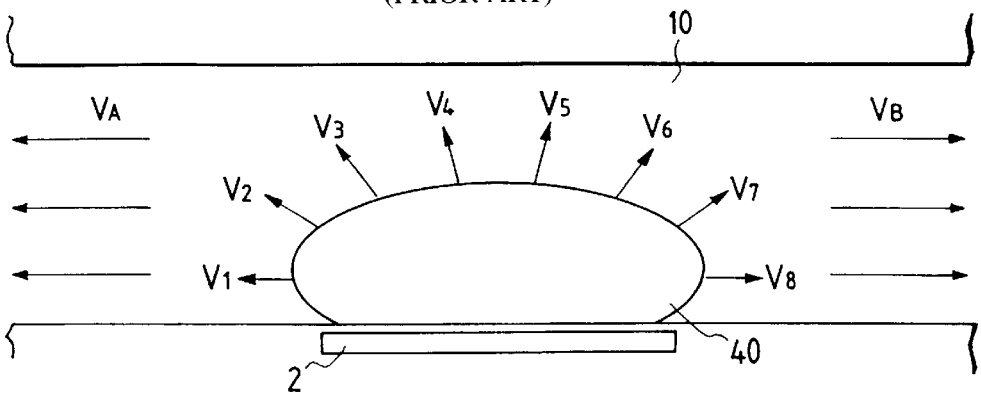
FIG. 3 (PRIOR ART)
FIG. 3 shows a schematic view of the pressure transmission from the bubble in a conventional liquid discharging head.

The conventional liquid discharging head in FIG. 3 has no mechanism for controlling the pressure transmission direction of the bubble 40. Therefore, such pressure of the bubble 40 is transmitted in various directions, namely, in the normal lines of the bubble 40 as indicated by V1–V8. Of these components, V1–V4, the components nearer to the liquid discharging port viewed from the center of the bubble has the most powerful influence on the liquid discharging process in the VA direction. These components are the important forces having the direct influences on the liquid discharging efficiency, liquid discharging force, liquid discharging speed, etc. Of these components, V1–V4, V1 has the greatest influence and V4 has the least influence on the liquid discharging process in the VA direction.

Figure 4:
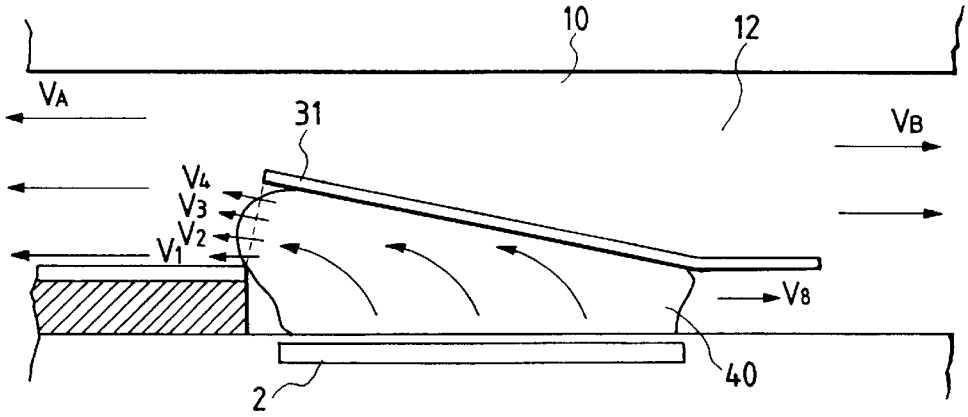
FIG. 4 shows a schematic view of the pressure transmission from the bubble in the liquid discharging head of FIG. 1.

Conversely, in the case of the present invention in FIG. 4, all the components, V1–V4 which are transmitted in the various ways are directed toward the downstream side (the liquid discharging port) by means of the movable member 31, namely, the VA pressure transmission direction. Therefore, the pressure of the bubble 40 pushes the liquid directly with high efficiency. Like the components V1–V4, the bubble growth itself is directed toward the downstream side and the bubble grows more actively in the downstream side rather than in the upstream side. Since the bubble growth itself and the bubble pressure transmission direction are controlled by means of the movable member, the drastic improvement of the liquid discharging efficiency, liquid discharging force, liquid discharging speed, etc., can be achieved.

Referring to FIGS. 1A to 1D again, the operation of the liquid discharging head will be described in detail below.

Figure 1B:
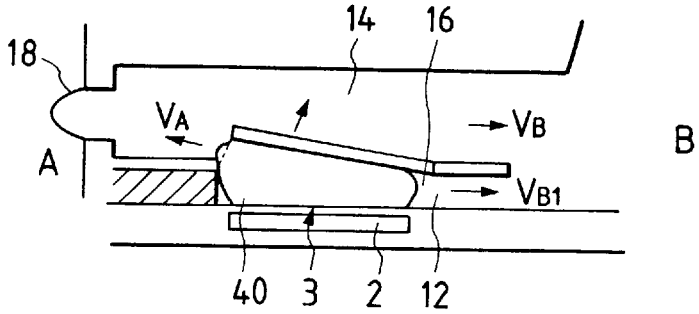
Figure 1C:
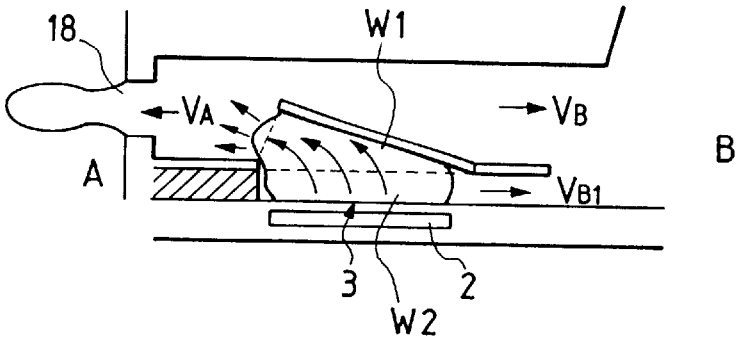
Figure 2:
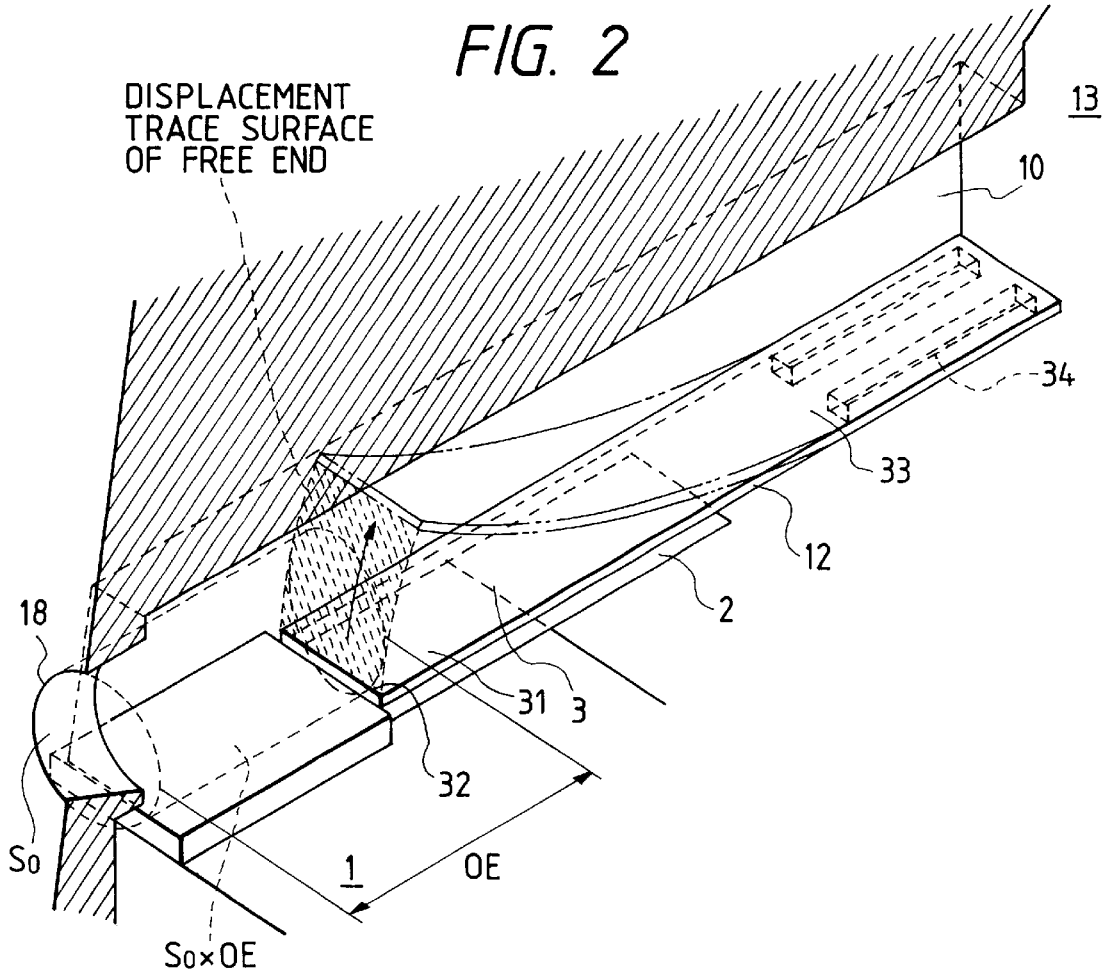
FIG. 2 shows a partial sectional perspective view of the liquid discharging head of the first embodiment in accordance with the present invention.

FIG. 1A shows the liquid discharging head before the energy such as the electric energy is applied to the heat generating element 2, that is, before the heat generating element generates the heat. Note that the movable member 31 is installed facing the downstream side of the bubble generated by the heat generating element of the head. In other words, the movable member 31 is installed on the downstream side of the center 3 of the heat generating element in the liquid flow path (in the downstream side of a line which passes through the center 3 of the heat generating element and intersects the longitudinal axis of the liquid flow path).

FIG. 1B shows the liquid discharging head when the heat generating element 2 generates heat with the energy such as the electric energy and part of the liquid is heated in the bubble generating region 11 with such heat, and the bubble is generated with the film boiling. In this case, the movable member 31 moves from the first position to the second position by the pressure of the bubble 40 so as to transmit such pressure toward the liquid discharging port. Note that the free end 32 of the movable member 31 is situated in the downstream side (the liquid discharging port side) and its fulcrum 33 is located in the upstream side (the common liquid chamber side), so at least part of the movable member faces the downstream side of the heat generating element 2, namely, in the downstream side of the bubble.

FIG. 1C shows the bubble which grows more. In this figure, the movable member 31 moves further by the pressure of the bubble 40. The generated bubble grows more actively in the downstream side rather than in the upstream side and at the same time it grows beyond the first position (the dotted line) of the movable member 31. As described above, as the movable member 31 moves slowly in accordance with the growth of the bubble 40, the bubble growth is uniformly directed in the direction in which the pressure and the volume of the bubble 40 move easily, namely, toward the free end of the movable member, finally toward the liquid discharging port 18. As a result, the liquid discharging efficiency is improved. The movable member 31 scarcely prevents the transmission of the bubble and the pressure wave generated by the bubble formation toward the liquid discharging port. Such element can control the pressure transmission direction and the bubble growing direction in accordance with the pressure to be transmitted with high efficiency.

Figure 1D:
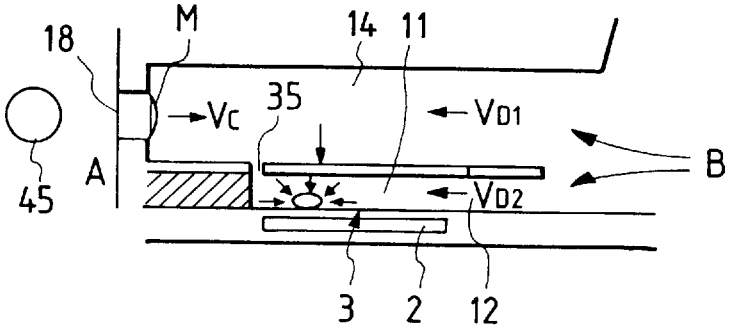

FIG. 1D shows the contraction and extinguishment of the bubble 40 in accordance with the pressure in the bubble after the above-mentioned film boiling. In this case, the electric energy is no longer applied to the heat generating element 2. (At least, the energy enough to support the bubble is not applied.) The movable member 31 which moved to the second position returns to the initial position (the first position) in FIG. 1A by the negative pressure due to the contraction of the bubble and the restoring force of the elastic movable member 31 itself. When the bubble breaks, to compensate the decreased volume of the bubble in the bubble generating region 11 and to compensate the discharged amount of the liquid, the liquid flows in from the upstream side (B side in the figure), namely, from the common liquid chamber as shown by the flows $V_{D1}$ and $V_{D2}$ and from the liquid discharging port as shown by the flow Vc.

In the above-mentioned liquid discharging process, the electric pulse energy is applied to the heat generating element 2. In this case, the discharge of then liquid droplets due to one bubble growth process corresponds to the pulse applied. (This pulse may be the combination of a pulse for bubble growth and a preceding pulse which does not grow up the bubble.) Therefore, when such a pulse is an electric pulse, the energy quantum of the pulse corresponding to one droplet discharge can be obtained by integrating the product of the current and the voltage during the pulse duration.

The operation of the movable member and the liquid discharging operation due to the bubble generation have been described. The liquid refilling operation in the liquid discharging head will be described in detail below.

When the bubble 40 passes its maximum volume and starts to contract after the state shown in FIG. 1C, the liquid flows into the bubble generating region 11 from the side of the liquid discharging port 18 in the first liquid flow path 14 and from the common liquid chamber 13 of the second liquid flow path 16 to compensate the decreased volume of the liquid due to the bubble break.

In the case of the conventional liquid flow path without the movable member 31, the amount of the liquid flowing into the location where the bubble broke from the side of the liquid discharging port and the common liquid chamber is controlled by the flow resistance of the area near to the liquid discharging port and the area near to the common liquid chamber (namely, the flow path resistance plus the inertia of the liquid). Therefore, if the flow resistance of the area near to the liquid discharging port is low, the large amount of the liquid flows into the location where the bubble broke and the drawing-back distance of the meniscus becomes large. Especially, if the flow resistance of the area near to the liquid discharging port is lowered to enhance the liquid discharging efficiency, the lower is such resistance, the greater becomes the meniscus drawing-back distance. As a result, the liquid refilling time increases and the high speed printing becomes impossible.

In the case of the liquid discharging head equipped with the movable member 31 based on the above-mentioned liquid discharging principle, when the bubble breaks and the movable member 31 returns to its original position, the meniscus drawing-back motion stops. In such head, the bubble volume W is divided into the upward volume W1 and the downward volume, namely, the volume W2 on the bubble generating region 11 side by means of the movable member 31. The decreased volume of the liquid volume W2 is chiefly supplied from the liquid flow $V_{D2}$ in the second liquid flow path 16. In the conventional liquid discharging head, the meniscus drawing-back distance corresponds to about one half of the bubble volume W, but in the head in accordance with the present invention, the meniscus drawing-back distance can be decreased to about one half of the upward volume W1. In addition, the liquid corresponding to W2 is forcedly supplied chiefly from the upstream side of the second liquid flow path 16 ($V_{D2}$) along the surface of on the side of the heat generating element of the movable member 31 by using the bubble breaking pressure. Therefore, more rapid liquid refilling operation can be achieved.

In the case of the conventional liquid discharging head, if the liquid refilling operation is performed using the bubble contracting pressure, the meniscus vibration increases and the image quality deteriorates. However, in the case of the head in accordance with the present invention, the movable member 31 prevents the communication between the liquid in the first liquid flow path 14 and the liquid in the bubble generating region 11 at the liquid discharging port side by means of the movable member 31. As a result, the meniscus vibration can be decreased greatly.

As described above, by using the liquid discharging principle in accordance with the present invention, it becomes possible to perform the forced liquid refilling operation to the bubble generating region 11 through the liquid supply path 12 of the second liquid flow path 16 and to perform a high speed liquid refilling operation by controlling the above-mentioned meniscus drawing-back motion and vibration. As a result, stable liquid discharging operation and repeated liquid discharging operation can be achieved. When the present invention is used in the recording field, improved image quality and high speed recording become possible.

The above-mentioned liquid discharging principle has additional effective functions described below. That is, the transmission (the back wave) of the pressure due to bubble generation toward the upstream side can be prevented. In the case of the conventional liquid discharging heads, of the pressure of bubble generated on the heat generating element, the bubble pressure on the common liquid chamber side (the upstream side) becomes the pressure (the back wave) pushing back the liquid toward the upstream side. Such back wave generates the pressure on the upstream side, liquid movement thereby and inertia due to the liquid motion. Such a pressure prevents the liquid refilling operation in the liquid flow path and high speed driving operation. By using the above-mentioned liquid discharging principle, the movable member 31 controls these effects and improves the liquid refilling operation.

The embodiments in accordance with the prevent invention will be described in detail below with reference to such principle.

First Embodiment

Figures 5A, 5B:
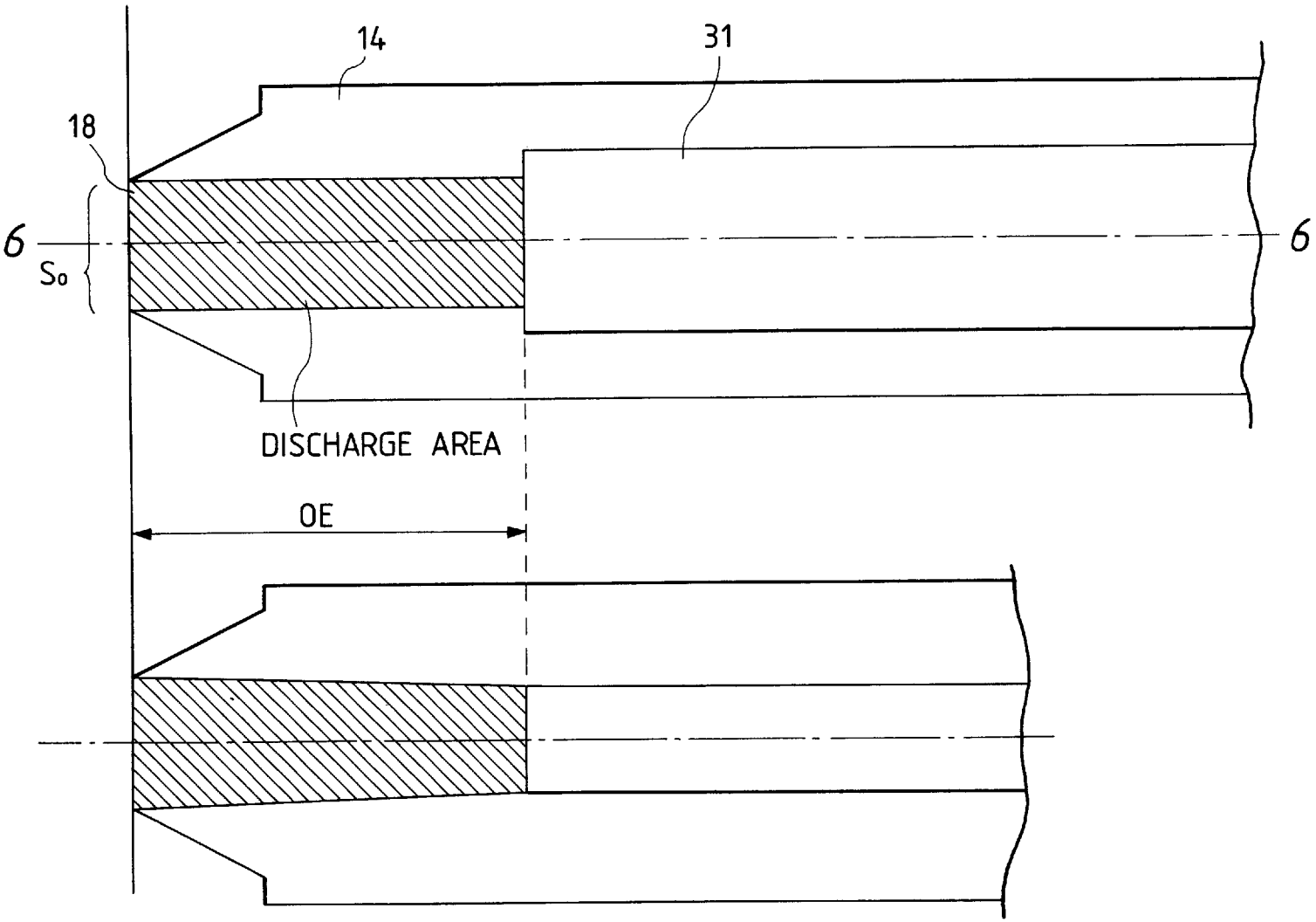
FIGS. 5A and 5B show schematic plan views of the liquid discharging domain of the liquid discharging head of the first embodiment.
Figure 6:
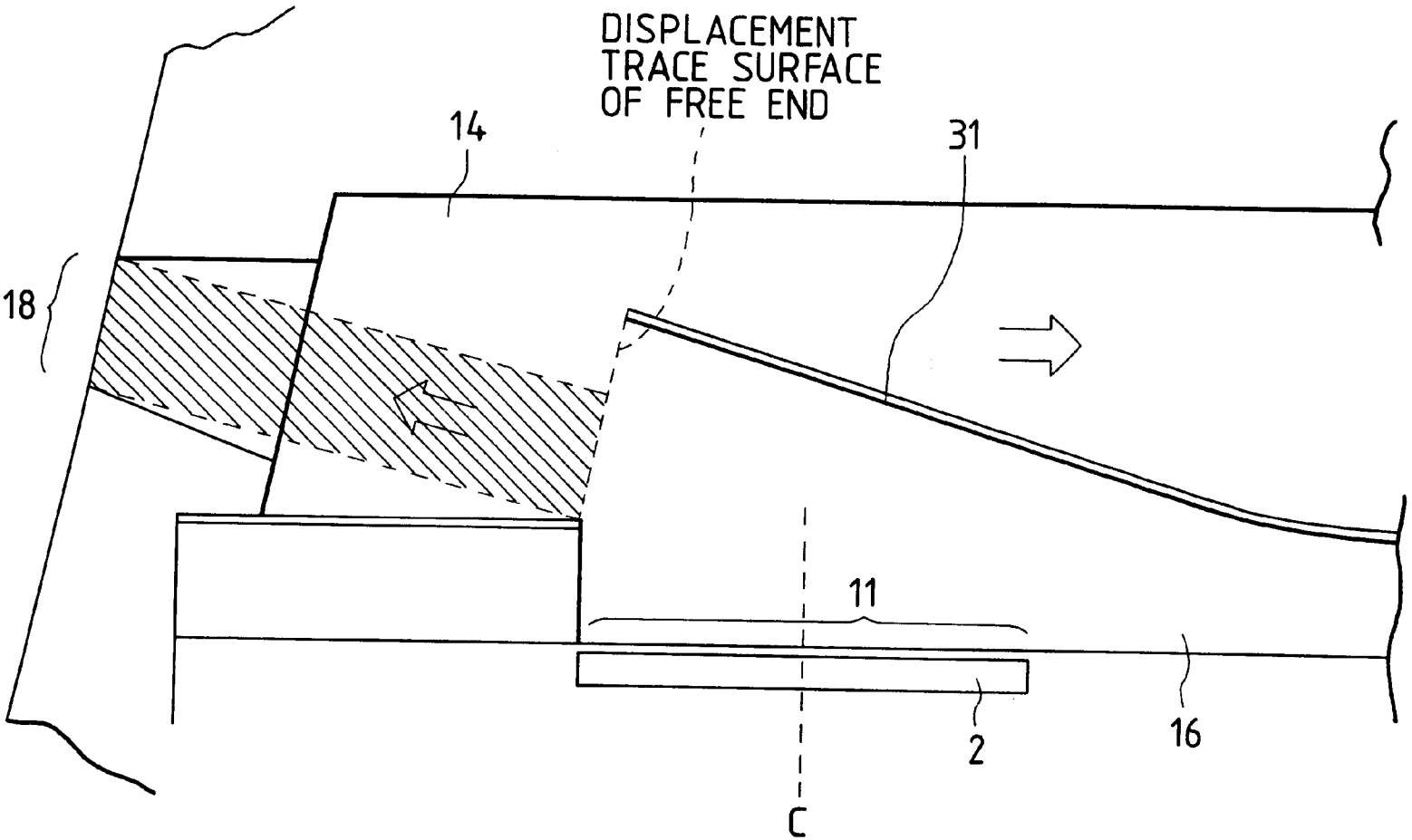
FIG. 6 shows a schematic sectional view taken along the 6—6 line of FIG. 5A.
Figure 7A:
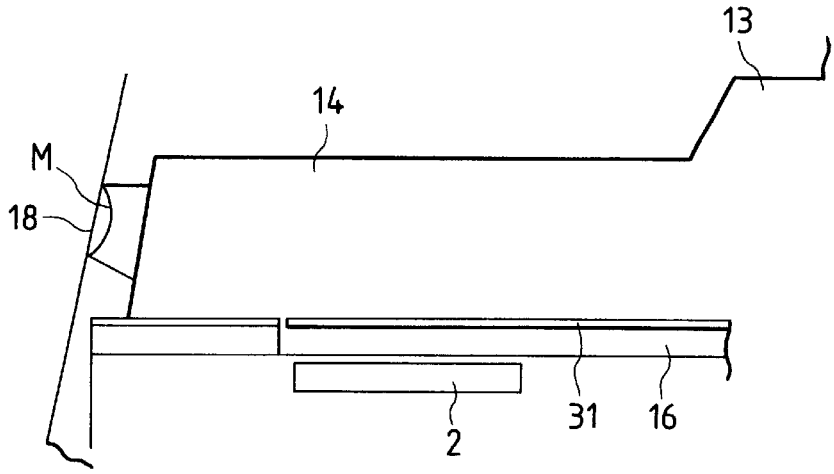
FIGS. 7A, 7B and 7C show the liquid discharging process of the first embodiment.
Figure 7B:
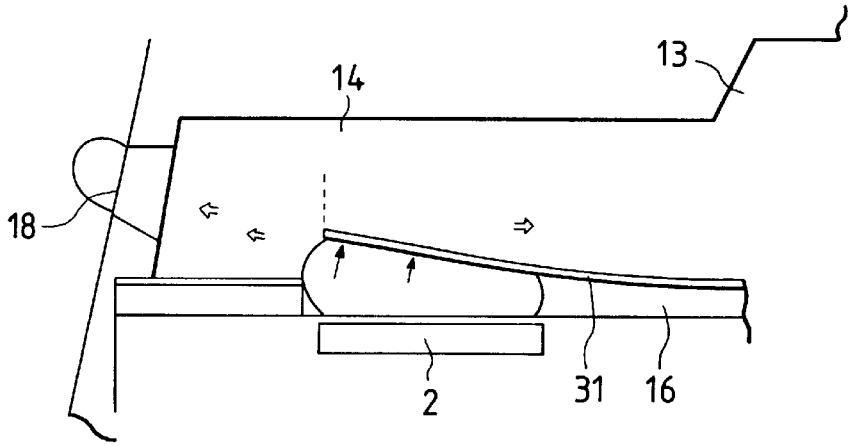
Figure 7C:
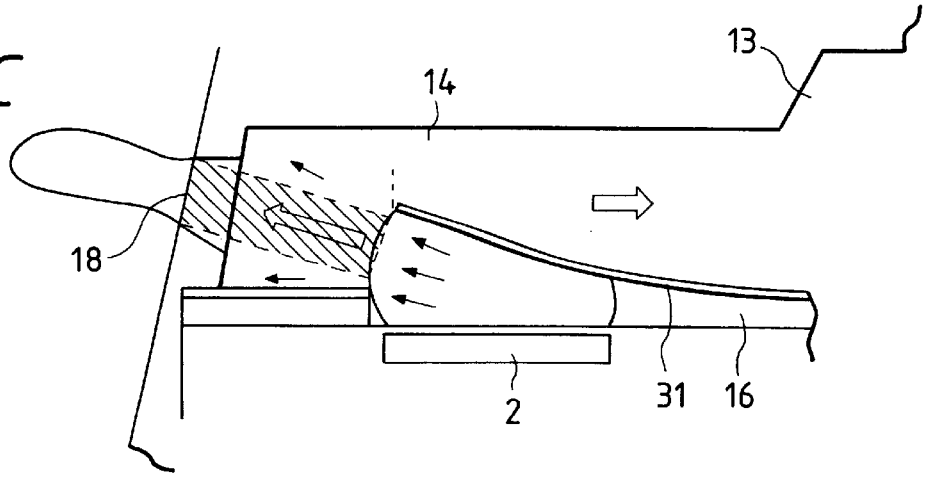

The first liquid discharging head in accordance with the present invention will be described below. The configuration of this head is the same as shown in the partial sectioned perspective view in FIG. 2. However, the distance between the free end of the movable member 31 and the liquid discharging port 18 in the first liquid flow path is somewhat longer than that shown in FIG. 2. In addition, the sectional shape of the first liquid flow path from such free end to the position immediately before the liquid discharging port 18 does not change. Such section reduces suddenly at a position near to the liquid discharging port 18. Thus the liquid discharging port 18 is formed. FIG. 5A is a schematic plan view of the liquid discharging domain of the liquid discharging head. This is the diagram of such domain viewed from the first liquid flow path 14. FIG. 6 is a schematic sectional view of the head shown in FIGS. 5A and 5B cut along the 6—6 line. FIGS. 7A to 7C are the sequential liquid discharging operation of the liquid discharging head.

In the drawings, $S_o$ ($\mu m^2$) is the (opening) area of the liquid discharging port 18, OE ($\mu$m) being the distance between the liquid discharging face and the displacement track surface of the free end of the movable member 31, $V_d$ ($\mu m^3$) being the discharging amount of one liquid discharging operation. In most liquid discharging heads, typically, the uppermost limit values are often used, namely, $S_o \leqq 1000$, $OE \leqq 150$, $V_d \leqq 100\times10^3$. When discharging the liquid droplets through the orifice of this head, the heat generating element 2 and the movable member 31 may be designed with the sufficient liquid discharging energy so that the discharging amount $V_d$ of the liquid of one liquid discharging operation becomes the value as calculated by the equation given below.

$$V_d = S_o \times OE \tag{1a}$$

That is, the discharging amount $V_d$ should be the volume from the liquid discharging port 18 to the displacement track surface of the free end of the movable member 31 (the hatched section in the figure). When the width of the free end of the movable member 31 is narrower than the diameter of the liquid discharging port, such a volume is a volume which is included between the displacement track surface of the free end and the liquid discharging port. To achieve the stable discharge of $V_d = 40\times10^3$, $S_o$ should be 400 and OE should be 100. In this case, the heat generating element 2 should be 36 $\mu$m in width and 85 $\mu$m in length so as to discharge $V_d = 40\times10^3$. It is preferable in view of stability that the movable member 31 should have the width wider than the diameter of the liquid discharging port and the width of the heat generating element, namely, wider than 40 $\mu$m. On the other hand, the movable member may have the same width as that of the heat generating region. Such width may be wider than that of the effective heat generating region (the domain 1–8 $\mu$m smaller than the periphery of the heat generating element.)

The periphery of the liquid discharging port is covered with a layer of the liquid which is not discharged due to its viscosity. The thickness of such layer may be 0–10% according to the physical properties of the liquid. That is, $V_d$ may be expressed by the equation given below.

$$S_o \times OE \geqq V_d 24\ 0.9 \times S_o \times OE \tag{1b}$$

In discharging the liquid of such $V_d$, the discharging amount regulation may be maintained at least less than ±5%.

In FIG. 6, the displacement track surface of the movement of the movable member 31 is larger than the diameter of the liquid discharging port and intersects all the domain of the plane of projection of the orifice. If the displacement track surface does not intersect such domain, the free end of the movable member divides the liquid into a front and rear portions in the moving direction, so the liquid discharging amount can be controlled with less precision. In some cases, the liquid is divided into the front and rear portions at the free end according to the displacing direction of the free end. In other cases, the liquid is divided at a line near to the fulcrum side. Such line is about 10 $\mu$m nearer to the fulcrum when viewed from the free end, the liquid discharging amount can be controlled in a range expressed by the equation given below.

$$S_o \times (OE + 10\ \mu m) \geqq V_d \geqq S_o \times OE \tag{1c}$$

How to obtain such liquid discharging amount will be described with reference to FIGS. 7A to 7C.

FIG. 7A shows the static state before the energy is applied to the heat generating element 2. The liquid flow path is filled with some kind of the liquid such as ink and a meniscus M is formed at the liquid discharging port. Note that as described above, the movable member 31 is situated at the position facing at least the downstream side of the bubble generated with the heat from the heat generating element 2. That is, the movable member 31 facing at least the downstream side of the center of the heat generating element 2 in the liquid flow path (a line passing the center of the heat generating element 2 and intersecting the longitudinal axis of the liquid flow path (the broken line in FIG. 6)) so that the movable member 31 is pushed with the downstream portion of the bubble.

Under this condition, the electric energy is applied to the heat generating element 2. FIG. 7B shows a state that the electric energy is applied to the heat generating element 2. In this case, part of the liquid in the bubble generating region 11 is heated up with the generated heat, and the bubble is generated due to film boiling. Therefore, the movable member 31 moves upward toward the first liquid flow path 14 by the pressure due to bubble generation. With the movement of the movable member 31, the pressure transmission starts from the displaced position of the free end of the movable member 31 toward the liquid discharging port. In the downstream side of the free end, and toward the common liquid chamber in the upstream side of the free end. According to the liquid flow path configuration, the kind of the liquid and the energy applied, typically, the pressure due to bubble generation reaches the maximum value within 1 ps from the start of the pulse application and decreases afterwards. That is, such pressure reaches the maximum value earlier than the bubble growth process and the pressure which is transmitted as a wave (a pressure wave) starts to decrease while the bubble is still growing.

FIG. 7C shows the bubble which grew further. In this case, the movable member moves further upward in accordance with the pressure due to bubble generation. The generated bubble grows more actively in the downstream side rather than in the upstream side and extends toward the first liquid flow path. Since the movable member 31 moves further in accordance with the bubble growth, the bubble growing direction may be in a direction in which the pressure and the volume change can move easily, namely, in the direction toward the free end side of the movable member. Under this condition, the pressure is transmitted toward the liquid discharging port 18 in the downstream side of the free end of the movable member 31. In the case of this liquid discharging head, as shown in the figure, the sectional area of the liquid flow path becomes narrower from the free end of the movable member 31 to the liquid discharging port 18. Therefore, the flow resistance increases near the liquid discharging port 18. Especially, most of the liquid which is accelerated toward the orifice by the pressure within the above-mentioned very short time is contained in the hatched $S_o \times OE$ section. So the liquid contained in other sections moves during the liquid discharging operation, but is seldom discharged. All the liquid in the liquid flow path 14 in the downstream side of the free end of the movable member 31 cannot be discharged. That is, only the liquid corresponding to the volume contained in a space between the orifice and the displacement track surface of the free end, namely, the liquid discharging amount $V_d$ expressed by the equation (1) is discharged. At the free end where the flow direction changes, the liquid is divided into two portions, one portion flowing toward the orifice and the other portion flowing to the upstream direction. As a result, only the liquids expressed by the equations (1a), (1b) and (1c) are discharged.

Figure 8:
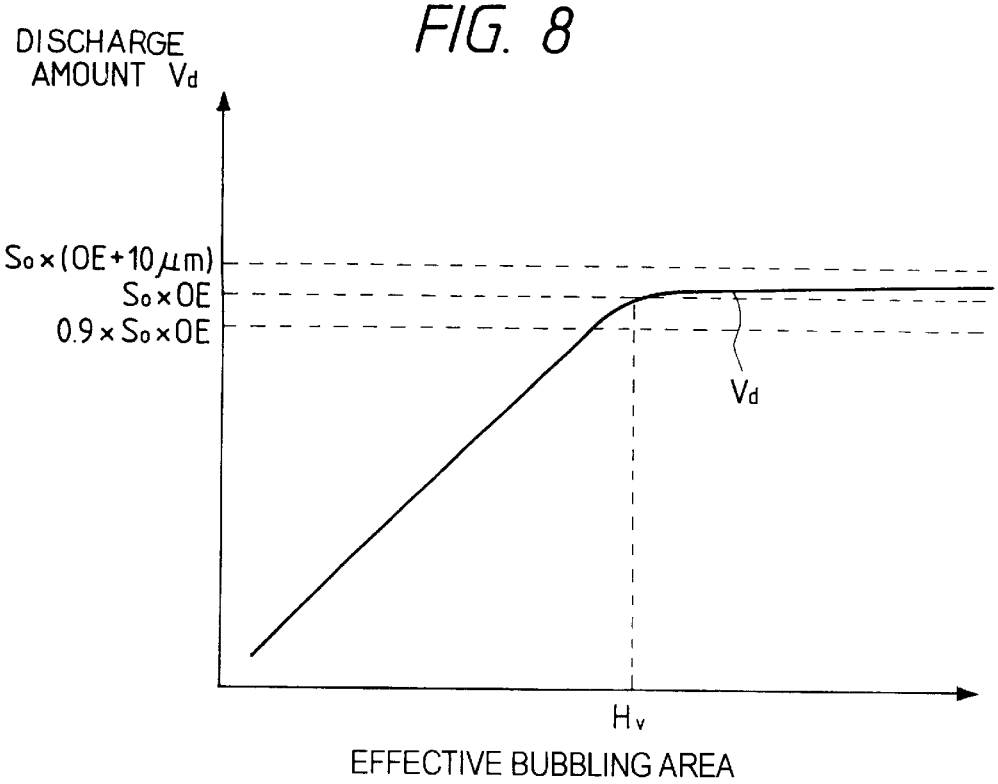
FIG. 8 is a graph showing a relationship between the effective bubble generating area of a heat generating element and the liquid discharging amount.

FIG. 8 shows the change of the liquid discharging amount $V_d$ when the liquid discharging pressure varies (increases) in the head in accordance with the present invention. The liquid discharging saturation domain, one of the features of the present invention will be described below with reference to this figure.

In the present embodiment, the area of the heat generating element varies (increases) to change the liquid discharging energy. The heat generating element consists of a bubble generating domain (an effective liquid bubble generating area H) and a non bubble generating domain, namely a peripheral section (in the present embodiment, a 4 $\mu$m wide peripheral zone) where the temperature is low and no bubble generates. If other design parameters are constant, the liquid discharging amount is almost proportional to such effective bubble generating area H. However, when $V_d$ increases with the increase of the effective bubble generating area H and becomes $V_d = S_o \times OE$ at Hv, because of the above-mentioned reason, the domain where the liquid discharging amount does not change appears. Therefore, by setting the area of the heat generating element so that the effective bubble generating area is larger than Hv, stable liquid discharging amount is guaranteed independent of the environmental factors.

That is, typically, the stable liquid discharging amount $V_d$ as expressed by $V_d = S_o \times OE$ can be achieved. Even though the viscosity of the liquid is very high, the stable liquid discharging amount $V_d$ is guaranteed within the range of $S_o \times OE \geqq V_d \geqq 0.9 \times S_o \times OE$, namely, with the accuracy of +5%. Even though the liquid is divided by the movement of the movable member at a line deviated from the displacement track surface of the free end, the stable liquid discharging amount can be achieved within a range of $S_o \times (OE+10\,\mu m) \geqq V_d \geqq S_o \times OE$. Even though in the almost worst case where the above-mentioned two adverse factors exist, the stable liquid discharging amount can be obtained in a range of $S_o \times (OE+10\,\mu m) \geqq V_d < 0.9 \times S_o \times OE$.

In the present embodiment, the liquid discharging energy as the liquid discharging amount in the saturation domain is adjusted by changing the area of the heat generating element. However, such energy can be adjusted by modifying the configuration of the liquid discharging path, the movable member etc.

As shown in FIG. 8, with the increase of the effective bubble generating area H (namely, the energy applied), the liquid discharging amount $V_d$ tends to saturate. When the effective bubble generating area is Hv, the liquid discharging amount out of the liquid discharging port 18 becomes as expressed by $V_d = S_o \times OE$. In this case, the liquid discharging amount $V_d$ becomes constant in a domain where the effective bubble generating area is greater than Hv, and the constant liquid discharging amount can be obtained independent of the effective bubble generating area H (the energy applied).

In the present embodiment, as described above, the liquid corresponding to the volume, $V_d = S_o \times OE$ is discharged out of the liquid discharging port 18. The liquid which was not discharged remains in the first liquid flow path 14 on the downstream side of the free end of the movable member 31 along the inner wall of the liquid flow path. Therefore, liquid refilling operation after liquid discharge can be more easily performed with the surface tension of the remaining liquid.

As described above, in the present embodiment, the volume contained in a space from the liquid discharging port 18 to the displacement track surface of the free end of the movable member 31 can be specified as the liquid discharging amount, so the required liquid discharging amount can be obtained by changing the liquid discharging area $S_o$ and the distance OE from the liquid discharging port 18. In addition, by applying the liquid discharging energy greater than that required for discharging the above-mentioned volume, very stable liquid discharging amount can be obtained with less variation of such amount due to the environmental and manufacturing factors. On the other hand, the liquid refilling operation after liquid discharge can be more easily performed and a high speed printing operation becomes possible.

The additional characteristic structure and effects of the present embodiment will be described below.

In the case of the present embodiment, the second liquid flow path 16 includes a liquid supply path 12 equipped with an internal wall connected substantially flush with (with the heat generating surface at the same level) the heat generating element 2 in the upstream side of such element. In this case, the liquid is supplied as shown by $V_{D2}$ to the surface of the bubble generating region 11 and the heat generating element 2 along the surface near the bubble generating region 11 of the movable member 31. Therefore, the liquid is not stagnant on the surface of the heat generating element 2. It becomes easy to remove the gas dissolved in the liquid and the remaining bubble therein. At the same time, the accumulation of too much heat can be prevented. For this reason, more stable bubble generation can be repeated at a high speed. In the present embodiment, the second liquid flow path 16 has the liquid supply path 12 with the substantially flat internal wall. The present invention is not limited to such configuration. The liquid flow path may include any liquid supply path which has a smooth internal wall and is connected with the surface of the heat generating element at almost the same level, and which has such configuration that the liquid is not stagnant on the surface of the heat generating element and does not cause a large turbulence in the liquid supply.

The liquid is supplied to the bubble generating region as $V_{D1}$ through a side (a slit 35) of the movable member. To introduce the pressure due to bubble generation into the liquid discharging port more effectively, a large movable member may be used which can cover the whole bubble generating region 11 (covering the surface of the heat generating element) as shown in FIGS. 1A to 1D or FIGS. 7A to 7C. If the above-mentioned large movable member has such configuration that when the movable member 31 returns to the first position, the flow resistance increases in the bubble generating region 11 and the liquid discharging port of the first liquid flow path 14, the liquid flow from $V_{D1}$ to the bubble generating region 11 is prevented. However, in the case of the head configuration of the present embodiment, the liquid supply performance is greatly improved because of the presence of $V_{D1}$ for supplying the liquid to the bubble generating region 11. Therefore, even though the bubble generating region 11 is covered with the movable member 31 to enhance the liquid discharging efficiency, the liquid supply efficiency does not lower.

Figure 9:
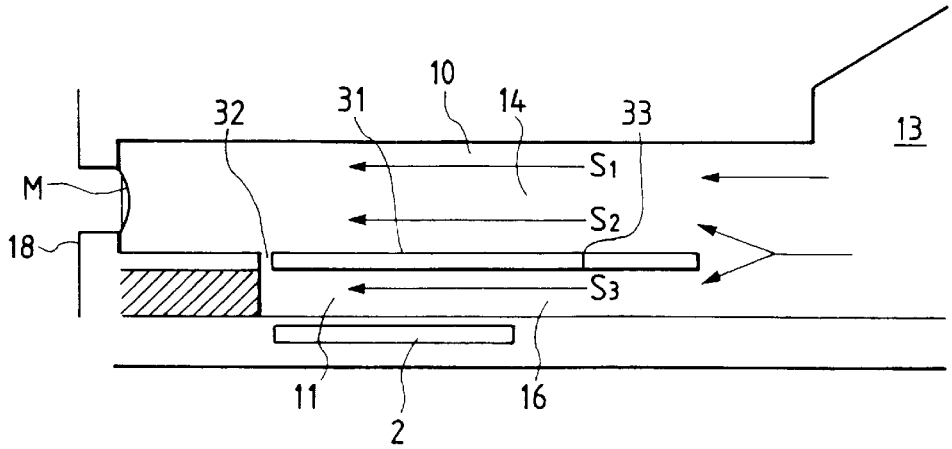
FIG. 9 shows a schematic view of the liquid flow in the first embodiment.

As shown in FIG. 9, the free end 32 of the movable member 31 is situated in the downstream side with respect to its fulcrum 33. Therefore, in the bubble generation process, the pressure due to bubble generation and the growing bubble can be directed toward the liquid discharging port with high efficiency. In addition, owing to such configuration, not only the liquid discharging function and efficiency can be improved but also the resistance for the liquid flow in the liquid flow path 10 in the liquid supply process can be decreased. As a result, a high speed liquid refilling operation can be achieved. These advantages are obtained by such configuration that the free end and the fulcrum of the movable member are so arranged, as shown in FIG. 9, that they do not prevent the flows S1, S2 and S3 in the liquid flow path 10 (including the first liquid path 14 and the second flow path 16), when the meniscus M which drew back by the liquid discharging operation returns to the liquid discharging port by capillarity, and when the liquid is supplied for compensating the liquid loss due to broken bubble.

More particularly, in the present embodiment, as described above, the free end 32 of the movable member 31 is situated in the downstream side of the centerline 3 of the heat generating element 2 dividing it into the upstream and downstream portions (the line passing through the center (the middle point) of the heat generating element and intersecting the longitudinal axis of the liquid flow path) facing the heat generating element 2. Therefore, the pressure and the bubble which generates in the downstream side of the centerline of the heat generating element and have a great influence on the liquid discharging operation push the movable member 31. The movable member 31 transmits such pressure and bubble toward the liquid discharging port 18 and improves the liquid discharging efficiency and the liquid discharging force drastically.

A lot of desirable effects can be obtained by using the bubble in the upstream side too.

In the present embodiment configuration, the momentary mechanical motion of the free end of the movable member 31 may contribute to the effective liquid discharging operation.

Second Embodiment

Figure 10:
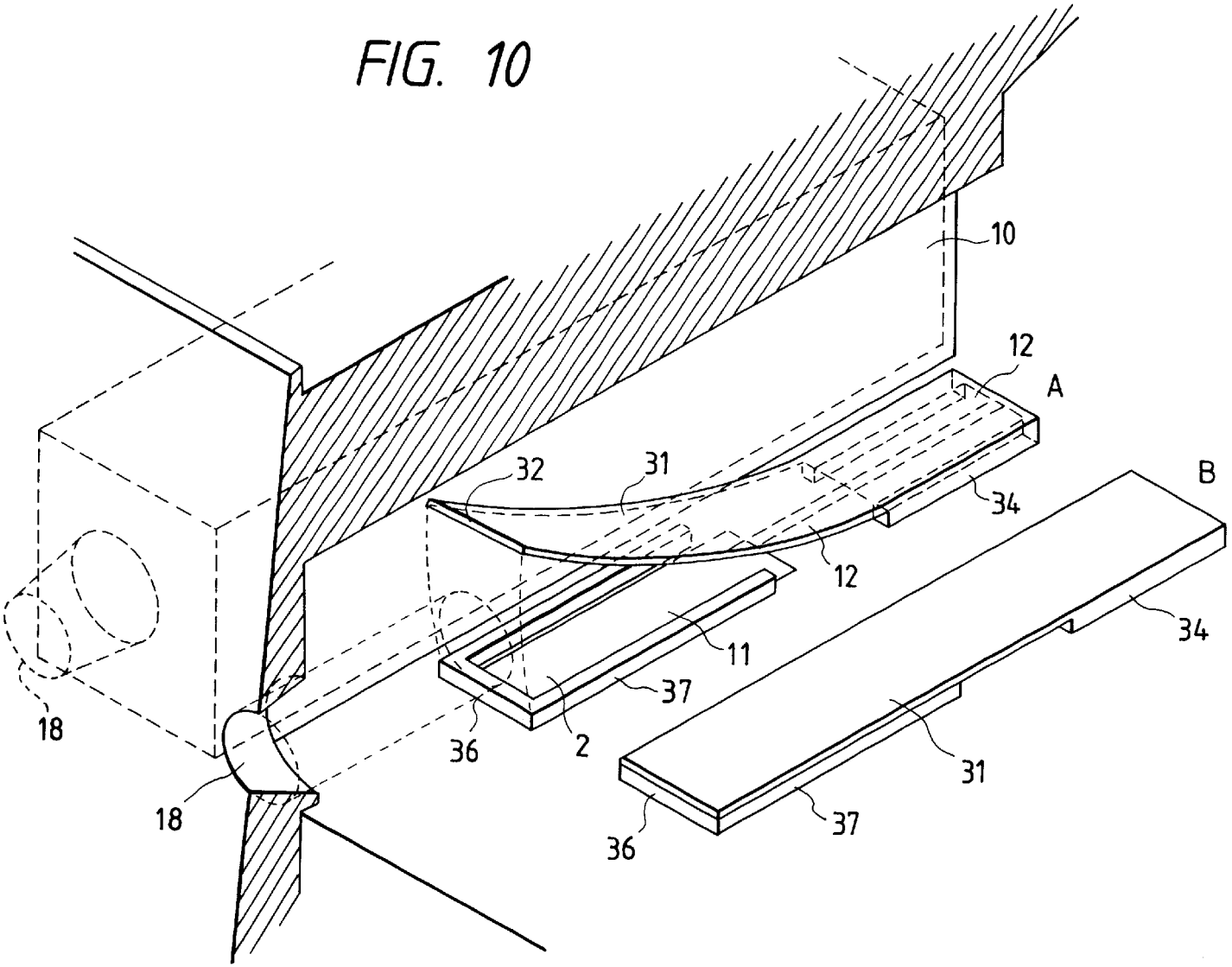
FIG. 10 shows a partial sectional perspective view of the liquid discharging head of the second embodiment in accordance with the present invention.

FIG. 10 shows the liquid discharging head of the second embodiment in accordance with the present invention. In this figure, A shows the movable member in motion (the bubble not shown). B shows the initial position (the first position) of the movable member. In the state B, the bubble generating region 11 is substantially sealed from the liquid discharging port. (In this figure, a flow path wall which separates the flow paths between A and B is not shown.) In the figure, the movable member 31 is equipped with two bases 34 on its side and a liquid supply path 12 is formed therebetween. Therefore, the liquid can be supplied along the side of the movable member 31 on the heat generating element, or through a liquid supply path installed at the substantially same level or equipped with the surface on almost the same level.

In the present embodiment configuration, the liquid discharging amount through the liquid discharging port 18 is set in a saturation domain. The discharging energy quantum corresponds to the volume in a space between the liquid discharging port 18 and the displacement track surface of the free end of the movable member 31. Therefore, like the first embodiment, by using the liquid discharging head in such saturation domain, both stable liquid discharging amount and a high speed refilling operation can be achieved.

When the movable member 31 is situated at the initial position (the first position), it is near to or in contact with the downstream side wall 36 and the side wall 37 of the heat generating element arranged atransversely in the downstream side of the heat generating element 2. In this case, the movable member 31 seals the side of the liquid discharging port 18 of the bubble generating region 11 substantially from other domains. Therefore, the pressure due to bubble generation, especially all the pressure in the downstream side of the bubble acts on the free end of the movable member 31 concentratedly.

When the bubble breaks, the movable member 31 returns to the first position. In this case, if the liquid is supplied onto the heat generating element 2, the liquid discharging port side of the bubble generating region 11 is substantially sealed up. Therefore, the above-mentioned various effects such as the meniscus drawing-back motion prevention, etc., of the first embodiment can be achieved. In the liquid refilling operation, the same functions and effects as those of the first embodiment can be obtained.

In the present embodiment, as shown in FIGS. 2 and 10, a base 34 for supporting and retaining the movable member 31 is installed in the upstream side somewhat apart from the heat generating element 2. The base 34 has a width narrower than that of the liquid flow path 10. The liquid is supplied to the liquid supply path 12 as described above. The shape of the base 34 is not limited to it. It may have any shape so long as it can perform the liquid refilling operation smoothly. In the present embodiment, the gap between the movable member 31 and the heat generating element 2 is about 5 $\mu$m. However any gap will do between the element 31 and the element 2 so long as the pressure due to bubble generation can be effectively transmitted to the movable member 31.

Third Embodiment

Figure 11:
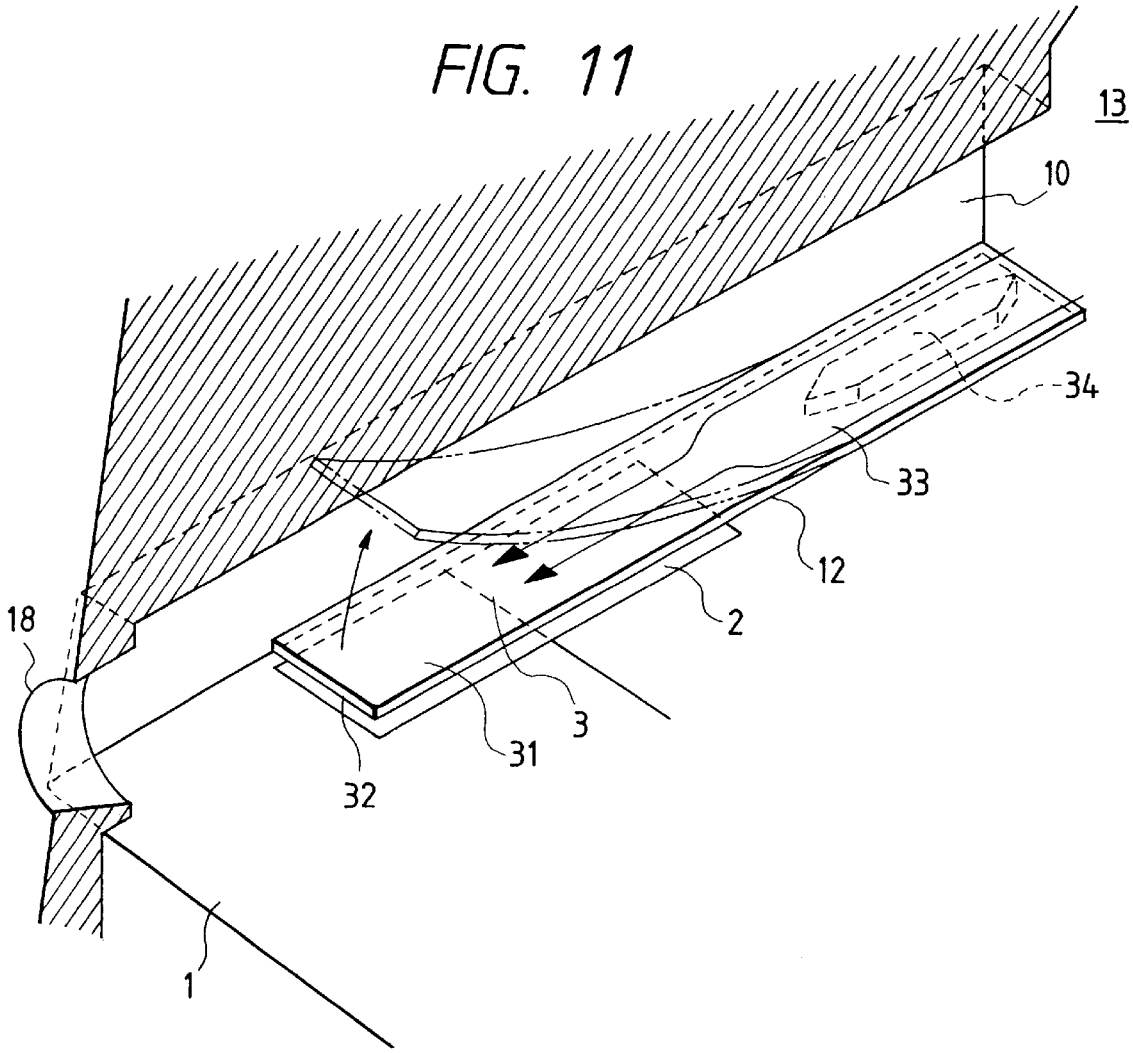
FIG. 11 shows a partial sectional perspective view of the liquid discharging head of the third embodiment in accordance with the present invention.

FIG. 11 shows the one of the basic concepts of the present invention. This figure shows the liquid discharging head of the third embodiment of the present invention.

In the case of the first and the second embodiments described above, the pressure due to bubble generation acts concentratedly on the free end of the movable member 31 so as to concentrate the bubble motion on the liquid discharging port 18, when the movable member 31 moves rapidly. In the present embodiment, the generated bubble is not so strictly restricted. Only the bubble directly acting on the discharging droplets on the liquid discharging port side, namely, the bubble in the downstream side is controlled at the free end of the movable member 31. That is, the liquid discharging head shown in FIG. 11 is different from the head of the first embodiment (see FIG. 2) in that the former is equipped with a convex portion (the hatched portion) as a barrier situated at the end of the downstream side of the bubble generating region 11 on the element substrate 1. In short, the free end domain and both side end domains of the movable member 31 does not seal the bubble generating region 11 from the liquid discharging port domain substantially. Conversely, they are open to such domain 11. This is a feature of the present embodiment.

In the present embodiment too, the liquid discharging amount through the liquid discharging port 18 is set in a saturation domain. The discharging energy quantum corresponds to the volume in a space between the liquid discharging port 18 and the displacement track surface of the free end of the movable member 31. Therefore, like the first and the second embodiments, by using the liquid discharging head in such saturation domain, both stable liquid discharging amount and a high speed refilling operation can be achieved.

In the present embodiment, the bubble can grow at the end of the downstream side which acts directly on the liquid droplet discharge operation. Therefore, such pressure component can be effectively used for discharging the liquid. In addition, the free end of the movable member 31 adds the upward pressure in the downstream side (the components $V_B$, $V_B$ and $V_B$) to the bubble at the tip of the downstream side so as to assist the growth of such bubble. Therefore, like the first and the second embodiments, the liquid discharging efficiency is improved. Compared with these embodiments, the present embodiment has a higher response for the operation of the heat generating element and simpler construction for easy manufacture.

The fulcrum of the movable member 31 of the present embodiment is retained on the base 34 having the width narrower than that of the surface of the movable member 31. Therefore, when the bubble breaks, the liquid is supplied to the bubble generating region 11 through both sides of the base (as shown by the arrow). Such base may have any shape so long as the liquid is surely supplied.

In the present embodiment, in the liquid refilling operation during the liquid supply process, when the bubble breaks, the liquid flow from the upstream side to the bubble generating region 11 is controlled by the movable member 31. Therefore, it has an advantage over a conventional bubble generating mechanism equipped with the heat generating element alone. Of course, the meniscus drawing-back motion can be reduced.

In the third embodiment, it is preferable to substantially seal both sides of the movable member toward its free end (or either one) from the bubble generating region 11. By this configuration, the pressure toward the side(s) of the movable member can be used after converting it into the bubble growth at the end of the bubble discharging port as described above. As a result, the liquid discharging efficiency is further improved.

Fourth Embodiment

Figure 12:
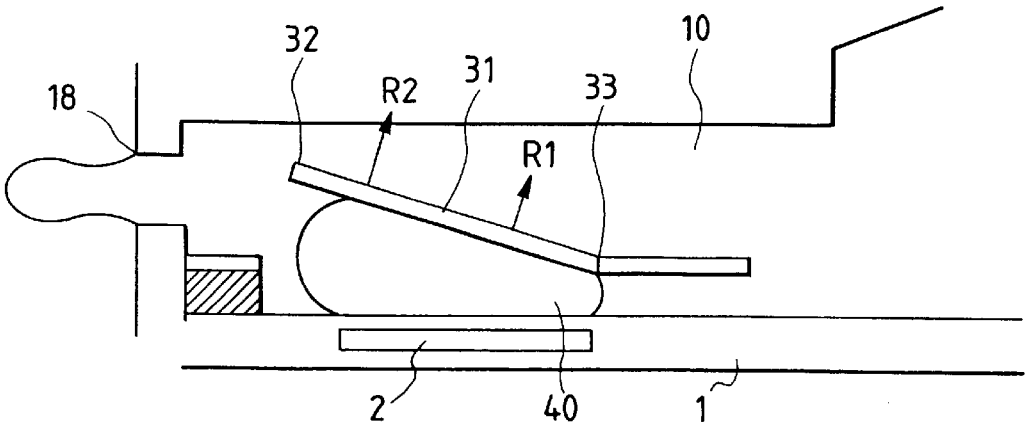
FIG. 12 shows a sectional view of the liquid discharging head of the fourth embodiment in accordance with the present invention.

An example of the liquid discharging efficiency which is further improved by the above-mentioned mechanical displacement will be described below. FIG. 12 shows a cross sectional view of such liquid discharging head. The movable member 31 further extends toward the liquid discharging port 18 so that such free end comes to further downstream side of the heat generating element 2. Therefore, the displacing speed of the movable member 31 can be more increased at its free end position, so the generation of the liquid discharging force due to the displacement of the movable member 31 is further enhanced.

In the present embodiment too, the liquid discharging amount through the liquid discharging port 18 is set in a saturation domain. The discharging energy quantum corresponds to the volume in a space between the liquid discharging port 18 and the displacement track surface of the free end of the movable member 31. Therefore, like the first embodiment, by using the liquid discharging head in such saturation domain, both stable liquid discharging amount and a high speed refilling operation can be achieved.

In the present embodiment, compared with the above-mentioned embodiments, the free end of the movable member 31 is nearer to the liquid discharging port, the bubble growth can be concentrated in the more stable component direction, so the liquid discharging efficiency can be further improved. The movable member 31 moves at a moving speed R1 in accordance with a bubble growing speed at the center of the pressure due to bubble generation. However, at the free end position farther from the fulcrum 33, the movable member 31 moves at a faster moving speed R2. Therefore, the free end 32 acts mechanically on the liquid so as to move it faster. As a result, the liquid discharging efficiency is further improved. In addition, the free end is perpendicular to the liquid flow as shown in FIGS. 1A to 1D, the pressure due to bubble generation and the mechanical motion of the movable member act on the liquid discharging operation more efficiently.

Fifth Embodiment

Figure 13A:
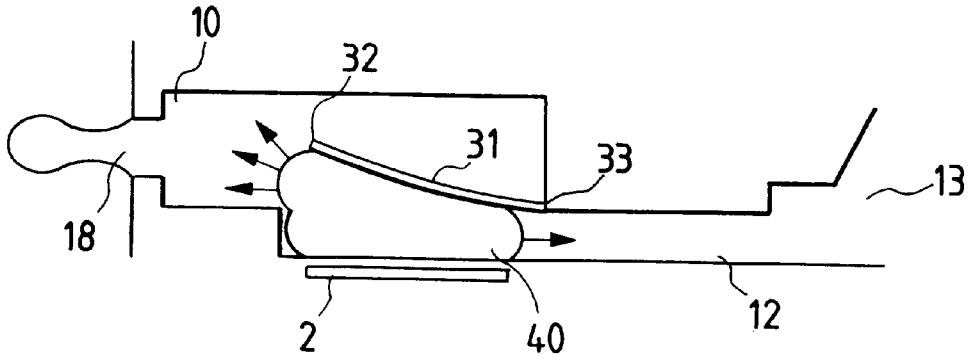
FIGS. 13A, 13B and 13C show schematic sectional views of the liquid discharging head of the fifth embodiment in accordance with the present invention.
Figure 13B:
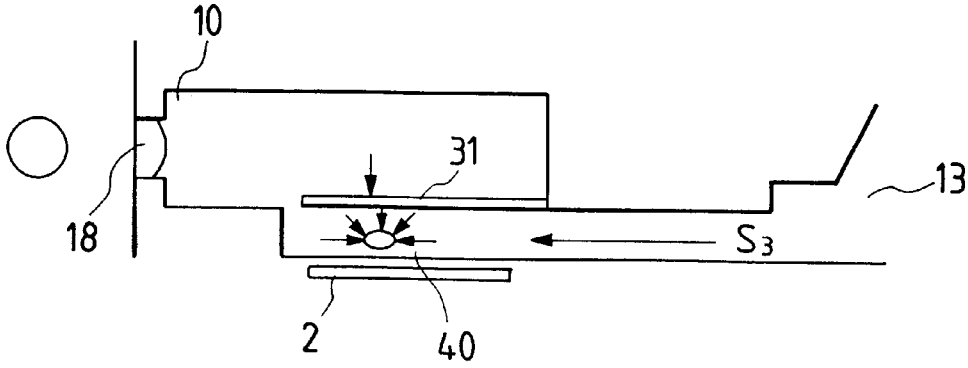
Figure 13C:
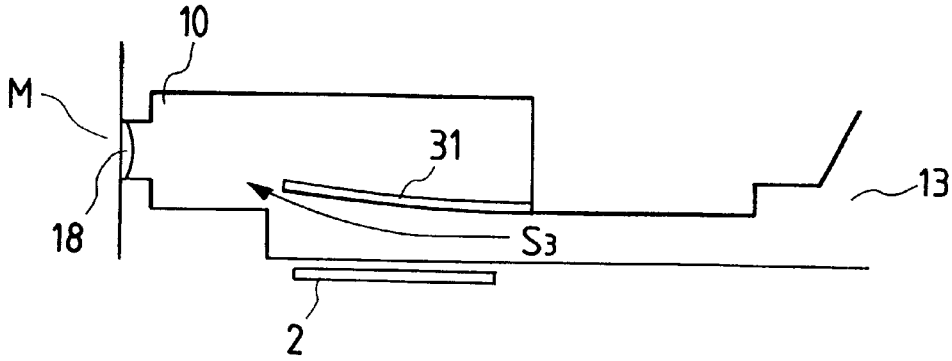

The liquid discharging head of the fifth embodiment in accordance with the present invention will be described below with reference to FIGS. 13A to 13C. Different from the liquid discharging heads of the above-mentioned embodiments, the head of the present embodiment has a liquid flow path directly communicating with the liquid discharging port 18 but not communicating with a liquid chamber. So the construction of the present head can be simplified. That is, all the liquid is supplied only through a liquid supply path along the surface on the bubble generating region of the movable member 31. The positions of the free end 32 and the fulcrum 33 of the movable member 31 and their orientations for the heat generating element 2 are the same as those of the above-mentioned embodiments.

In the present embodiment too, the liquid discharging amount through the liquid discharging port 18 is set in a saturation domain. The discharging energy quantum corresponds to the volume in a space between the liquid discharging port 18 and the displacement track surface face of the free end of the movable member 31. Therefore, like the first embodiment, by using the liquid discharging head in such saturation domain, both stable liquid discharging amount and high speed refilling operation can be achieved.

The present embodiment also achieves the above-mentioned effects such as high liquid discharging efficiency and excellent liquid supply properties. Especially, all the liquid supply is performed by a forced liquid refilling operation by decreasing the backward motion of the meniscus and by using the pressure due to bubble break. FIG. 13A shows a state when the bubble is generated in the liquid by means of the heat generating element 2. FIG. 13B shows a state that the above-mentioned bubble is shrinking. Under this condition, the movable member 31 returns to the initial position and the liquid is supplied with S3. FIG. 13C shows a state that the slight backward motion of the meniscus M while the movable member 31 returns to its initial position is refilled with the liquid by the capillarity near the liquid discharging port 18 after bubble break.

Sixth Embodiment

Figure 14:
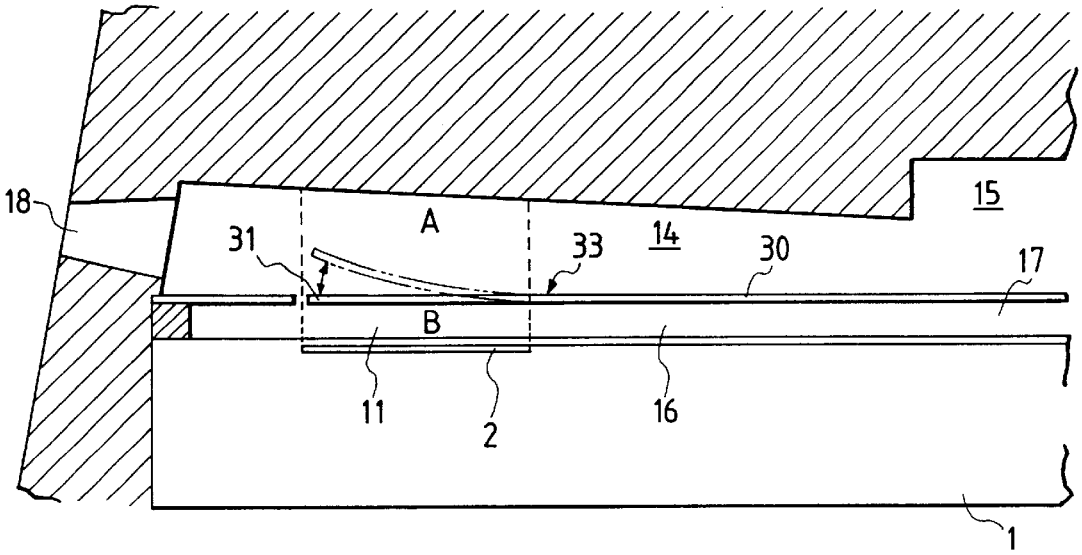
FIG. 14 shows a sectional view of the liquid discharging head (equipped with two liquid flow paths) of the sixth embodiment in accordance with the present invention.
Figure 15:
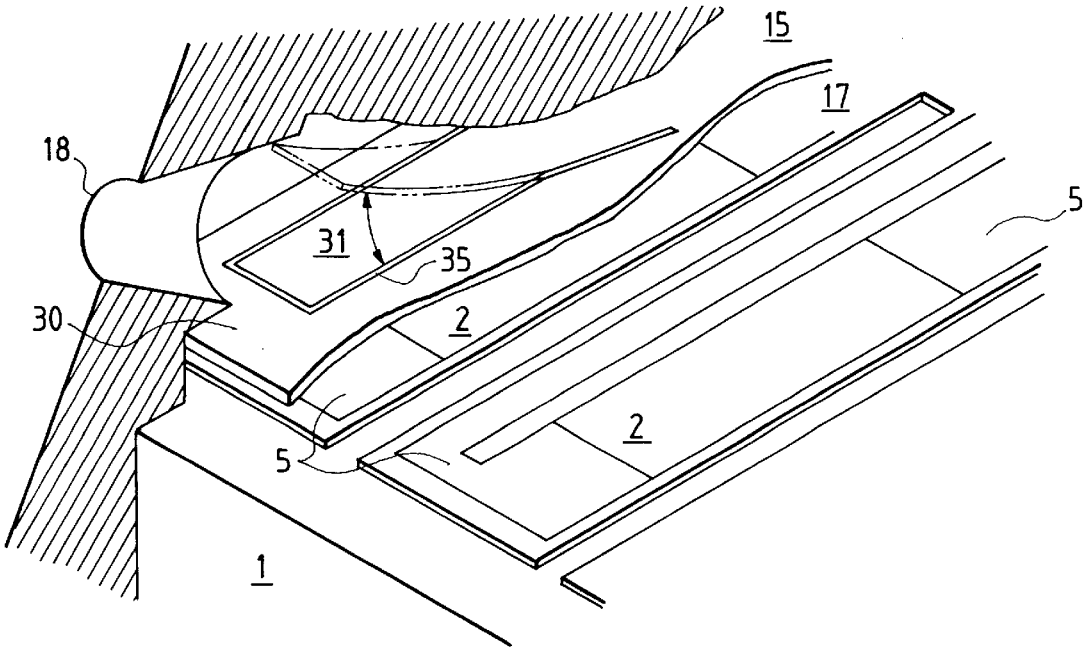
FIG. 15 shows a partial sectional perspective view of the liquid discharging head of the sixth embodiment in accordance with the present invention.

The sixth embodiment in accordance with the present invention will be described below. The principal liquid discharging principle of the present embodiment is the same as that of each embodiment described above. The present embodiment employs a plurality of the liquid flow paths. So the liquid may be divided into one liquid portion in which the bubble is generated (a bubble generating liquid) and the other liquid portion to be discharged (a discharging liquid). FIG. 14 shows a schematic sectional view of the liquid discharging head of the present embodiment in the liquid flow path direction. FIG. 15 shows a partial sectional perspective view of such liquid discharging head.

The present liquid discharging head is equipped with the base 1. On such as, the heat generating element 2 is installed. The second liquid flow path 16 for the bubble generating liquid is installed on such element 2. In addition, the first liquid flow path 14 directly communicating with the liquid discharging port 18 is installed on such path 16. The upstream side of the first liquid flow path 14 communicates with the first common liquid chamber 15 for supplying the discharging liquid to a plurality of the first liquid flow paths. On the other hand, the upstream side of the second liquid flow path 16 communicates with a second common liquid chamber 17 for supplying the bubble generating liquid to a plurality of the second liquid flow paths 16. However, when the same liquid is used as the bubble generating liquid and as the discharging liquid, one common liquid chamber can be used for them.

A separation wall 30 made of elastic material such as metal is installed between the first liquid flow path 14 and the second liquid flow path 16. Such wall separates these liquid flow paths from each other. If it is preferable to separate the bubble generating liquid from the discharging liquid as much as possible, the first liquid flow path 14 should be separated from the second liquid flow path 16 as completely as possible by means of the separation wall 30. If such complete separation is not required, it is not necessary for such wall to have a complete separatable function.

The separation wall in the space of projection to the upward direction toward the surface of the heat generating element 2 (hereinafter called a discharging pressure generating domain; the bubble generating region 11 in the domains A and B in FIG. 14) is a movable member in the form of a cantilever including a free end equipped with a slit 35 on the liquid discharging side (the downstream side of the liquid) and a fulcrum 33 on the common liquid chambers 15, 17. The movable member 31 is directed to the bubble generating region 11 (B), so it opens toward the liquid discharging port 18 on the first liquid flow path 14, when the bubble generating liquid generates the bubble (in the direction of the arrow). In FIG. 15, the separation wall 30 is installed on the element substrate 1 mounted with a heat generating resistor as the heat generating element and a wiring electrodes 5 for applying an electric signal to such heat generating resistor thereon through a space constituting the second liquid flow path 16. The arrangement of the fulcrum 33 and the free end 32 of the movable member 31 and the heat generating element 2 is the same as that of each embodiment described above. The relationship between the second liquid flow path 16 and the construction of the heat generating resistor 2 of the present embodiment is the same as that between the liquid supply path 12 and the heat generating element 2 of the embodiment described above.

The operation of the present liquid discharging head will be described below with reference to FIGS. 16A and 16B.

The same water ink was used as the discharging liquid for the first liquid flow path 14 and as the bubble generating liquid for the second liquid flow path 16 in the actual operation of the present liquid discharging head. When the heat generated by the heat generating element 2 is applied to the bubble generating liquid in the bubble generating region 11 in the second liquid flow path 16, as described with respect to the embodiment described above, the bubble 40 is generated in the bubble generating liquid due to film boiling as described in U.S. Pat. No. 4,723,129. In the present embodiment, since the bubble can not escape in three directions excluding the upstream side of the bubble generating region 11, the pressure due to bubble generation is concentrated on the side of the movable member 31 installed on the discharging pressure generating area. Under this condition, the movable member 31 moves upward toward the first liquid flow path 14 from the position as shown in FIG. 16A to the position as shown in FIG. 16B, in accordance with the growth of the bubble. By the movement of the movable member 31, the first liquid flow path 14 communicates with the second liquid flow path 16 freely. The pressure due to bubble generation is chiefly transmitted toward the liquid discharging port 18 (in Direction A) in the first liquid flow path 14. The liquid is discharged out of the liquid discharging port by thus transmitted pressure and the mechanical movement of the movable member as described above.

Figure 16A:
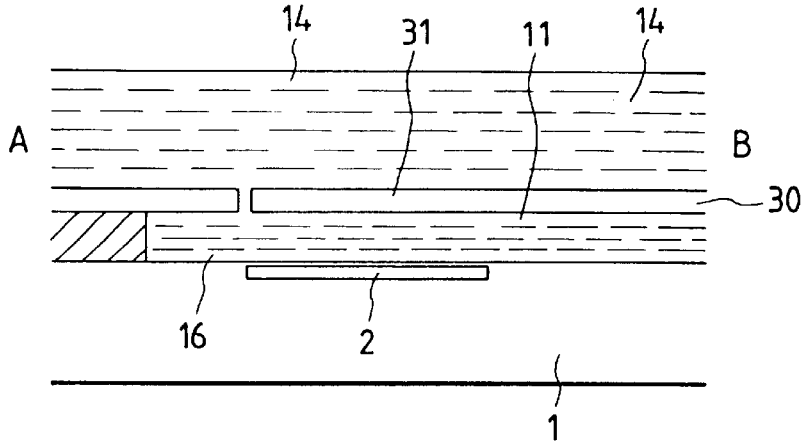
FIGS. 16A and 16B are schematic sectional views showing the operation of a movable member.

When the bubble contracts, the movable member 31 returns to the position shown in FIG. 16A, and the liquid corresponding to the discharged amount is supplied from the upstream side in the first liquid flow path 14. In the present embodiment too, the liquid is supplied to the direction in which the movable member closes, like each embodiment described above, so the liquid refilling operation is not prevented by the movable member 31.

In the present embodiment too, the liquid discharging amount through the liquid discharging port 18 is set in a saturation domain. The discharging energy quantum corresponds to the volume in a space between the liquid discharging port 18 and the displacement track surface of the free end of the movable member 31. Therefore, like the first embodiment, by using the liquid discharging head in such saturation domain, both stable liquid discharging amount and high speed refilling operation can be achieved.

In the present embodiment, the actions and effects of the main parts regarding the bubble pressure transmission, bubble growing direction, back wave suppression etc., due to the movement of the movable member 31 are the same as those of the first embodiment. However, the present embodiment includes two liquid flow paths (double liquid flow paths), so it has the following advantage: that is, in the present embodiment, the discharging liquid and the bubble generating liquid can be used separately, and the former can be discharged by the bubble pressure of the latter. Therefore, any liquid of high viscosity such as polyethylene glycol which could not be discharged smoothly due to its low bubble generating power in the heating process through the conventional liquid discharging head can be discharged by using the process described below. Such liquid of high viscosity is supplied to the first liquid flow path 14. Then a bubble generating liquid with high bubbling property (a mixture of ethanol and water in the ratio of 4:6 with the viscosity of 1–2 cP) and a liquid with low boiling point is supplied to the second liquid flow path 16. The liquid in the first liquid flow path 14 can be freely discharged by the bubble pressure of the liquid in the second liquid flow path. By selecting a liquid which does not accumulate scorched residue, etc., on the surface of the heat generating element 2 as the bubbling liquid, a stable bubble generation and a smooth liquid discharging operation can be achieved.

The liquid discharging head of the present embodiment has the same effects as those of the above-mentioned embodiment. Therefore any liquid of high viscosity can be discharged with high discharging efficiency and high discharging pressure.

If the discharging liquid which cannot withstand high temperatures is used, such liquid should be supplied as a discharging liquid in the first liquid flow path 14 and a liquid which does not easily denature and generates the bubble smoothly should be supplied to the second liquid flow path 16. Then the liquid can be discharged with the above-mentioned high discharging efficiency and high discharging pressure.

Other Embodiments

The embodiments of the principal parts and processes of the liquid discharging head and the liquid discharging method in accordance with the present invention have been described. The detailed configuration of the present invention preferably applicable to these embodiments will be described below with reference to the drawings. Unless otherwise described, any configuration in the following description can be applied to both embodiments with one liquid flow path and embodiments with two liquid flow paths.

<Ceiling Shape of the Liquid Flow Path>

Figure 17:
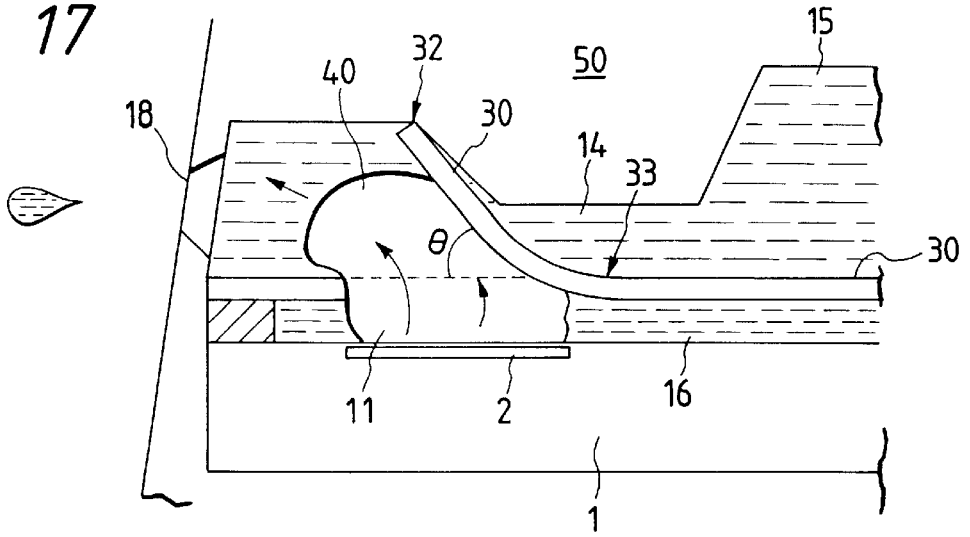
FIG. 17 is a longitudinal sectional view showing the construction of the movable member and a first liquid flow path.

FIG. 17 shows a sectional view of the liquid discharging head in accordance with the present invention in the liquid flow path direction. An element 50 equipped with a groove for forming a first liquid flow path 13 (or the liquid flow path 10 in FIG. 1A) is installed on the separation wall 30. In the present embodiment, the liquid flow path ceiling height increases near the free end 32 of a movable member 31. As a result, the operable angle θ (the movable angle of a free end from the fulcrum 33) of the movable member 31 can be selected more widely. The movable range of the movable member 31 may be determined, taking the construction of the liquid flow path, the durability and the bubble generating ability of the movable member 31 into consideration. It may be preferable that such movable angle should cover an angle including the axial angle of the liquid discharging port 18.

As shown in this figure, by setting the movable height of the free end of the movable member larger than the diameter of the liquid discharging port 18, more sufficient discharging pressure can be transmitted. As also shown in this figure, the ceiling height of the liquid flow path at the fulcrum 33 of the movable member 31 is lower than that at its free end 32, so the pressure wave release toward the upstream side by the motion of the movable member 31 can be more effectively prevented.

<Arrangement of Second Liquid Flow Path and Movable Member>

Figure 18A:
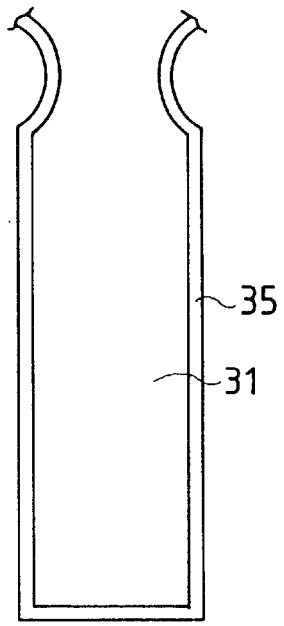
FIG. 18A shows a plan view of the shape of the movable member.
Figure 18B:
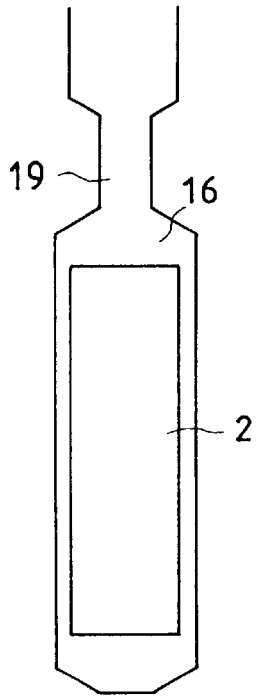
FIG. 18B shows a plan view of the construction of the liquid flow path.
Figure 18C:
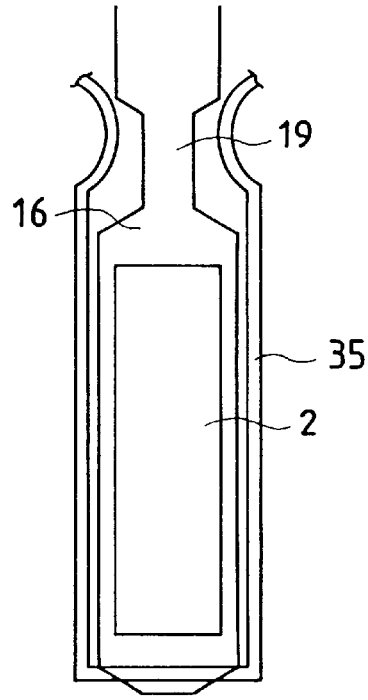
FIG. 18C shows a schematic view of a relationship between the construction of the movable member and that of the liquid flow path.

FIGS. 18A to 18C show the arrangement of the above-mentioned movable member 31 and the second liquid flow path 16. FIG. 18A is a top view of a section adjacent to the separation wall 30 and the movable member 31. FIG. 18B is a top view of the second liquid flow path 16 with the separation wall 30 removed. FIG. 18C shows a schematic arrangement of the movable member 31 and the second liquid flow path 16 by overlapping these factors. In each figure, the front in which the liquid discharging port is situated is shown at the bottom.

The second liquid flow path 16 of the present embodiment has a narrower part 19 in the upstream side of the heat generating element 2. (The above-mentioned upstream side means the upper stream section in a long flow from the second common liquid chamber to the liquid discharging port through the heat generating element, movable member 31 and the first liquid flow path.) Such narrower part 19 is a chamber (a bubble generating chamber) which can prevent the pressure due to bubble generation from escaping toward the upstream side of the second liquid flow path 16.

In the case of a conventional liquid discharging head, the same liquid flow path is used for both bubble generating liquid and discharging liquid and a narrower part is installed at a position nearer to a liquid chamber rather than to the heat generating element so as to prevent the transmission of the generated pressure toward the common liquid chamber. In this case, it was necessary not to decrease the sectional area of the narrower part too much so as to perform the liquid refilling operation at an adequate speed. However, in the case of the liquid discharging head of the present embodiment, it is possible to use the discharging liquid in large quantity in the first liquid flow path and the bubble generating liquid in small quantity in the second liquid flow path in which the heat generating element 2 is installed, because the consumption of the latter liquid is not too much. That is, only small amount of the bubble generating liquid is required for refilling the domain on the bubble generating region 11 of the second liquid flow path 16. Therefore, the gap of the above-mentioned narrower part 19 can be greatly decreased, for example, to several to ten and several μm. As a result, it becomes possible to further prevent the escape of the pressure due to bubble generation in the second liquid flow path 16 to the ambient areas. That is, such pressure can be concentrated to the side of the movable member 31. By using such pressure as the liquid discharging pressure by means of the movable member 31, higher liquid discharging efficiency and stronger liquid discharging pressure can be achieved. The shape of the second liquid flow path 16 is not limited to the above-mentioned form. Any configuration will do for such flow path, so long as the pressure due to bubble generation can be effectively transmitted to the movable member 31.

As shown in FIG. 18C, part of the wall of the second liquid flow path 16 is covered with one side of the movable member 31, so the element 31 does not fall into the flow path 16. By this configuration, the above-mentioned separation between the discharging liquid and the bubble generating liquid becomes more complete. In addition, the release of the bubble through the slit 35 can be prevented, so the liquid discharging efficiency and the liquid discharging pressure can be more increased. Moreover, the liquid refilling operation from the upstream side by the breaking bubble pressure can be further enhanced.

Figure 16B:
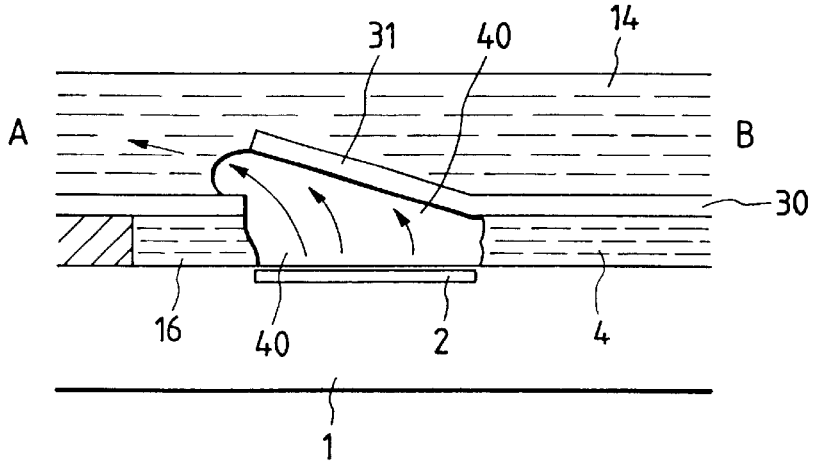

In FIG. 16B and FIG. 17, with the upward displacement of the movable member 31 toward the liquid flow path 14, part of the bubble generated in the bubble generating region 11 of the second liquid flow path 16 extends into the first liquid flow path 14. By setting the height of the second liquid flow path so as to extend the bubble as described above, the liquid discharging pressure can be further enhanced. To extend the bubble into the first liquid flow path 14, it is preferable to set the height of the second liquid flow path 16 lower than that of the maximum bubble height, namely, to several to 30 μm. In the present embodiment, such height is set to 15 μm.

<Movable Member and Separation Wall>

Figure 19A:
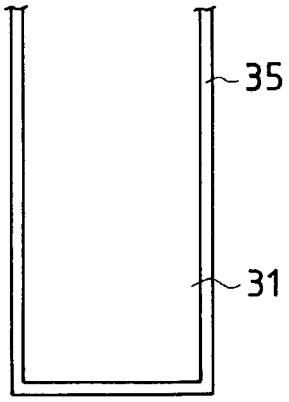
FIGS. 19A, 19B and 19C show plan views of an example of another shape of the movable member.
Figure 19B:
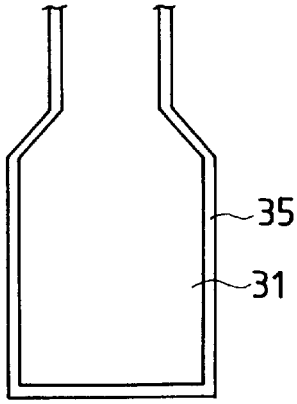
Figure 19C:
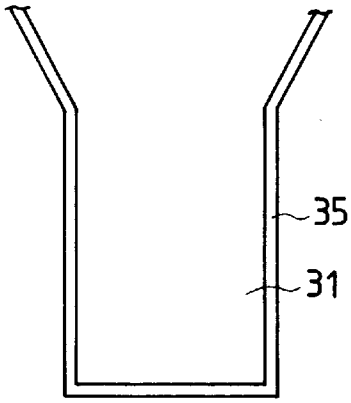

FIGS. 19A to 19C show the another shape of the movable member 31. In the figure, the slit 35 in the separation wall is the movable member 31. FIG. 19A shows the rectangular movable member. FIG. 19B shows the movable member 31 with the small portion in the fulcrum side which can move more smoothly. FIG. 19C shows the movable member with the wider portion on the fulcrum side which has higher durability. For smoother operation and higher durability, it is preferable that as shown in FIG. 18A, the movable member has narrower arc portion on the fulcrum side. Since the movable member 31 does not enter the second liquid flow path 16, it can take any form so long as it can operate smoothly with high durability.

In the above-mentioned embodiment, the plate-shaped movable member 31 and the separation wall 30 equipped with such element was made of a nickel plate of 5 μm in thickness. However, the wall 30 and the element 31 can be made of any material which is resistant to both bubble generating liquid and discharging liquid and has elasticity suitable for the element 31 and in which a fine slit can be formed.

The preferable material for the movable member is as follows: metals with high durability such as silver, nickel, gold, iron, titanium, aluminium, platinum, tantalum, stainless steel, and phosphor bronze; their alloys; resins containing nitride group such as acrylonitrile, butadiene, and styrene; resins containing amide group such as polyamide; resins containing carboxyl group such as polycarbonate; resins containing aldehyde group such as polyacetal; resins containing sulfone group such as polysulfone; resins such as liquid crystal polymer and their compounds; metals with high resistance to ink such as gold, tungsten, tantalum, nickel, stainless steel, and titanium; their alloys; materials coated with these metals or alloys: or resins containing amide group such as polyamide, resins containing aldehyde group such as polyacetal; resins containing ketone group such as polyether ether ketone; resins containing imide group such as polyimide; resins containing hydroxyl group such as phenol resins; resins containing ether group such as polyethylene; resins containing alkyl group such as polypropylene; resins containing epoxy group such as epoxy resins; resins containing amino group such as melamine resins; resins containing methyrol group such as xylene resins and their compounds; ceramics such as silicon dioxide and their compounds.

The preferable materials for the separation wall are as follows: resins with high heat resistance, high solvent resistance and easy moldability, for example, recent engineering plastics such as polyethylene, polypropylene, polyamide, polyethylene terephthalate, melamine resins, phenol resins, epoxy resins, polybutadiene, polyurethane, polyether ether ketone, polyether sulfone, polyarylate, polyimide, polysulfone, and liquid crystal polymer (LCP), and their compounds; or metals such as silicon dioxide, silicon nitride, nickel, and gold stainless steel, their alloys and compounds; or materials coated with titanium.

The thickness of the separation wall may be determined based on its strength required and smooth operability as a movable member, taking its material and shape into consideration. It is preferable that the separation wall is 5–10 μm in thickness.

In the present embodiment, the slit 35 as the movable member 31 is 2 μm in width. If such wall is used for preventing mixing of two different kinds of liquids, namely, the bubble generating liquid and the discharging liquid, the width of the slit 35 should be such that a meniscus is formed between two liquids to prevent their communication. For example, when a liquid with the viscosity of about 2 cP is used as the bubble generating liquid and a liquid with the viscosity of 100 cP or more as the discharging liquid, a slit of about 5 μm in width can prevent their mixing. However it is preferable to use a slit of less than 3 μm in width.

The movable member in accordance with the present invention should have thickness in the μm unit. Any movable member with the thickness in the cm unit may not be used for the present invention. If a slit with the width in the μm unit is formed in the movable member with the thickness in the μm unit, it is preferable to take some variation in the manufacturing process into consideration.

If any element opposite to the free end and/or one side of the movable member in which a slit is formed has a thickness almost equal to that of the movable member (FIGS. 16A, 16B, 17 etc.), mixing of the bubble generating liquid and the discharging liquid can be prevented by adjusting the relationship between the slit width and the movable member thickness within a range given below, taking variations in the manufacturing process into consideration. Under the restricted condition, when a bubble generating liquid with the viscosity of 3 cP or less is used with a discharging liquid with high viscosity of (5–10 cP), mixing of these two liquids can be prevented for a long time within the range of $W/t \leqq 1$. This range may be used as a reference value in the design stage. Any slit with the width of several μm or so may guarantee the above-mentioned "substantially sealed state".

As described above, the bubble generating liquid and the discharging liquid are used separately, the movable member is a substantial separation wall. When such movable member moves with bubble generation, a slight amount of the bubble generating liquid is mixed with the discharging liquid. It is typical that in the ink jet recording, the discharging liquid for forming an image contains about 3–5% of coloring material. Therefore, if the discharging liquid contains the bubble generating liquid in the range of 20% or less, the resulting image density does not change greatly. The present invention includes the such mixture of two liquids.

In the actual liquid discharging operation using the above-mentioned configuration, the uppermost limit of the mixed percentage of the bubble generating liquid into the discharging liquid at various viscosity was 15%. In the case of the bubble generating liquid with the viscosity of 5 cP or less, the uppermost limit of such percentage was about 10%, depending on a driving frequency. Especially, when the viscosity of the discharging liquid is less than 20 cP, lower the viscosity is, the less (less than 5%) such percentage becomes.

The arrangement of the liquid discharging head and the movable member will be described below with reference to the drawings. However, the shape, dimensions and number of the movable member and the heat generating element are not limited to those described below. By arranging these elements optimally, the pressure due to bubble generation by means of the heat generating element can be used more efficiently as the liquid discharging pressure.

Figure 20:
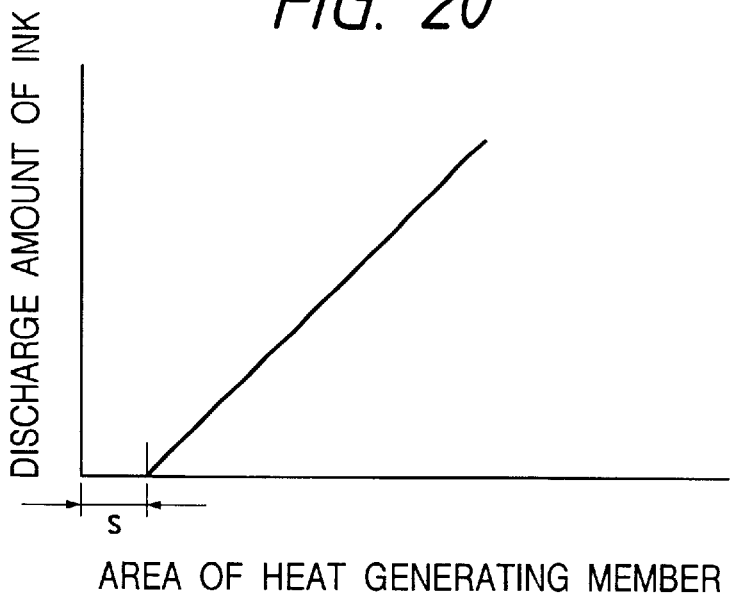
FIG. 20 is a graph showing a relationship between the area of the heat generating element and the ink discharging amount of a conventional liquid discharging head.

In the ink jet recording method, so-called the bubble jet recording method, the change of ink is caused with a sudden volume change (due to bubble generation) by applying the energy such as the heat to ink, ink being discharged with the pressure due to such state change out of an ink discharging port, such ink being stuck onto a recording medium. In this case, as shown in FIG. 20, the relationship between the area of the heat generating element and the discharged ink amount is linear and the former is almost in proportion to the latter. It is known that effective non-bubble generating area S which does not contribute to the ink discharging operation exists. It is also known that judging from scorched residue on the heat generating element, such effective non-bubble generating effective area surrounds such element. Therefore, it is considered that the peripheral portion of about 4 μm in width around the heat generating element does not contribute to the bubble generation.

To use the pressure due to bubble generation efficiently, it is effective to arrange the movable member in such manner that the operable portion of the movable member covers the bubble generating area about 4 μm apart from the periphery of the heat generating element. In the present embodiment, the effective bubble generating area is as described above, but such area varies in accordance with the kind and manufacturing process of the heat generating element.

Figure 21A:
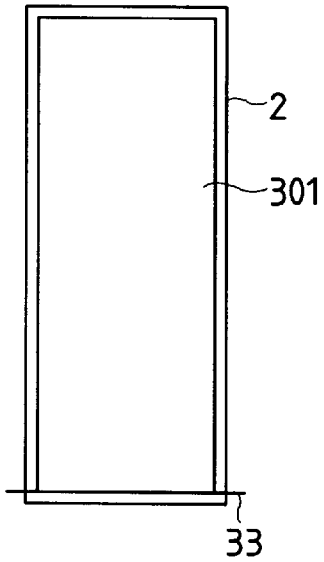
FIGS. 21A and 21B are plan views showing the arrangement of the movable member and the heat generating element.
Figure 21B:
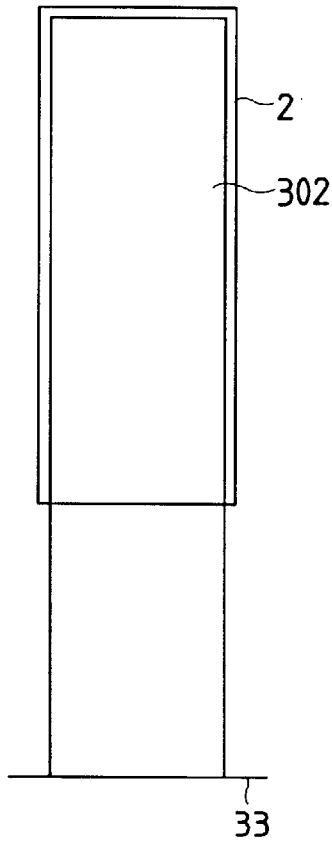
Figure 22:
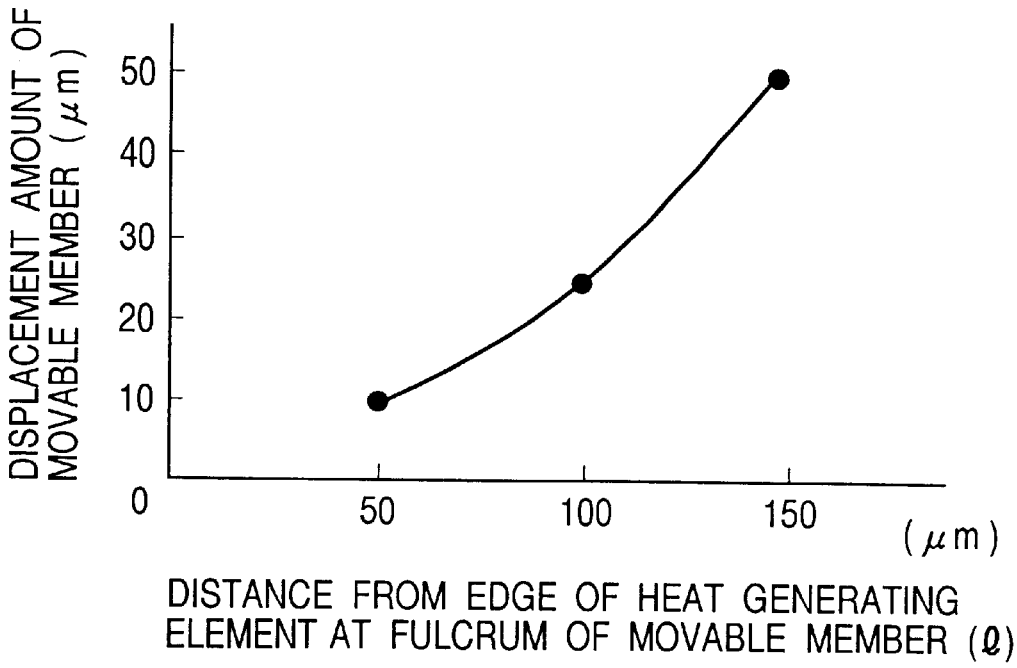
FIG. 22 is a graph showing a relationship between the distance between an edge and a fulcrum of the heat generating element and the displacement of the movable member.

FIGS. 21A and 21B show schematic top views of the layout of the heat generating element 2 of 58×150 μm in size and the movable member 301 and the movable member 302 with the different operable areas (FIG. 21A and FIG. 21B). In FIG. 21A, the movable member 301 is 53×145 μm in size which is smaller than the area of the heat generating element 2. However, such size is almost the same as the effective bubble generating area. The movable member is arranged so as to cover the above-mentioned effective bubble generating area. In FIG. 21B, the movable member 302 is 53×220 μm in size which is larger than the area of the heat generating element 2. (The width of the element 302 is the same as that of element 2, but the distance from the fulcrum to the tip is longer than that of the element 2.) Like the movable member 301, the element 302 covers the effective bubble generating area. The durability and the liquid discharging efficiency of two kinds of the movable members 301, 302 were measured under the measuring conditions described below.

| | |
|---|---|
| Bubble generating liquid: | Ethanol 40% water solution |
| Discharging ink: | Dye ink |
| Applied voltage: | 20.2 V |
| Frequency: | 3 kHz |

As a result, in the measurement of the movable member 301, as shown in FIG. 21A, its fulcrum was damaged when $1\times10^7$ pulse was applied. In the case of the movable member 302, as shown in FIG. 21B, the fulcrum was not damaged, when $3\times10^8$ pulse was applied. It was confirmed that the kinetic energy calculated from the liquid discharged amount and the liquid discharging speed for the input energy was enhanced about 1.5–2.5 times.

Judging from the above-mentioned experimental results, it is clear that both durability and liquid discharging efficiency can be enhanced by covering a space right over the effective bubble generating area with the movable member the area of which is larger than that of the heat generating element.

Figure 23:
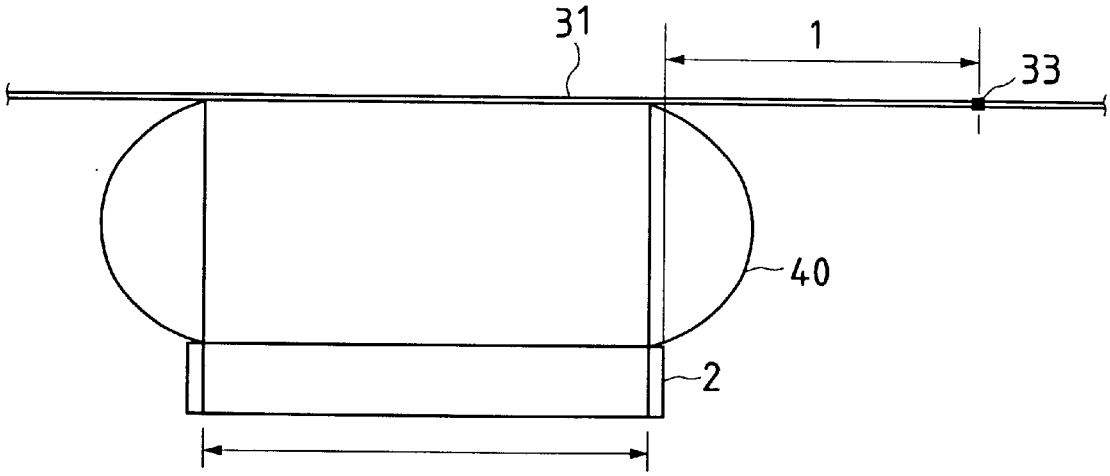
FIG. 23 is a schematic view showing the arrangement of the heat generating element and the movable member.

FIG. 20 shows the relationship between the distance from the edge of the heat generating element to the fulcrum of the movable member and the displacement of the movable member. FIG. 23 shows a sectional view of the layout of the heat generating element 2 and the movable member 31 viewed from the lateral side. The heat generating element of 40×105 μm in size was used. It is clear that the displacement distance increases with the increase of the distance 1 from the edge of the heat generating element 2 to the fulcrum 33 of the movable member 31. It is preferable to determine the position of the fulcrum 33 of the movable member 31 by finding the optimal displacement amount in accordance with the required ink discharging amount, the liquid flow path structure, and the shape of the heat generating element.

When the fulcrum 33 of the movable member 31 is situated in a space right over the effective bubble generating area of the heat generating element, the durability of the movable member 31 lowers due to the stress by the displacement of the movable member and the pressure due to bubble generation directly applied to the fulcrum 33. It was found out by the experiments of the present inventors that when the fulcrum is situated in a space right over the effective bubble generating area, the movable wall of the movable member was damaged by the pulse of about $1\times10^6$ and its durability lowers. Therefore, by placing such fulcrum 33 at a position deviated from such position, the movable member 31 of the shape and material with not so high durability can be practically used. However, even though the fulcrum 33 is situated in a space right over the effective bubble generating area, a movable member can enjoy high durability by selecting its shape and material properly. With this configuration, the liquid discharging head with high liquid discharging efficiency and excellent durability can be obtained.

<Element Substrate>

The configuration of the element substrate equipped with a heat generating element for applying the heat to the liquid will be described below.

Figure 24A:
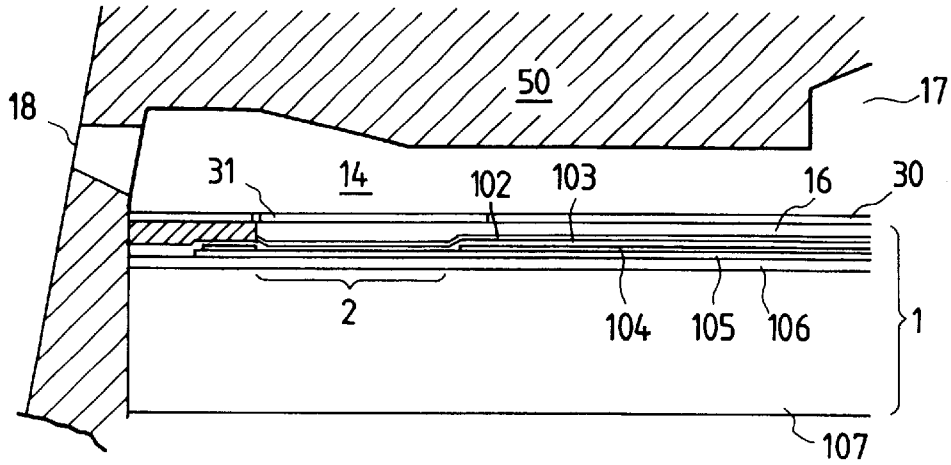
FIG. 24A is a longitudinal sectional view of a liquid discharging head equipped with a protective film.
Figure 24B:
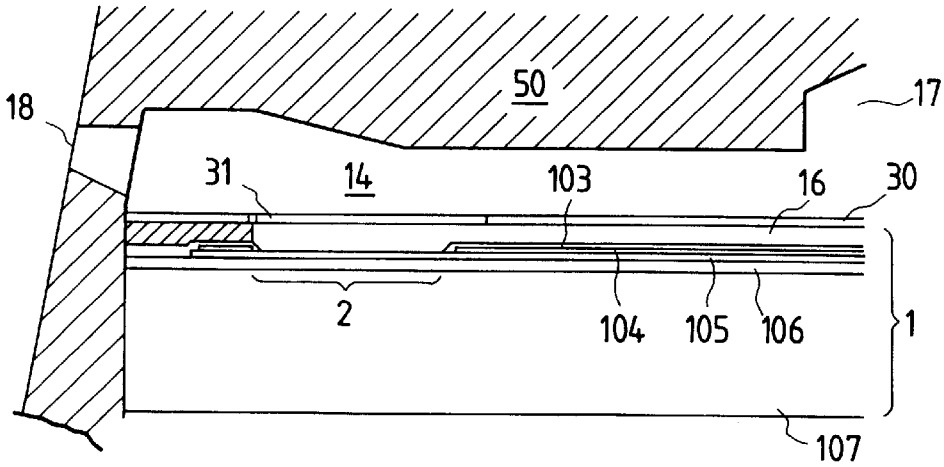
FIG. 24B is a longitudinal sectional view of a liquid discharging head not equipped with a protective film.

FIGS. 24A and 24B show longitudinal sections of the liquid discharging head in accordance with the present invention. FIG. 24A shows the liquid discharging head equipped with a protective film described below. FIG. 24B shows such head not equipped with the protective film.

An element equipped with the second liquid flow path 16, the separation wall 30, the first liquid flow path 14 and the grooved member 50 constituting the first liquid flow path is installed on the element substrate. On the element substrate 1, a base 107 made of silicon is coated with silicon oxide film or silicon nitride film 106 for insulation and heat accumulation. On such coating, an electric resistance layer 105 (0.01–0.2 μm in thickness) made of hafnium boride ($HfB_2$), tantalum nitride (TaN), tantalum aluminium (TaA1), etc., as the heat generating element 2 and the wiring electrodes (0.2–1.0 μm in thickness) are patterned as shown in FIG. 15. When the voltage is applied from these two electrodes 104 to the resistance layer 105, the current flows through such layer and the heat is generated. A protective layer 104 of silicon oxide, silicon nitride, etc., is formed in the thickness of 0.1–2.0 μm on the resistance layer between two wiring electrodes 104. On the protective layer, a cavitation resistant layer of tantalum etc., (0.1–0.6 μm in thickness) 103 is coated to protect the resistance layer 105 from various kinds of the liquid such as ink. Especially, the pressure and the shock wave due to bubble generation and bubble break are very intensive, so the durability of the hard and brittle film oxide lowers markedly. Therefore, a layer of metals such as tantalum (Ta) is used as the cavitation resistant layer 103.

A combination of the liquid, liquid flow path structure and resistance material requiring no protective layer described above may be used. FIG. 24B shows an example of such combination. An example of the material of such protective layer is iridium-tantalum-aluminium alloy.

The heat generating element of each embodiment described above may be the above-mentioned resistance layer alone (the heat generating part) between the electrodes described above or a combination of the resistance layer and the protective layer therefor.

In each embodiment described above, the heat generating element equipped with the heat generating part which generates the heat by an electric signal is used as a heat generating element. The heat generating element in accordance with the present invention is not limited to such element. Any heat generating element may be used which can generate sufficient bubble in the bubble generating liquid to discharge the discharging liquid. For example, a heat generating element may be used which is equipped with a light-heat converter that generates the heat when irradiated with the laser, etc., or equipped with a heat generating part that generates the heat when activated by a high frequency.

In addition to the resistance layer 105 constituting the heat generating part and an electrothermal converting element consisting of the wiring electrodes 104 which apply an electric signal to such layer 105, function elements for driving the electrothermal converting element (the heat generating element 2) selectively such as a transistor, diode, latch register, and shift register, may be incorporated in the element substrate in a semiconductor manufacturing process.

Figure 25:
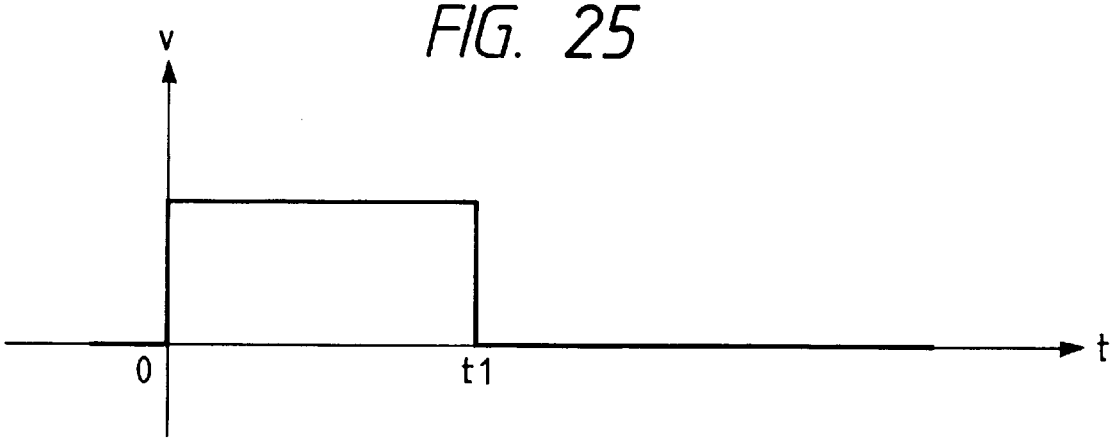
FIG. 25 is a schematic view showing the shape of a driving pulse.

To drive the heat generating part of the electrothermal converting element on the element substrate in order to discharge the liquid, a rectangular pulse shown in FIG. 25 is applied to the resistance layer 105 through the wiring electrodes 104 to heat such resistance layer 105 suddenly. In the liquid discharging head of each embodiment describe above, the heat generating element 2 is driven with an electric signal of 24V in voltage, 7 $\mu$sec in pulse width and 150 mA in current repeatedly applied thereto at the frequency of 6 kHz. As a result, the liquid, namely, ink in this case is discharged out of the liquid discharging port by the operation described above. However, the driving signal is not limited to such electric signal. Any driving signal may be used, so long as the bubble can be generated properly in the bubble generating liquid.

<Head Construction with Two Liquid Flow Paths>

Figure 26:
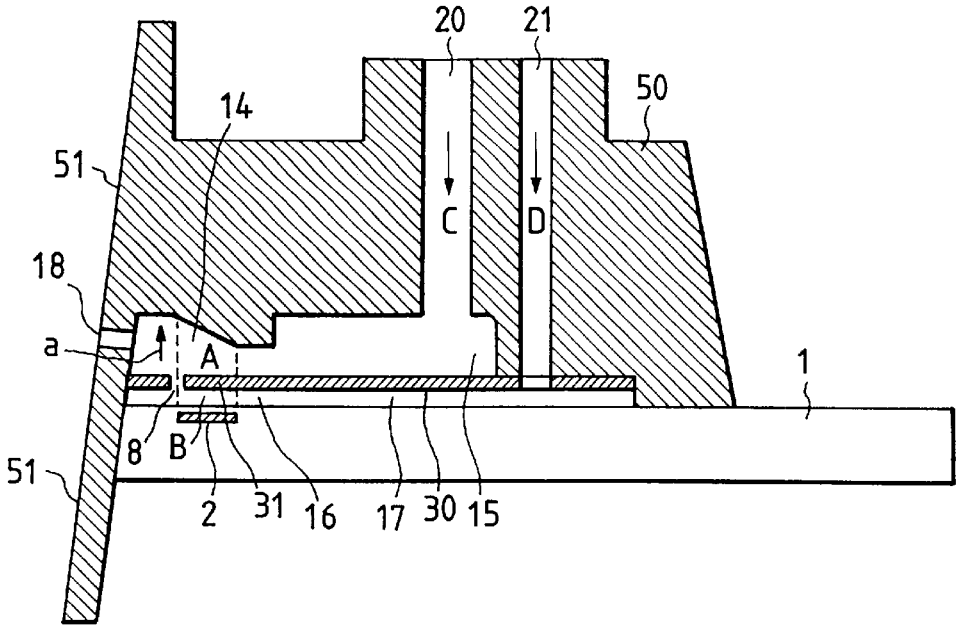
FIG. 26 is a sectional view showing a liquid supply path of the liquid discharging head equipped with two liquid flow paths.
Figure 27:
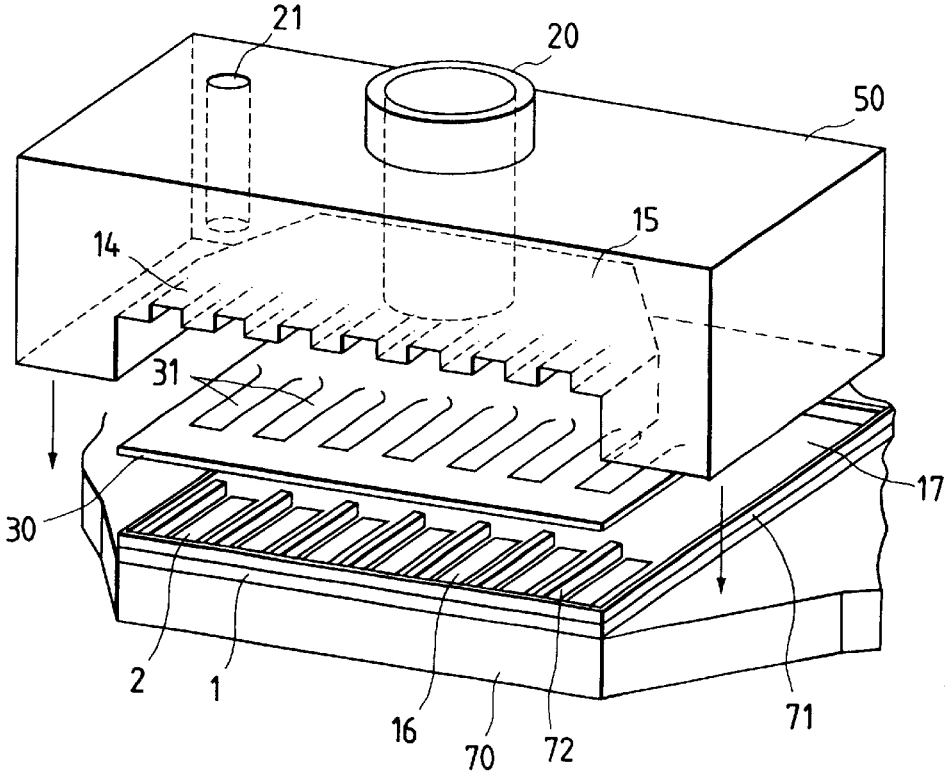
FIG. 27 shows the exploded perspective view of the liquid discharging head of FIG. 26.

The construction of the liquid discharging head will be described below which can separate two different kinds of the liquid and introduce each liquid into first and second common liquid chambers respectively and can reduce the number of the parts with cost reduction. FIG. 26 shows a schematic diagram of the construction of the liquid discharging head. The parts corresponding to those of the embodiment described above bear the same reference number. The detailed description of such parts is omitted here. FIG. 27 shows an exploded perspective view of such liquid discharging head.

The grooved member 50 comprises the orifice plate 51 equipped with the liquid discharging port 18, a plurality of grooves constituting a plurality of the first liquid flow paths, the concave portion constituting the first common liquid chamber 15 which communicates with a plurality of the liquid flow path 14 and supplies each liquid flow path with the liquid (the discharging liquid), etc. By joining the separation wall 30 with the lower part of the grooved member 50, a plurality of the first liquid flow paths can be formed. Such grooved member 50 is equipped with the first liquid supply path 20 communicating the upper part of the member 50 with the first common liquid chamber 15. The grooved member 50 is also equipped with the second liquid supply path 21 communicating the upper part of the member 50 with the second common liquid chamber through the separation wall 30. As shown with the arrow C in FIG. 26, the first liquid (the discharging liquid) is supplied to the first common liquid chamber 15 then to the first liquid flow path 14 through the first liquid supply path 20. As shown with the arrow D in FIG. 26, the second liquid (the bubble generating liquid) is supplied to the second common liquid chamber 17 then to the second liquid flow path 16 through the second liquid supply path 21.

In this case, the second liquid supply path 21 is arranged in parallel with the first liquid supply path 20. However, any arrangement will do so long as it communicates the second common liquid chamber 17 through the separation wall 30 installed on the outside of the first common liquid chamber 15. The diameter of the second liquid supply path 21 may be determined, taking the supply amount of the second liquid into consideration. Any shape such as circular form and rectangular form will do for the second liquid supply path 21. The second common liquid chamber 17 can be formed by separating the grooved member 50 by means of the separation wall 30. For example, as shown in FIG. 27, first, a common liquid chamber and a second liquid path wall are formed by means of dry film on the element substrate 1. Second, a second common liquid chamber 17 and a second liquid flow path 16 can be formed by bonding a combined body of a grooved member 50 with the separation wall 30 secured with the element substrate 1.

In the case of this liquid discharging head, as shown in FIG. 27, the element substrate 1 is installed on a support 70 made of metals such as aluminium. The element substrate 1 is equipped with a plurality of electrothermal converting elements as a heat generating element 2 for generating the heat to generate the bubble in the bubble generating liquid due to film boiling. On the element substrate 1, a plurality of the grooves constituting the second liquid flow path 16 formed by the second liquid path wall, a concave portion and the separation wall 30 equipped with the movable member 31 are installed. The concave portion forms the second common liquid chamber (the common bubble generating liquid chamber) 17 which communicates a plurality of the bubble generating flow paths (the second liquid flow path) and supplies each bubble generating liquid path with the bubble generating liquid.

As described above, the member 50 is equipped with the groove which constitutes the discharging liquid flow path (the first flow path) 14 together with the separation wall 30; the concave portion as the first common liquid chamber (the common discharging liquid chamber) 15 for supplying each discharging liquid flow path with the discharging liquid; the first liquid supply path (the discharging liquid supply path) 20 for supplying the first common liquid chamber with the discharging liquid; and the second liquid supply path (the bubble generating liquid supply path) 21 for supplying the second common liquid chamber 17. The second liquid supply path 21 is connected with a communication path which communicates with the second common liquid chamber 17 through the separation wall 30 arranged outside the first common liquid chamber 15. Therefore, the bubble generating liquid can be supplied to the second common liquid chamber 15 without being mixed with the discharging liquid through this communication path.

The movable member 31 is arranged on the heat generating element 2 of the element substrate 1. The discharging liquid path 14 is arranged on the front end of the movable member 31. In the case of the present embodiment, the grooved element 50 is equipped with only one second liquid supply path 21. However, the element 50 may include a plurality of second liquid supply paths 21 according to the amount of the liquid to be supplied. The sectional area of the discharging liquid supply path 20 and the bubble generating liquid supply path 21 may be determined in proportion to the amount of the liquid to be supplied. By optimizing the sectional area of the flow paths, more compact components may be used for the grooved member 50.

As described above, in the case of the present embodiment, the second liquid supply path for supplying the second liquid flow path with the second liquid and the first liquid supply path for supplying the first liquid flow path with the first liquid are formed of the grooved ceiling plate as the same grooved member. Therefore, the number of the components can be reduced, the manufacturing process can be shortened, and the cost reduction becomes possible. The second liquid is supplied to the second common liquid chamber communicating with the second liquid path by means of the second liquid supply path through the separation wall separating the first liquid from the second liquid.

The separation wall, the grooved member and the heat generating element substrate can be joined in one step, so the head with higher joining precision and improved liquid discharging properties can be more easily produced. Since the second liquid is supplied to the second common liquid chamber through the separation wall, the second liquid can be stably supplied in sufficient amount.

<Discharging Liquid and Bubble Generating Liquid>

As described above, the liquid discharging head in accordance with the present invention including the movable member can discharge a liquid with higher liquid discharging pressure and higher liquid discharging efficiency at a higher speed, compared with a conventional liquid discharging head. When the same liquid is used as the bubble generating liquid and the discharging liquid, such liquid does not deteriorate with the heat from the heat generating element, and hardly accumulates burned residue on the heat generating element. In addition, a reversible status change is possible between vaporization and condensation. Various kinds of the liquid may be used for the head of the present invention, so long as it does not deteriorate the liquid flow path, movable member, separation wall etc.

For example, ink for a conventional bubble jet printer may be used as a liquid (a recording liquid) for a recording medium.

When using the liquid discharging head equipped with two liquid flow paths as the above-mentioned sixth embodiment which uses different kind of the liquid as the discharging liquid and the bubble generating liquid, any liquid of the properties may be used as the bubble generating liquid. The examples of such liquid is as follows: methanol, ethanol, n-propanol, isopropanol, n-hexane, n-heptane, n-octane, toluene, xylene, methylene dichloride, trichloroethylene, Freon TF, Freon BF, ethyl ether, dioxane, cyclehexane, methyl acetate, ethyl acetate, acetone, methyl ethyl ketone, water, etc., and mixture thereof. As the discharging liquid, various kinds of the liquid of any bubbling and thermal properties. Any liquid having low bubbling property which cannot be easily discharged, any liquid which is apt to deteriorate and any liquid of high viscosity can be used as the discharging liquid. Such discharging liquid should not prevent the discharging and bubbling operation or the operation of the movable member when it is used alone or with the bubble generating liquid. Medicines, perfumes, etc., in the form of a liquid which are adversely affected by the heat may be used as the discharging liquid.

In the case of the present embodiment, ink having the properties given below was used as a recording liquid which may be used not only as the discharging As liquid but also as the bubble generating liquid. An image of very high quality was obtained due to improved landing precision of the liquid droplets which were discharged under stronger discharging pressure and at a high ink discharging speed.

TABLE 1

| | | |
|---|---|---|
| Dye ink (viscosity: 2 cP) | (C.I. food black 2) dye | 3 wt % |
| | Diethylene glycol | 10 wt % |
| | Thiodiglycol | 5 wt % |
| | Ethanol | 3 wt % |
| | Water | 77 wt % |

The combination of the bubble generating liquid and the discharging liquid having the compositions respectively was used for a recording operation. It was possible to discharge a liquid of the viscosity of about ten and several cP and even 150 cP which was hardly discharged by a conventional liquid discharging head. As a result, an image of high quality was recorded.

TABLE 2

| | | |
|---|---|---|
| Bubble generating liquid 1 | Ethanol | 40 wt % |
| | Water | 60 wt % |
| Bubble generating liquid 2 | Water | 100 wt % |
| Bubble generating liquid 3 | Isopropyl alcohol | 10 wt % |
| | Water | 90 wt % |
| Discharging liquid 1 Pigment ink (viscosity: 15 cP) | Carbon black 5 | 5 wt % |
| | Styrene-acrylic acid-ethyl acrylate copolymer (oxidation 140, weight average molecular weight 8000) | 1 wt % |
| | Monoethanolamine | 0.25 wt % |
| | Glycerine | 69 wt % |
| | Thiodiglycol | 5 wt % |
| | Ethanol | 3 wt % |
| | Water | 16.75 wt % |
| Discharging liquid 2 (viscosity: 55 cP) | Polyethylene glycol 200 | 100 wt % |
| Discharging liquid 3 (viscosity: 150 cP) | Polyethylene glycol 600 | 100 wt % |

When any liquid which was hardly discharged by a conventional liquid discharging head is used, it was difficult to obtain an image of high quality due to the variation of the liquid discharging direction owing to low discharging speed, low liquid landing precision on a recording medium, and unstable liquid discharging amount owing to unstable liquid discharging operation. However, in the case of the above-mentioned embodiment, sufficient and stable bubble generation becomes possible by using the bubble generating liquid. Therefore, the liquid droplet landing precision can be improved and the ink discharging amount can be stabilized. As a result, the quality of a recorded image can be improved markedly.

<Manufacture of the Liquid Discharging Head>

The manufacturing process of the liquid discharging head in accordance with the present invention will be described below.

In the case of the liquid discharging head as shown in FIG. 2, the base 34 for the movable member 31 was formed by patterning dry film, etc., on the element substrate 1. The movable member 31 was adhered or secured by fusion on such base 34. Then the grooved member 50 including a plurality of the grooved as each liquid flow path 10, the liquid discharging port 18, and the concave portion as the common liquid chamber 13 was joined with the element substrate 1 in such manner that the grooves correspond to the movable member 31.

The manufacturing process of the liquid discharging head equipped with two liquid flow paths as shown in FIGS. 14 and 27 will be described below.

The wall of the second liquid flow path 16 is formed on the element substrate 1. The separation wall 30 is installed on such wall. The grooved member 50 equipped with the groove as the first liquid flow path 14, etc., is mounted on such separation wall 30. Alternately, after forming the wall of the second liquid flow path 16, the grooved member 50 equipped with the separation wall 30 is installed on the wall. Thus the liquid discharging head with two liquid flow paths is manufactured.

The manufacturing process of the second liquid flow path will be described in detail below. FIGS. 28A to 28E show schematic sectional views of the first embodiment of the manufacturing process of the liquid discharging head equipped with two liquid flow paths.

Figure 28A:
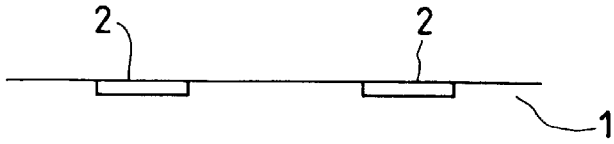
FIGS. 28A, 28B, 28C, 28D and 28E are flow charts showing a first embodiment of a liquid discharging head manufacturing process.

In the case of this embodiment, as shown in FIG. 28A, an electrothermal converting element having the heat generating element 2 consisting of hafnium boride, tantalum nitride, etc., is formed on the element substrate (silicon wafer) 1, by using a manufacturing equipment similar to that for semiconductor. Then the surface of the element substrate 1 is washed in order to improve the adhesion to photosensitive resin in the next process. To improve such adhesion further, the element substrate surface is exposed with the ultraviolet ray, ozone, etc., in order to improve the surface condition. Then the resulting surface is spin-coated with a dilute solution prepared by dissolving 1% by weight of silane coupling agent (manufactured by Nippon Unica, A189) in ethyl alcohol to enhance such adhesion further.

Figure 28B:
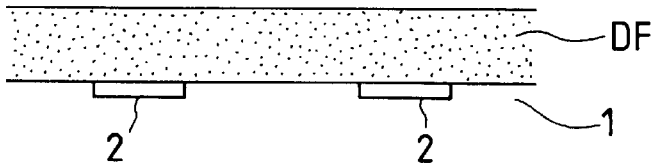

The element substrate surface is washed again. The resulting surface is laminated with the ultraviolet ray sensitive resin film (manufactured by Tokyo Ohka, Dry Film Odyl SY-318) as shown in FIG. 28B.

Figure 28C:
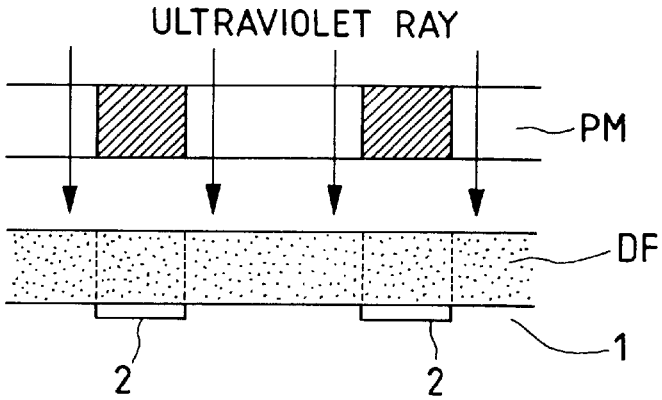

As shown in FIG. 28C, a photo mask PM is placed on the dry film DF. The ultraviolet ray is irradiated on part of the dry film DF through the photo mask PM to form the wall of the second liquid flow path. In this exposure process, about 600 mJ/cm$^2$ of the ultraviolet ray is irradiated by means of an exposure equipment (manufactured by Canon, MPA-600).

Figure 28D:
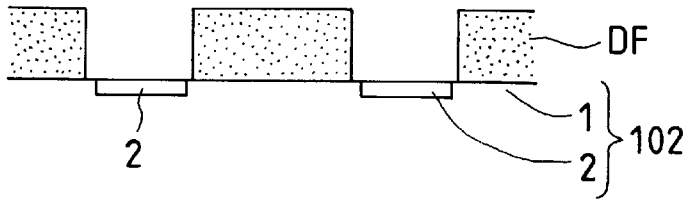

As shown in FIG. 28D, the dry film DF is developed in a developing solution (manufactured by Tokyo Ohka Co., Ltd., BMRC-3) consisting of xylene and butyl cell solve acetate. As a result, unexposed portion is dissolved and exposed and hardened portion remains as the wall of the second liquid flow path 16. All the residue on the element substrate 1 is removed by means of an oxygen plasma ashing device (manufactured by Alcantech, MAS-800) for about 90 seconds. Then the exposed portion is irradiated with the ultraviolet ray in the dose of 100 mJ/cm$^2$ for two hours at 150° C. to harden it completely.

The second flow path can be uniformly formed for a plurality of heater board (the element substrate) by dividing the above-mentioned silicon base by the procedure described above. The silicon base is cut and separated into each heater board (the element substrate) by means of a dicing machine (manufactured by Tokyo Seimitsu, AWD-4000) equipped with a diamond plate of 0.05 mm in thickness. The resulting heater board (the element substrate) is secured on an aluminium support (a base plate) 70 with adhesive (manufactured by Toray, SE4400) (See FIG. 31). Then a PC board 71 previously secured on the support 70 with the element substrate 1 by means of a 0.05 mm aluminium wire (not shown).

Figure 28E:
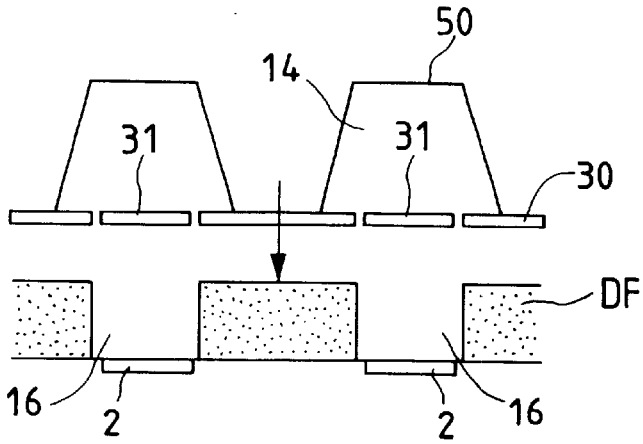

As shown in FIG. 28E, the joined body of the grooved member 50 and the separation wall 30 is aligned and joined on the resulting element substrate 1 by the procedure described above. That is, the grooved member equipped with the separation wall 30 is aligned with the element substrate 1. They are engaged and secured by means of a retaining spring 78. A supply element 80 for the bubble generating liquid is joined and secured on the support 70. A gap between the aluminium wires and a gap between the grooved member 50 and the element substrate 1 and the supply member 80 for ink and the bubble generating liquid are sealed with silicone sealant (manufactured by Toshiba Silicone, TSE399). Thus the liquid discharging head is manufactured.

By forming the second liquid flow path by the above-mentioned procedure, such path is aligned with the heater (the heat generating element) of each element substrate with high precision. Especially, by joining the grooved member 50 with the separation wall 30 previously, more precise alignment can be achieved between the first liquid flow path 14 and the movable member 31. By this high precision manufacturing know-how, the liquid discharging operation can be stabilized and the printing quality can be improved. Since the second liquid flow path can be formed in one step on a wafer, the liquid discharging head can be manufactured in a large quantity at low cost.

In the case of the present embodiment, dry film which hardened with the irradiation of the ultraviolet ray is used for forming the second liquid flow path. It is also possible to form the second liquid flow path by first laminating the element substrate with resin film having the absorption range at the wavelength of about 248 nm, second hardening such film, and third, directly removing resin corresponding to the second liquid flow path with excimer laser.

FIGS. 29A to 29D show the second embodiment of the liquid discharging procedure equipped with two liquid flow paths.

Figure 29A:
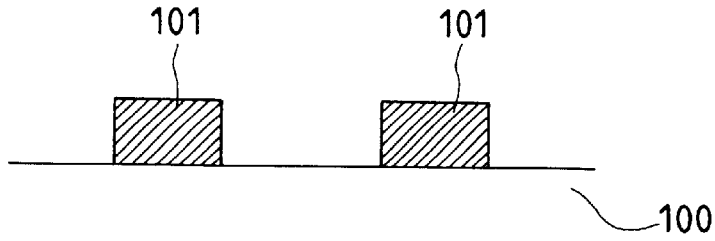
FIGS. 29A, 29B, 29C and 29D are flow charts showing a second embodiment of a liquid discharging head manufacturing process.
Figure 29B:
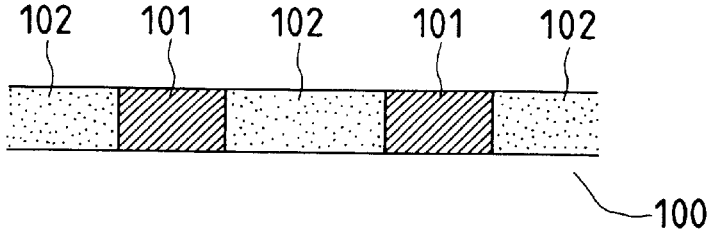
Figure 29C:
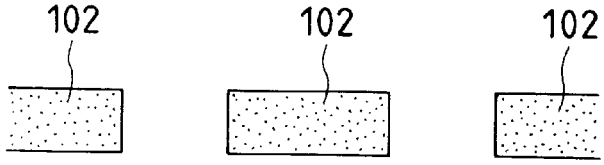

In the case of the present embodiment, as shown in FIG. 29A, photoresist 101 is applied in the thickness of 15 $\mu$m in the form of the second liquid flow path on an SUS (stainless steel) base 100. Then, as shown in FIG. 29B, the SUS base 100 is electroplated with nickel to form a nickel layer 102 of 15 $\mu$m in thickness thereon. As the electroplating solution, a nickel sulfonate solution containing a stress reducing agent (manufactured by World Metal, Zeroall), boric acid, a pit preventing agent (manufactured by World Metal, NP-APS) and nickel chloride is used. In the electroplating process, an electrode is connected with an anode, an already patterned SUS base 100 is attached to a cathode, the electroplating solution temperature is kept at 50° C., and a current density is adjusted to 5A/cm$^2$. Then, as shown in FIG. 29C, a supersonic wave is applied to the electroplated SUS base 100 to peel the nickel layer 102 from the SUS base 100 to form the second liquid flow path required.

The heater board (the element substrate) 1 equipped with the electrothermal converting element is formed into a silicon wafer by means of a manufacturing equipment similar to a semiconductor manufacturing equipment. Like the above-mentioned embodiment, the wafer is cut and separated into each heater board (the element substrate) 1 by means of a dicing machine. The resulting element substrate 1 is joined with the aluminium support 70 to which the PC board 104 was already connected. The PC board 71 is electrically connected with an aluminium wire (not shown).

Figure 29D:
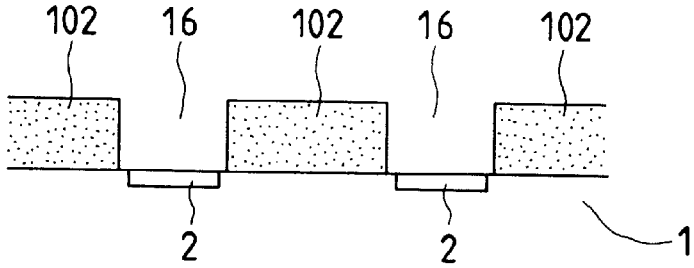

As shown in FIG. 29D, the second liquid flow path formed in the preceding process is preliminarily aligned and secured on the above-mentioned element substrate 1. It is sufficient for such path to be secured in such a manner that such alignment is not disturbed. Because in the subsequent process, like the first embodiment, such path is engaged and adhered by means of the ceiling plate on which the separation wall is secured and the retaining spring. In the case of the present embodiment, in the above-mentioned aligning and securing process, an adhesive which hardens with the irradiation of the ultraviolet ray (manufactured by Grace Japan, Amicon UV-300) is applied to the surface of the element substrate 1. Such adhesive can be hardened at a dose of 100 mJ/cm$^2$ for about 3 seconds by means of an ultraviolet ray irradiation equipment.

According to the manufacturing process of the present embodiment, the second liquid flow path precisely aligned with the heat generating element can be formed. In addition, since such flow path wall is made of nickel, it is possible to provide a reliable liquid discharging head with high resistance to an alkaline liquid.

FIGS. 30A to 30D show the third embodiment of the manufacturing process of the liquid discharging head equipped with two liquid flow paths.

Figure 30A:
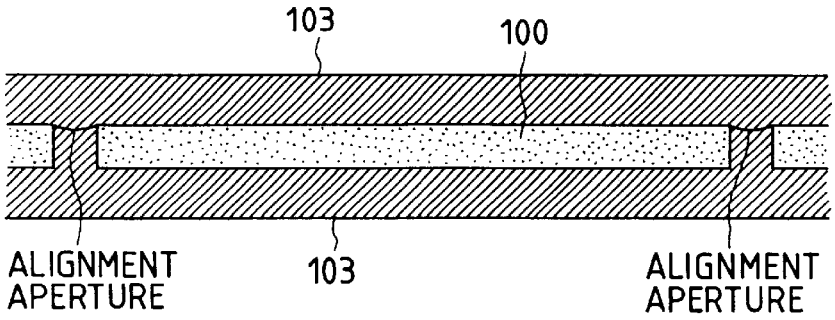
FIGS. 30A, 30B, 30C and 30D are flow charts showing a third embodiment of a liquid discharging head manufacturing process.
Figure 30B:
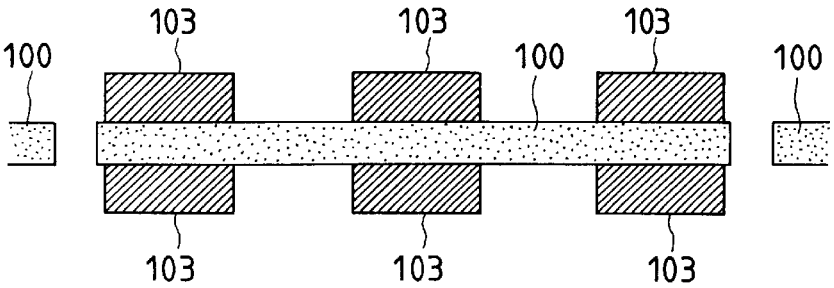
Figure 30C:
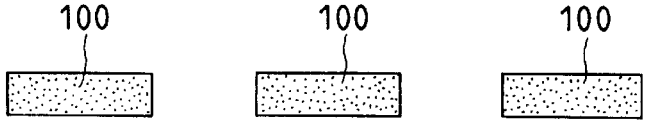
Figure 30D:
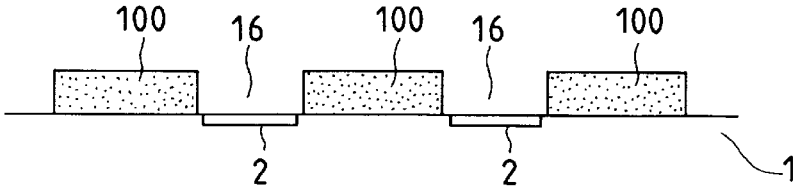

As shown in FIG. 30A, photoresist 103 is applied to both sides of the SUS base 100 of 15 $\mu$m in thickness having an alignment hole or a mark 100*a*. As photoresist, PMERP-AR900 manufactured by Tokyo Ohka is used. Then, as shown in FIG. 30B, the applied photoresist is exposed by means of a exposure equipment (manufactured by Canon, MPA-600) according to the alignment hole 100*a* on the element substrate 100. Photoresist 103 corresponding to the second liquid flow path is removed. Such exposure is performed at a dose of 800 mJ/cm$^2$. Then, as shown in FIG. 30C, the SUS base 100 with photoresist 103 patterned on both sides is soake in an etching solution (the water solution containing ferric chloride or cupric chloride) to etch unexposed portion from photoresist 103 to peel off photoresist. Then, as shown in FIG. 30D, like the embodiment of the preceding manufacturing process, the etched SUS base 100 is aligned and secured on the heater board 1. Thus the liquid discharging head equipped with the second liquid flow path is assembled.

According to the manufacturing process of the present embodiment, the second liquid flow path 16 precisely aligned with the heat can be formed. In addition, since such flow path is made of stainless steel, it is possible to provide a reliable liquid discharging head with high resistance to an acidic and alkaline liquid.

As described above, according to the manufacturing process of each embodiment described above, by forming the wall of the second liquid flow path preliminarily on the element substrate, it becomes possible to align the electric heat generating element with the second liquid flow path with high precision. The second liquid flow path can be formed on many element substrates on the base at a time prior to the cutting and separating process. Therefore, it is possible to provide a liquid discharging head in large quantity at low cost. In the liquid discharging head manufactured in accordance with these manufacturing processes, the heat generating element is aligned with the second liquid flow path with high precision. Therefore, the pressure due to bubble generation by the heat from the electric heat converting element can be efficiently used and high liquid discharging efficiency can be achieved.

<Liquid Discharging Head Cartridge>

A liquid discharging head cartridge equipped with the liquid discharging head according to each embodiment described above will be schematically described.

Figure 31:
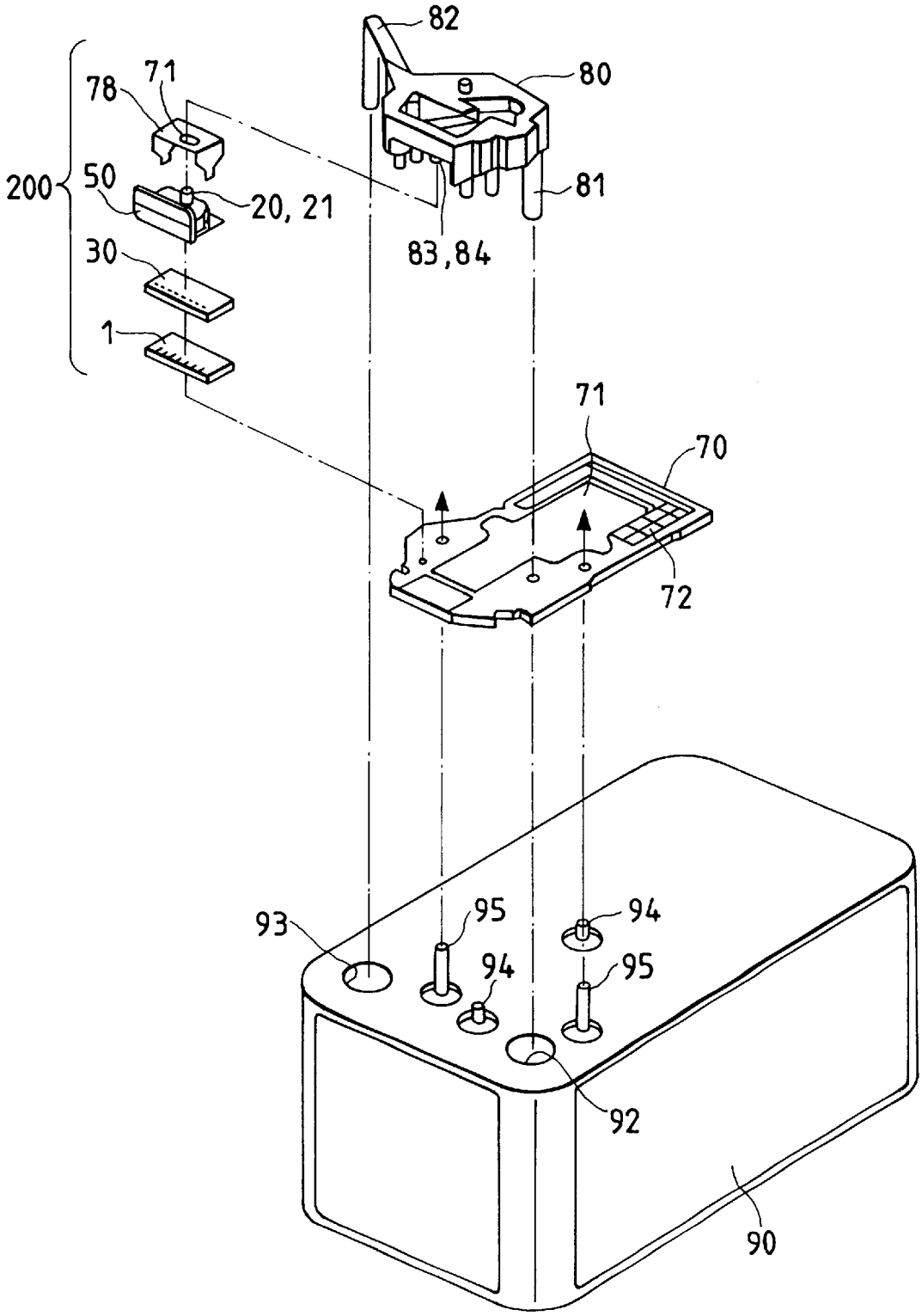
FIG. 31 shows an exploded perspective view of the liquid discharging head cartridge.

FIG. 31 shows a schematic partial exploded perspective diagram of the liquid discharging head cartridge including the above-mentioned liquid discharging head. Such liquid discharging head cartridge consists of two main units, namely, the liquid discharging head 200 and the liquid container 80.

The liquid discharging head 200 consists of the element substrate 1, the separation wall 30, the grooved member 50, the retaining spring 78, the liquid supply member 90, the support 70, etc. As described above, a plurality of the heat generating resistors (the heat generating elements) are arranged in rows on the element substrate 1. On this base, a plurality of the function elements for driving these heat generating resistors selectively are also arranged. A path for the bubble generating liquid is formed such element substrate 1 and the separation wall 30 equipped with the movable member. The bubble generating flow passes through such path. A path for the discharging liquid (not shown) is formed by joining the separation wall 30 and the grooved ceiling plate 50. The retaining spring 78 is used to push the grooved member 50 toward the element substrate 1. By this force, the element substrate 1, the separation wall 30, the grooved member 50 and the support 70 are formed into one assembly. The support 70 sustains the element substrate 1, etc. In addition, on such support 70, the PC board 71 which connects with the element substrate 1 and supplies an electric signal, and a contact pad 72 which connects with the equipment side and exchanges an electric signal with it.

The liquid container 90 contains the discharging liquid such as ink to be supplied to the liquid discharging head and the bubble generating liquid which generates the bubble separately. Outside the liquid container 90, a positioning member 94 for arranging a connecting member for communicating the liquid discharging head with the liquid container 90, and a securing shaft 95 for retaining such connecting member are installed. The discharging liquid is supplied from the discharging liquid supply path 92 of the liquid container 90 to the discharging liquid supply path 81 of the liquid supply member 80 through the liquid supply path 84 of the connecting member, then to the first common liquid chamber through the discharging liquid supply paths 83, 71 and 21 of each member. Similarly, the bubble generating liquid is supplied from the supply path 93 of the liquid container 90 to the bubble generating liquid supply path 82 of the liquid supply member 80 through the liquid supply path of the connecting member, then to the second common liquid chamber through the bubble generating liquid supply paths 84, 71 and 22 of each member.

The liquid discharging head cartridge equipped with the liquid supply mechanism and the liquid container for two different kinds of the liquid, namely, the bubble generating liquid and the discharging liquid has been described. If the same liquid is used as these liquids, the same liquid supply path and the same container can be used for the above-mentioned two liquids. The liquid container may be filled with each liquid after each liquid has been completely used up. Therefore, it is preferable to form a liquid injecting opening in the liquid container. The liquid discharging head and the liquid container may be assembled in a body or separately.

<Liquid Discharging Device>

Figure 32:
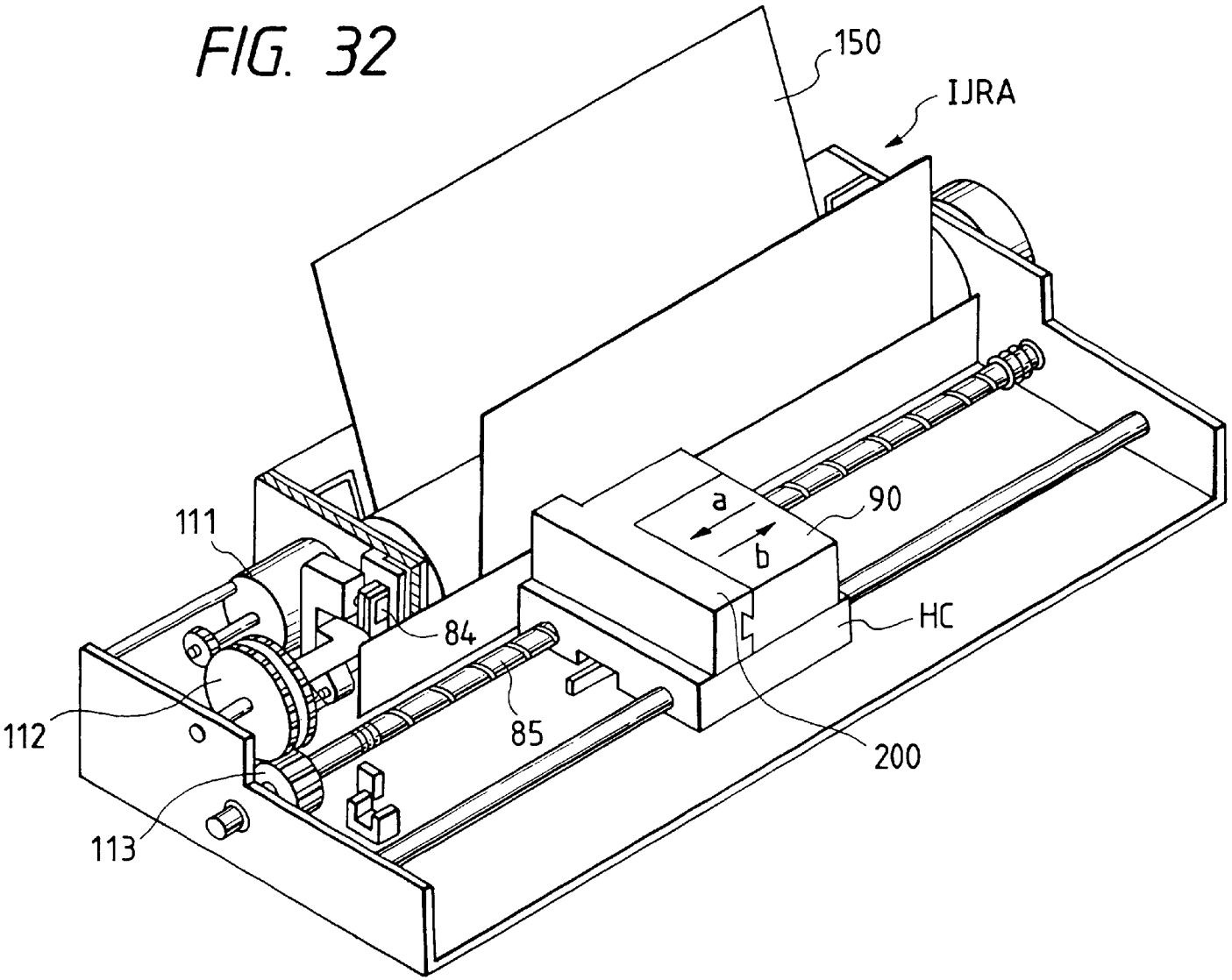
FIG. 32 shows a schematic perspective view showing the configuration of liquid discharging equipment.

FIG. 32 is a schematic diagram illustrating the structure of a liquid discharging device on which a liquid discharging head is mounted. In this example, an ink ejection recording device IJRA that employs ink as discharging liquid will be explained.

On a carriage HC of the liquid discharging device (ink ejection recording device IJRA) is mounted a head cartridge, to which a liquid tank 90 in which ink is retained and a liquid discharging head 200 can be detachably attached. The carriage HC reciprocates in the direction of the width of a recording medium 150, such as a recording sheet, that is fed by a recording medium feeding means. When a driving signal is supplied from driving signal supply means (not shown) to the liquid discharging means on the carriage HC, liquid is ejected toward the recording medium through the liquid discharging head. The liquid discharging device of the present invention includes a motor 111 that serves as a driving source for driving the recording medium feeding means and the carriage HC; gears 112 and 113 for transmitting power from the driving source to the carriage HC; and a carriage shaft 115. When liquid was ejected toward various types of recording media by this recording device according to the liquid discharging method, satisfactory images could be obtained.

Figure 33:
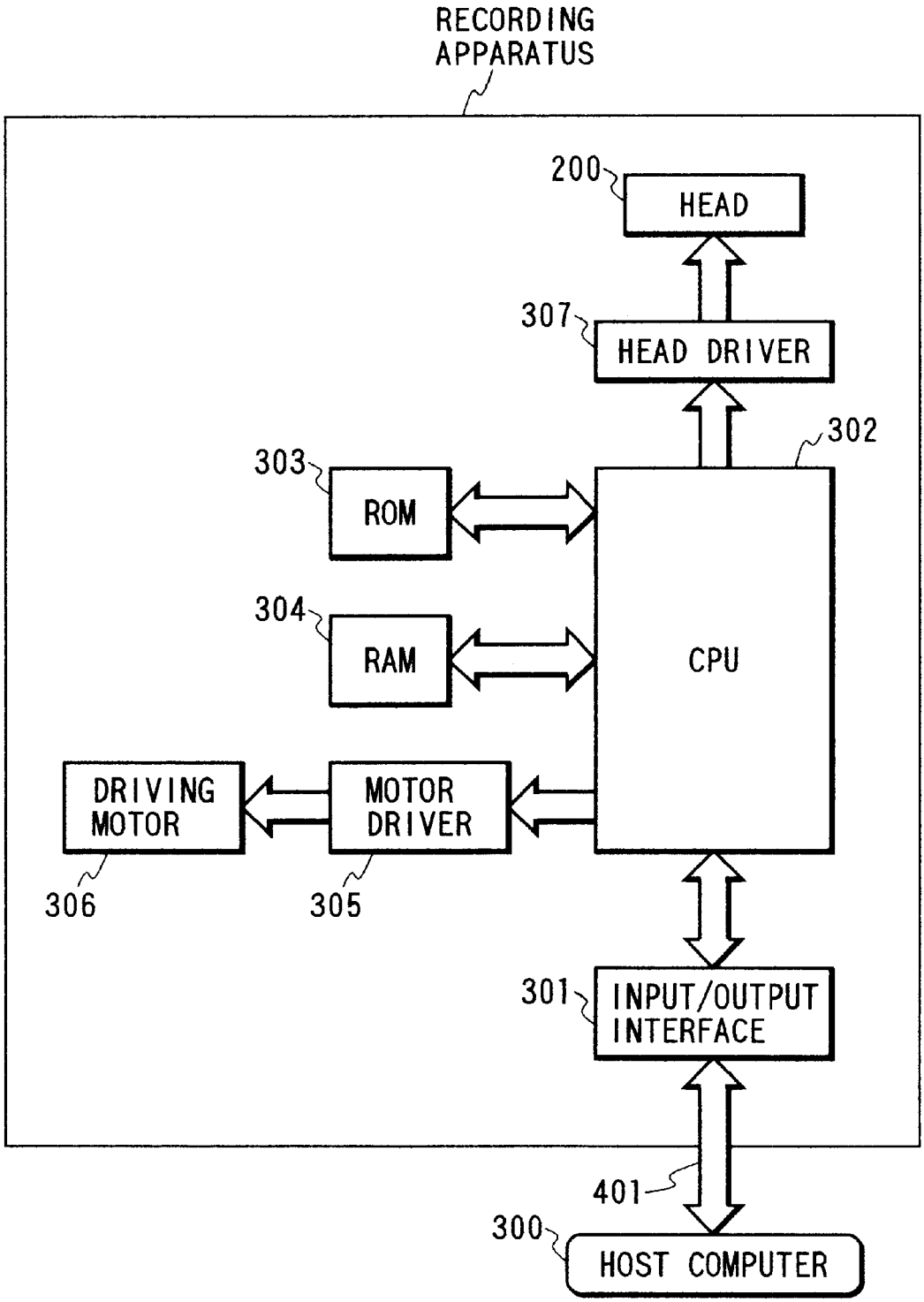
FIG. 33 is a block diagram showing a circuit configuration of the equipment of FIG. 32.

FIG. 33 is a block diagram illustrating the entire arrangement of a recording device that employs the liquid discharging method and the liquid discharging head of the present invention to record images by ejecting ink.

The recording device receives print data as a control signal from a host computer 300. The print data is temporarily held in an input interface 301. At the same time, the print data is converted into data that can be processed inside the device, and the resultant data are transmitted to a CPU 302, which also serves as head driving signal supply means. Based on a control program stored in a ROM 303, the CPU 302 processes the received data using a peripheral unit, such as a RAM 304, and converts the raw data into image data. In addition, in order to record the image data at a satisfactory position on a recording sheet, the CPU 302 prepares driving data used for driving the motor that moves the recording sheet and the recording head synchronously with the recording of the image data. The image data and motor driving data are transmitted respectively via a head driver 307 and a motor driver 305 to the head 200 and the drive motor 306, which are driven at controlled timings to form images.

The recording medium, which can be employed for the above recording device and toward which liquid such as ink is ejected, is one of various types of paper, an OHP sheet, plastic material used for compact disks and decorative laminated sheets, cloth, metal, such as aluminum or copper, leather, such as oxhide, pig skin or artificial leather, wood, such as plywood or bamboo, ceramics, such as tiles, or a three-dimensional net structure, such as a sponge. The recording device includes a printer for printing on various types of paper and OHP sheets; a plastic recording device for recording on plastic material, such as compact disks; a metal recording device for recording on metal plates; a leather recording device for recording on leather; a ceramics recording device for recording on ceramics; a recording device for recording on a three-dimensional net structure such as a sponge; or a textile printing device for printing on cloth. Liquids that match individual recording media and recording conditions can be used as the discharging liquids for these liquid discharging devices.

<Recording System>

Figure 34:
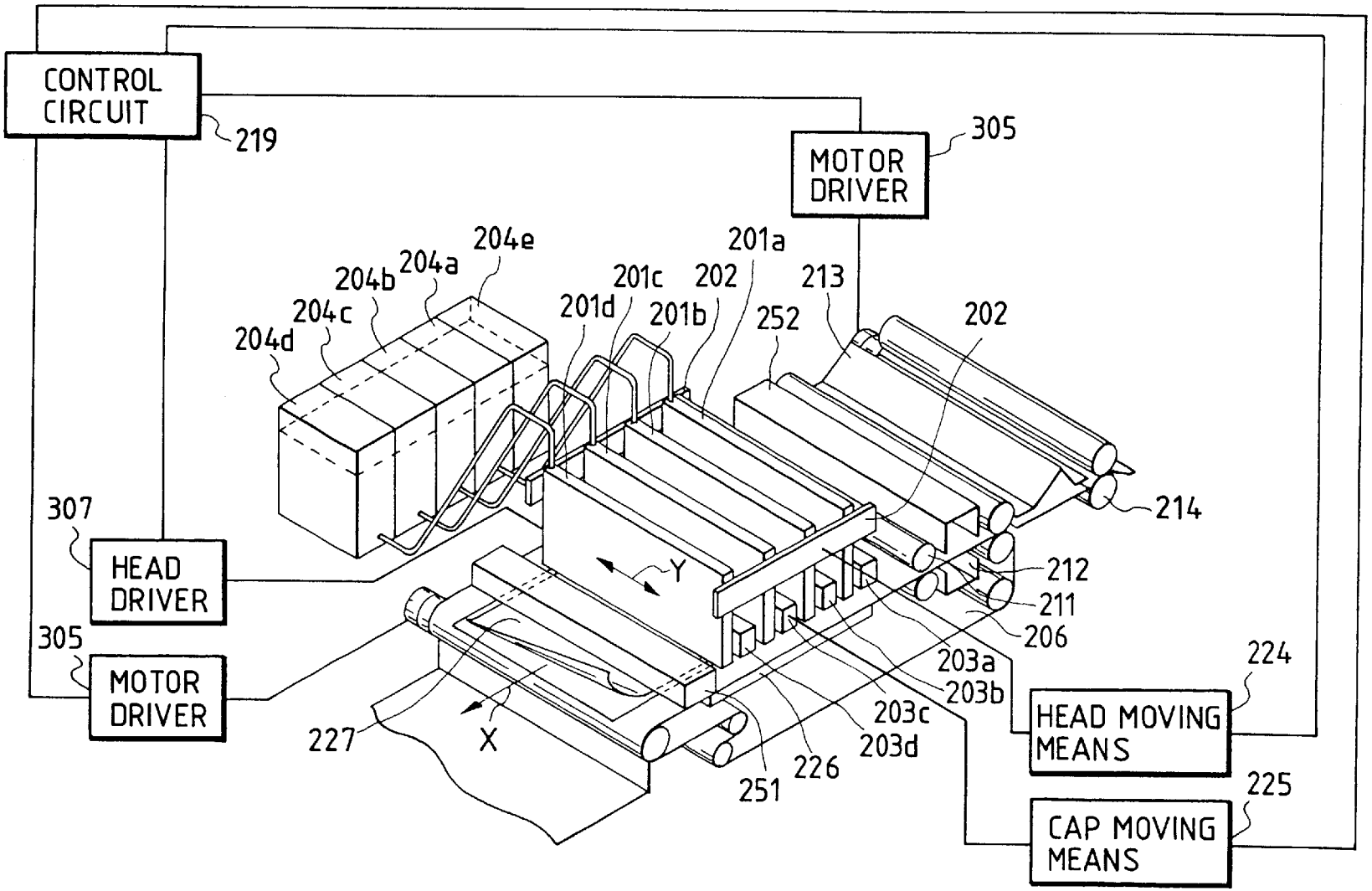
FIG. 34 is a diagram showing the configuration of an ink jet recording system.

An explanation will now be given for an example ink-jet recording system that employs the liquid discharging head of the present invention as a recording head when recording an image on a recording medium. FIG. 34 is a specific diagram for explaining the structure of this ink-jet recording system that employs a liquid discharging head 201 according to the present invention.

The liquid discharging head 201 of the ink-jet recording system is a full-line type head where a plurality of discharging ports are arranged at intervals (with a density) of 360 dpi (360 dots for each 25.4 mm) along a length that corresponds to the available recording width for a recording medium 150. Four corresponding liquid discharging heads 201*a*, 201*b*, 201*c* and 201*d* for the colors yellow (Y), magenta (M), cyan (C) and black (Bk) are held parallel to each other by a holder 202 at predetermined intervals in direction X. Signals are supplied to these four liquid discharging heads 201*a* to 201*d* from head drivers 307 that constitute driving signal supply means, and the liquid discharging heads 201*a* to 201*d* are driven in response to the signals. Four colors of ink, Y, M, C and Bk, are supplied to the liquid discharging heads 201*a* to 201*d* by respective ink containers 204*a* to 204*d*. A bubbling liquid is retained in a liquid container 204*e*, and is supplied by this container 204*e* to the liquid discharging heads 201*a* to 201*d*. Head caps 203*a* to 203*d* that have internal ink absorption members, such as sponges, are located below the respective liquid discharging heads 201*a* to 201*d*. When no recording is being performed, the head caps 203*a* to 203*d* cover the discharging ports of the liquid discharging heads 201*a* to 201*d* to protect them.

In addition a feed belt 206 is provided for the recording system, and serves as feeding means for feeding the various recording media that were described in the previous embodiments. The feed belt 206 lies along a predetermined route supported by rollers, and is driven by a driving roller connected to the motor driver 305.

In this ink-jet recording system, a pre-processor 251 and a post-processor 252 are respectively provided upstream and downstream along the recording medium feeding route, and perform various processes for the recording medium before and after printing is performed for a recording medium. The pre-process and the post-process differ depending on the recording medium type and the ink type. For example, a recording medium, such as metal, plastic and ceramics, is irradiated by ultraviolet rays and ozone as a pre-process to cure the surface of the recording medium, so that the attachment of ink is enhanced. Other recording media, such as plastic, that tend to generate static electricity may attract dust that adheres to their surfaces and could interrupt the recording process. Therefore, as the pre-process for such media, static electricity is removed from a recording medium by an ionizer so that dust on the recording surface can be removed. Further, when cloth is employed as a recording medium, as the pre-process, either an alkaline substance, an aqueous substance, a synthetic polymer, an aqueous metal complex salt, urea, or thiourea is selected and applied to the recording material in order to prevent a feathering image and to improve a degree of exhaustion. The pre-processes are not limited to those mentioned above, and they may involve the setting of the temperature of a recording medium to one that is appropriate for recording. The post-process may be a thermal process, a fixing process for promoting the fixing of ink by irradiation with ultraviolet rays, or a process for removing a processing agent that was provided in the pre-process and was not removed during printing.

In this embodiment, a full-line head type has been employed, but the liquid discharging head is not limited to this type. The previously described compact head may be moved in the direction of the width of the recording medium to record images.

<Head Kit>

Figure 35:
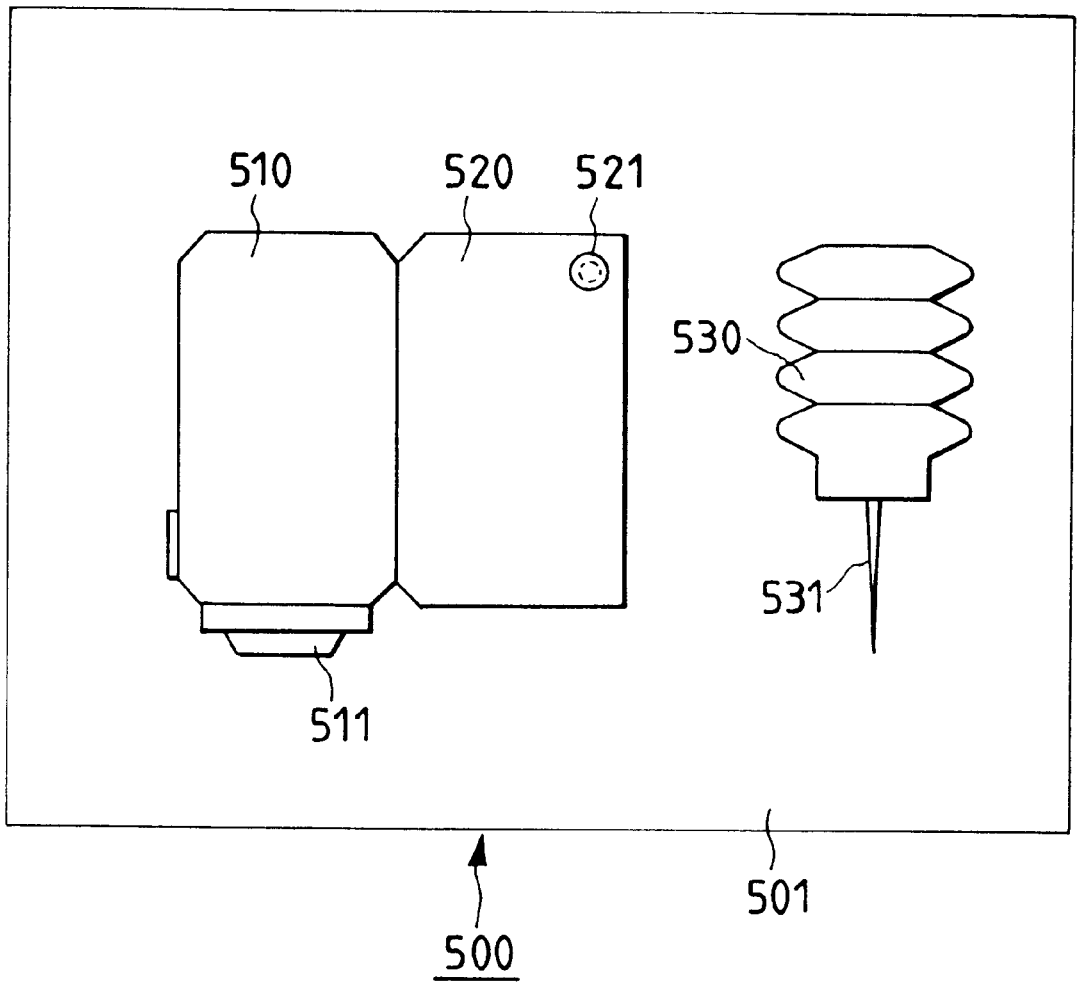
FIG. 35 is a schematic view of a head kit.
Figure 36A:
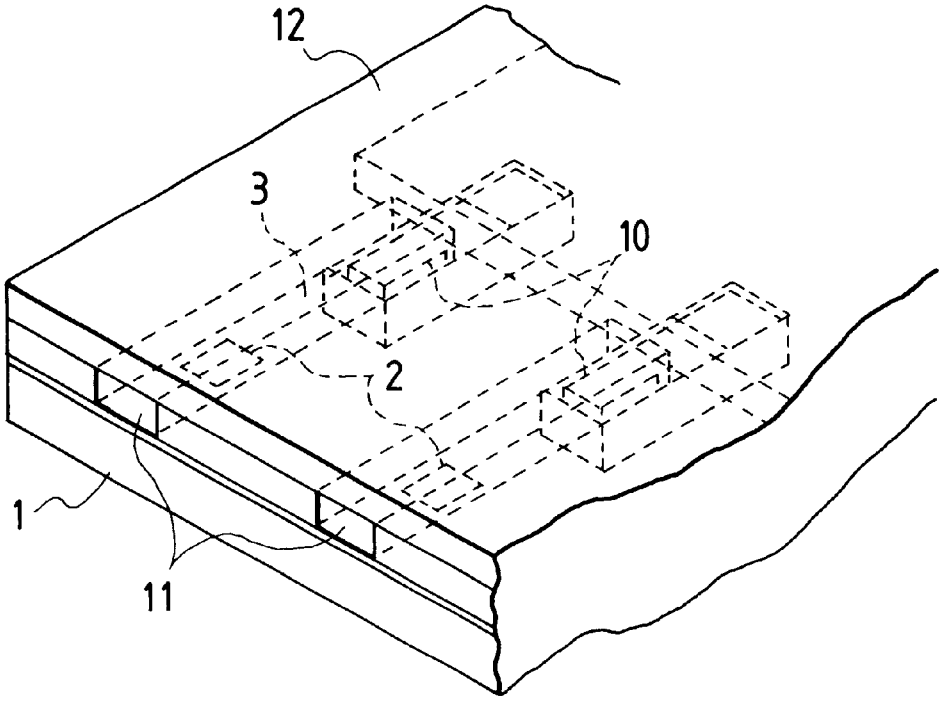
FIGS. 36A and 36B are diagrams showing a liquid flow path of a conventional liquid discharging head.
Figure 36B:
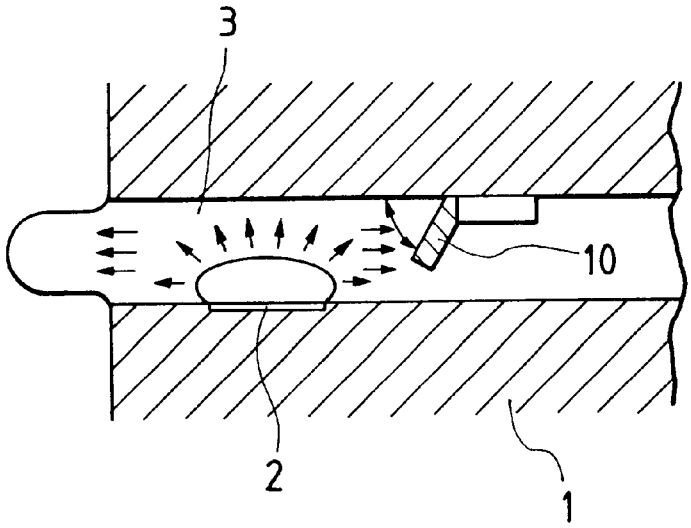

A head kit of which one component is a liquid discharging head of the present invention will now be described. FIG. 35 is a specific diagram showing a head kit.

In a kit container 501 of the head kit in FIG. 35 are stored a liquid discharging head 510, which has an ink discharging portion 511 for discharging ink; an ink en container 520, which is a liquid container that can be included as a part of the head 510 or as a separate part; and ink refilling means 530 for holding ink for refilling the ink container 520. When the supply of ink in the ink container 520 is exhausted, an insertion portion (injection needle) 531 of the ink refilling means 530 is partially inserted into a communication opening 521 in the ink container 520, the portion connected to the head, or into an opening in the wall of the ink container 520, so that using the inserted portion 531 a supply of ink can be transferred from the ink refilling means 530 to the ink container 520.

Since the liquid discharging head of the present invention, the ink container and the ink refilling means are stored in a single kit container and constitute a head kit, even when the ink container has been emptied, it can be easily refilled with ink and recording can be quickly resumed.

Although the head kit in this embodiment has ink refilling means, another type of head kit can be employed with which ink refilling means is not provided, for which a separate ink container filled with ink and a head are stored in a kit container 510. Although only the ink refilling means for refilling the ink container is shown in FIG. 35, in addition to the ink container, bubbling liquid refilling means may be stored in the kit container to refill a bubbling liquid container.

The present invention has been described mainly by employing a liquid discharging head, of an edge shooter type, that has a discharging port at a side position relative to a bubble-generating region. The present invention, however, can be applied for a side shooter type that has a discharging port at a position corresponding to a bubble-generating region or a heat-generating element.

As is described above, according to the present invention, an innovative discharging principle employing a flexible member is used to acquire an extremely superior discharging efficiency and a rapid refill characteristic. Further, a volume from the discharging port to the displacement locus of the free end of the flexible member is defined as a discharging quantity, and energy sufficient to discharge the defined quantity is applied. As a result, the discharging quantity is easily controlled, a stable discharging quantity can be acquired, and refilling can be performed at high speed. In addition, the present invention can provide an effect that ensures the discharging quantity will be stable even when environmental conditions, such as temperature, are altered.

Especially with the structure of the present invention, wherein the refill characteristic is improved, sequential discharge response, stable bubble growth and stabilization of liquid droplet discharge can be achieved, and fast recording by the rapid discharge of liquid, and a high quality image recording can be provided.

When a liquid in which a bubble is easily generated, or a liquid with which production and deposit of a precipitate (scorching) on a heat-generating element is difficult, is employed as a bubbling liquid for a liquid discharging head having a dual flow path structure, the degree of freedom available in the selection of a discharging liquid is increased. And a preferable discharge is possible, even of a liquid, such as a viscous liquid in which generation of a bubble is difficult or a liquid with which a precipitate is easily generated and deposited on a heat-generating element, that is difficult to discharge when a conventional bubble-jet discharging method is used. In addition, a liquid that is easily damaged by heat can be discharged without being adversely affected by heat.

What is claimed is:

1. A liquid discharging method which employs a liquid discharging head comprising a liquid discharging port communicating with a liquid flow path; a bubble generating region in said flow path where a bubble is generated in liquid in said flow path; and a movable member extending along said flow path and having a free end which is moveable and a fulcrum which is fixed, wherein said free end can move between a first position and a second position which is located at a point farther from the bubble generating region compared with the first position in response to an expansion of a bubble generated in said bubble generating region; wherein said movable member is movable from the first position to said second position by a pressure of said bubble generated in said bubble generating region in order to discharge the liquid out of said liquid discharging port, said method comprising the steps of:

providing said movable member with said free end in a downstream direction with respect to said fulcrum and applying discharging energy to said liquid in said bubble generating region in an amount which causes saturation wherein an amount of liquid discharged does not change substantially with increases in said discharging energy.

2. The liquid discharging method according to claim 1, wherein said bubble expands beyond said first position, and at the same time said movable member moves to said second position, a downstream portion of said bubble grows in the downstream side of said movable member by the displacement of said movable member.

3. A liquid discharging method which employs a liquid discharging head comprising: a liquid discharging port; a first liquid flow path connected with said liquid discharging port; a second liquid flow path including a bubble generating region; and a movable member having a fulcrum and a free end, said free end extending in a downstream direction with respect to said fulcrum and said movable member being located between said first liquid flow path and said bubble generating region, wherein said free end of said movable member moves toward said first liquid flow path by a pressure of a bubble generated in said bubble generating region, whereby liquid is discharged out of said liquid discharging port by liquid discharging energy applied to liquid in said bubble generating region, said method comprising the steps of:

applying discharging energy to the liquid in said bubble generating region in an amount such that the amount of liquid discharged out of said liquid discharging port does not change substantially with increases in applied discharging energy.

4. A liquid discharging method according to claim 3, wherein part of the generated bubble extends to said first liquid flow path according to the displacement of said movable member.

5. A liquid discharging method according to claim 1 or 3, wherein the liquid discharging amount at a time due to the application of said discharging energy in said saturation domain is substantially equal to a volume expressed by the product of the area of said liquid discharging port and a distance between said liquid discharging port and the displacement trace surface of said free.

6. A liquid discharging method according to claim 1 or 3, wherein the liquid discharging amount at a time due to the application of said discharging energy in said saturation domain is more than the product of 90% of said liquid discharging port and the distance between said liquid discharging port and the displacement trace surface of said free end and less than the product of the distance between said liquid discharging port and the displacement trace surface of said free plus 10 $\mu$m and the area of said liquid discharging port.

7. A liquid discharging method according to claim 1 or 3, wherein the displacement amount of said movable member is larger than the opening length of said liquid discharging port in the displacement direction of said movable member.

8. A liquid discharging method according to claim 1 or 3, wherein a heat generating element is installed at a position facing said movable member, said bubble generating region is present between said movable member and said heat generating element, said bubble generating energy is applied to said heat generating element.

9. A liquid discharging method according to claim 8, wherein said free end is situated in the downstream side in the liquid flow direction with respect to the center of said heat generating element.

10. A liquid discharging method according to claim 8, wherein said bubble is generated in said liquid due to film boiling in it by the heat transmitted from said heat generating element to the liquid.

11. A liquid discharging method according to claim 3, wherein the same liquid is supplied to the said first liquid flow path and said second liquid flow path.

12. A liquid discharging method according to claim 3, wherein a liquid to be supplied to said first liquid flow path is different from a liquid to be supplied to the second liquid flow path.

13. A liquid discharging method for discharging a liquid out of a liquid discharging port, said liquid discharging port being located at a downstream end of a liquid flow path, wherein said liquid is supplied to said liquid flow path from an upstream end thereof, and a heat generating element which is located in said liquid flow path, generates a bubble by heating the liquid with heat generated by activation of said heat generating element, said bubble causing displacement of a free end of a movable member which extends along said flow path and which faces said heat generating element, whereby liquid is discharged out of said liquid discharging port by a pressure of said generated bubble, said generated bubble causing displacement of the free end of said movable member to discharge liquid from said liquid discharging port, said method comprising the steps of:

by application of said bubble generating energy generating liquid discharging energy in an amount of the liquid discharged out of said liquid discharging port does not change substantially with increasing liquid discharging energy; and discharging liquid from said liquid discharging port by application of a bubble in liquid in said liquid flow path which bubble displaces said free end of said movable member.

14. A liquid discharging method for discharging liquid from a liquid discharging port by use of a movable member equipped with a displaceable free end in a liquid flow path communicating with said liquid discharging port, said method comprising the steps of:

said free end of said movable member by the generation of a bubble having at least a pressure component directly acting on a liquid droplet;

generating liquid discharging energy in an amount of the liquid discharged out of said liquid discharging port does not change substantially with increasing liquid discharging energy; and discharging liquid from said liquid discharging port by application of a bubble in said liquid flow path which bubble displaces said free end of said movable member.

15. A liquid discharging method according to claim 14, wherein the front end including the free end of said movable member moves from a first position where the bubble generating region of the bubble due to said film boiling is substantially sealed from said liquid discharging port to a second position where said bubble generating region is opened to said liquid discharging port by said bubble portion.

16. A liquid discharging method in which liquid droplets are discharged out of a liquid discharging port situated on a downstream side of a bubble generating element with respect to a liquid droplet discharging direction by a bubble generated by bubble generating energy in a bubble generating region, wherein a movable member is employed which is equipped with a free end which substantially seals a liquid discharging port side of said bubble generating region from said liquid discharging port, said movable member being equipped with a surface ranging from a fulcrum to a free end, said fulcrum being situated away from said liquid discharging port and said free end being situated toward said liquid discharging port, said method comprising the steps of:

opening said bubble generating region to the liquid discharging port by moving said substantially sealed free end by said generated bubble; and discharging, said liquid by applying liquid droplet discharging pressure to liquid;

by applying the bubble generating energy in a domain in which an amount of liquid discharged out of said liquid discharging port does not change substantially with increases in the applied bubble generating energy.

17. A liquid discharging method according to one of claims 13, 14 and 16, wherein the liquid discharging amount at a time due to the application of said discharging energy in said saturation domain is substantially equal to a volume expressed by the product of said liquid discharging port area and a distance between said liquid discharging port and the displacement trace surface of said free end.

18. A liquid discharging method according to one of claims 13, 14 and 16, wherein the liquid discharging amount at a time due to the application of said discharging energy in said saturation domain is more than the product of 90% of said liquid discharging port area and the distance between said liquid discharging port and the displacement trace surface of said free end and less than the product of the distance between said liquid discharging port and the displacement trace surface of said free end plus 10 $\mu$m and said liquid discharging port area.

19. A liquid discharging method according to one of claims 13, 14 and 16, wherein the displacement amount of said movable member is larger than the opening length of said liquid discharging port in the displacement direction of said movable member.

20. A liquid discharging head which comprise:

a liquid discharging port;

means defining a bubble generating region where a bubble is generated in a liquid; and a movable member that faces said bubble generating region and that is movable between a first position and a second position which is located at a point farther from the bubble generating region compared with the first position, wherein said movable member moves from the first position to the second position due to a pressure of a bubble generated by bubble generating energy in said bubble generating region; and a source of bubble generating energy arranged to supply bubble generating energy to liquid in said bubble generating region in an amount corresponding to a saturation domain where an amount of the liquid discharged out of said liquid discharging port does not increase substantially with increasing bubble generating energy.

21. A liquid discharging head according to claim 20, wherein the downstream portion of said bubble grows toward the downstream side of said movable member due to the displacement of said movable member.

22. A liquid discharging head which comprises:

means defining a first liquid flow path connected with a liquid discharging port;

means defining a second liquid flow path including a bubble generating region where a bubble is generated in liquid in said second liquid flow path by means of heat applied to the liquid by bubble generating energy; and a movable member that is equipped with a free end on a liquid discharging port side thereof, said movable member being located between said first liquid flow path and said bubble generating region, wherein liquid is discharged by a motion of said free end of said movable member toward said first liquid flow path by pressure from a bubble generated in said bubble generating region, and by applying bubble generating energy to the liquid by introducing said pressure to the liquid discharging port side of said first liquid flow path, said bubble generating region of said second flow path being arranged to be supplied with energy in an amount such that an amount of liquid discharged out of said liquid discharging port is substantially unchanged with increases of said bubble generating energy.

23. A liquid discharging head according to claim 22, wherein said movable member is formed as part of a separation wall installed between said first liquid flow path and said second liquid flow path.

24. A liquid discharging head according to claim 22 or 23, wherein such a head includes a first common liquid chamber for supplying a plurality of said first liquid flow paths with a first liquid, and a second liquid common chamber for supplying a plurality of said second liquid flow paths with a second liquid.

25. A liquid discharging head according to claim 20 or 22, wherein the sectional area of the path at said liquid discharging port is smaller than that of said liquid flow path at a position including a domain where said movable member is installed.

26. A liquid discharging head according to claim 20 or 22, wherein the liquid discharging amount due to one application of the energy when substantially saturated as described above is substantially equal to a volume expressed by the product of said liquid discharging port area and a distance between said liquid discharging port and the displacement trace surface of said free end.

27. A liquid discharging head according to claim 20 or 22, wherein the liquid discharging amount due to one application of said discharging energy when substantially saturated as described above is more than the product of 90% of said liquid discharging port area and the distance between said liquid discharging port and the displacement trace surface of said free end and less than the product of the distance between said liquid discharging port and the displacement trace surface of said free end plus 10 $\mu$m and said liquid discharging port area.

28. A liquid discharging head according to claim 20 or 22, wherein the displacement amount of said movable member is larger than the opening length of said liquid discharging port in the displacement direction of said movable member.

29. A liquid discharging head according to claim 20 or 22, wherein said movable member is plate-shaped.

30. A liquid discharging head according to claim 20 or 22, wherein a he at generating element is installed at a position facing said movable member, said bubble generating region is present between said movable member and said heat generating element.

31. A liquid discharging head according to claim 30, wherein the free end of said movable member is situated in the downstream side in the liquid flow direction with respect to the center of said heat generating element area.

32. A liquid discharging head according to claim 30, wherein a liquid supply path is installed for supplying the liquid from the upstream side of said heat generating element to said heat generating element along such heat generating element.

33. A liquid discharging head according to claim 32, wherein said supply path has a substantially flat or gently sloping internal wall on the upstream side of said supply path and supplies the liquid to said heat generating element along said internal wall.

34. A liquid discharging head which comprises:

a liquid discharging port;

a liquid flow path including a heat generating element for generating a bubble in a liquid by heating the liquid;

a liquid supply path for supplying said heat generating element with a liquid from the upstream side of said heat generating element along said heat generating element; and a movable member having a free end on a liquid discharging port direction and facing said heat generating element, wherein pressure is introduced into liquid toward said discharge port by displacement of said free end by pressure of a generated bubble, said heat generating element being arranged to be supplied with energy in an amount such that when liquid is discharged out of said liquid discharging port by liquid discharging energy obtained by applying energy to said heat generating element, the amount of the liquid discharged out of said port does not increase substantially with increases of said liquid discharging energy.

35. A liquid discharging head which comprises:

a liquid discharging port;

a heat generating element for generating a bubble in a liquid by heating the liquid;

a movable member having a free end facing said liquid discharging port, said movable member facing said heat generating element, said movable member also being arranged to direct pressure toward said liquid discharging port by displacing said free end in response to the pressure of a generated bubble; and a liquid supply path for supplying said heat generating element with the liquid from an upstream side of said supply path and along a surface near to said heat generating element, said heat generating element being arranged to be supplied with energy in an amount such that when liquid is discharged out of said liquid discharging port by liquid discharging energy applied to said heat generating element, an amount of the liquid discharged out of said liquid discharging port does not change substantially with increases of said liquid discharging energy.

36. A liquid discharging head which comprises:

a plurality of liquid discharging ports;

a grooved element having a plurality of grooves for forming a plurality of first liquid flow paths connected directly with each corresponding liquid discharging port;

a grooved member including a concave portion forming a first common liquid chamber for supplying said plurality of first liquid flow paths with liquid;

an element substrate including a plurality of heat generating elements for generating a bubble in liquid by heating liquid;

separation walls situated between said grooved element and said element substrate and which constitute walls of further liquid flow paths corresponding to said heat generating elements and which liquid flow paths each include a movable member that is situated at a position facing a respective one of said heat generating elements and that moves toward said first liquid flow path by pressure resulting from bubble generation; and means for supplying energy to said heat generating elements in an amount such that when liquid is discharged out of said liquid discharging port by liquid discharging energy obtained by applying energy to one of said heat generating elements, an amount of liquid discharged out of said liquid discharging port is substantially unchanged with increases of said liquid discharging energy.

37. A liquid discharging head according to one of claims 34 to 36, wherein the liquid discharging amount due to one application of the energy when substantially saturated as described above is substantially equal to a volume expressed by the product of said liquid discharging port area and a distance between said liquid discharging port and the displacement trace surface of said free end.

38. A liquid discharging head according to one of claims 34 to 36, wherein the liquid discharging amount due to one application of said discharging energy when substantially saturated as described above is more than the product of 90% of said liquid discharging port area and the distance between said liquid discharging port and the displacement trace surface of said free end and less than the product of the distance between said liquid discharging port and the displacement trace surface of said free end plus 10 $\mu$m and said liquid discharging port area.

39. A liquid discharging head according to one of claims 34 to 36, wherein the displacement amount of said movable member is larger than the opening length of said liquid discharging port in the displacement direction of said movable member.

40. A liquid discharging head according to one of claims 34 to 36, wherein said bubble is generated in said liquid due to film boiling in it by the heat generated by said heat generating element.

41. A liquid discharging head according to one of claims 34 to 36, wherein the free end of said movable member is situated in the downstream side of the center of the area of said heat generating element.

42. A liquid discharging head according to claim 36, wherein said grooved member includes a first introduction path for introducing the liquid into said first common liquid chamber and a second introduction path for introducing the liquid into said second common liquid chamber.

43. A liquid discharging head according to one of claims 34 to 36, wherein said heat generating element is an electric heat converter including a heat generating resistor for generating the heat by receiving an electric signal.

44. A liquid discharging head according to claim 43, wherein said electric heat converter is said heat generating resistor covered with a protective film.

45. A liquid discharging head according to claim 43, wherein a wiring for transmitting an electric signal to said electric heat converter and a function element for sending an electric signal selectively to said electric heat converter are arranged on said element substrate.

46. A head cartridge including the liquid discharging head according to one of claims 20, 22, 34, 35 and 36 and a liquid container connected to supply a liquid to said liquid discharging head.

47. A liquid discharging device including a liquid discharging head according to one of claims 20, 22, 34, 35 and 36 and a driving signal connected to discharging head for supplying a driving signal for discharging a liquid out of said liquid discharging head.

48. A liquid discharging device including a liquid discharging head according to one of claims 20, 22, 34, 35 and 36 and a recording medium transport means mounted to transport a recording medium for receiving a liquid discharged from said liquid discharging head.

* * * * *

UNITED STATES PATENT AND TRADEMARK OFFICE

CERTIFICATE OF CORRECTION

PATENT NO. : 6,523,941 B2
DATED : February 25, 2003
INVENTOR(S) : Yoshie Asakawa et al.

It is certified that error appears in the above-identified patent and that said Letters Patent is hereby corrected as shown below:

Title page,
Item [56], FOREIGN PATENT DOCUMENTS,
"55081172" should read -- 55-081172 --;
"61069467" should read -- 61-069467 --; and
"63199972" should read -- 63-199972 --.

Column 8,
Line 60, "a" should read -- an --.

Column 15,
Line 8, "prevent" should read -- present --.

Column 16,
Line 4, "$S_oX0E \geqq V_\alpha 24$" should read -- $S_oX0E \geqq V_\alpha \geqq$ --; and
Line 57, "1 ps" should read -- 1 $\mu$s --.

Column 30,
Lines 27 and 48, "aluminium" should read -- aluminum --.

Column 31,
Line 13, "describe" should read -- described --.

Column 33,
Line 49, "As" should be deleted.

Column 35,
Lines 47, 51 and 60, "aluminium" should read -- aluminum --.

Column 36,
Lines 46 and 48, "aluminium" should read -- aluminum --.

Column 42,
Line 45, "free." should read -- free end. --.

Column 44,
Line 39, "comprise:" should read -- comprises: --.

Column 45,
Line 58, "he at" should read -- heat --.

UNITED STATES PATENT AND TRADEMARK OFFICE

CERTIFICATE OF CORRECTION

PATENT NO. : 6,523,941 B2
DATED : February 25, 2003
INVENTOR(S) : Yoshie Asakawa et al.

It is certified that error appears in the above-identified patent and that said Letters Patent is hereby corrected as shown below:

Column 48,
Line 29, "signal connected to" should read -- signal supplying means connected to said --.

Signed and Sealed this

Eighteenth Day of November, 2003

JAMES E. ROGAN
*Director of the United States Patent and Trademark Office*